US010320125B2

(12) United States Patent
Ju et al.

(10) Patent No.: US 10,320,125 B2
(45) Date of Patent: Jun. 11, 2019

(54) ELECTRICAL CONNECTOR AND ELECTRICAL CONNECTOR ASSEMBLY

(71) Applicant: LOTES CO., LTD, Keelung (TW)

(72) Inventors: Ted Ju, Keelung (TW); Wu Feng, Keelung (TW); Ya Jun Zeng, Keelung (TW); Nan Fang He, Keelung (TW); Jun Fan, Keelung (TW); Jin Ke Hu, Keelung (TW); Guo Sheng Zhou, Keelung (TW); Chin Chi Lin, Keelung (TW)

(73) Assignee: LOTES CO., LTD., Keelung (TW)

( * ) Notice: Subject to any disclaimer, the term of this patent is extended or adjusted under 35 U.S.C. 154(b) by 29 days.

(21) Appl. No.: 15/637,302

(22) Filed: Jun. 29, 2017

(65) Prior Publication Data

US 2017/0302035 A1 Oct. 19, 2017

Related U.S. Application Data

(63) Continuation of application No. 14/626,709, filed on Feb. 19, 2015, now Pat. No. 9,917,405.

(Continued)

(51) Int. Cl.

| | |
|---|---|
| ***H01R 13/60*** | (2006.01) |
| ***H01R 13/6585*** | (2011.01) |
| ***H01R 24/60*** | (2011.01) |
| ***H01R 13/6581*** | (2011.01) |
| ***H01R 13/6591*** | (2011.01) |
| ***H01R 12/72*** | (2011.01) |
| ***H01R 13/6583*** | (2011.01) |

(Continued)

(52) U.S. Cl.

CPC ..... *H01R 13/6585* (2013.01); *H01R 12/724* (2013.01); *H01R 13/6581* (2013.01); *H01R 13/6583* (2013.01); *H01R 13/6591* (2013.01); *H01R 13/6594* (2013.01); *H01R 24/60* (2013.01); *H01R 2107/00* (2013.01)

(58) Field of Classification Search

CPC ..... H01R 13/6585
USPC ..... 439/660, 607.11, 607.4
See application file for complete search history.

(56) References Cited

U.S. PATENT DOCUMENTS 5,169,324 A * 12/1992 Lemke ..... H01R 13/187 439/101
7,758,379 B2 * 7/2010 Chen ..... H01R 13/6485 439/607.11

(Continued)

*Primary Examiner* — Neil Abrams
(74) *Attorney, Agent, or Firm* — Locke Lord LLP; Tim Tingkang Xia, Esq.

(57) ABSTRACT

An electrical connector used for mating a mating connector includes an insulation body having a base portion and a tongue extending from the base portion, terminals fixedly disposed in the base portion and grouped into an upper row and a lower row, and a middle shielding sheet embedded in the tongue and located between the upper and lower rows. The tongue has upper and lower surfaces arranged opposite to each other, and a front surface connected to the upper and lower surfaces. The upper and lower rows of terminals are exposed on the upper and lower, respectively. The middle shielding sheet has a front end surface extending out of the front surface, a slot formed on the front end surface, and a first projection portion extending into the slot, overlapping a central line of the middle shielding sheet along a longitudinal direction, and located behind the front surface.

12 Claims, 54 Drawing Sheets

Related U.S. Application Data

(60) Provisional application No. 62/024,728, filed on Jul. 15, 2014, provisional application No. 61/942,830, filed on Feb. 21, 2014.

(51) Int. Cl.
*H01R 13/6594* (2011.01)
*H01R 107/00* (2006.01)

(56) References Cited

U.S. PATENT DOCUMENTS 7,771,235 B2 * 8/2010 Kameyama ..... H01R 13/648 439/607.27
8,070,516 B2 * 12/2011 Chiang ..... H01R 13/6595 439/607.27
8,684,769 B2 * 4/2014 Kao ..... H01R 13/6471 439/607.28
8,808,029 B2 * 8/2014 Castillo ..... H01R 13/6585 439/607.05
8,851,927 B2 * 10/2014 Hsu ..... H01R 12/724 439/607.11
8,968,031 B2 * 3/2015 Simmel ..... H01R 13/659 439/660
9,022,800 B2 * 5/2015 Yang ..... H01R 13/6581 439/487
9,225,130 B2 * 12/2015 Zhang ..... H01R 13/405
9,231,356 B1 * 1/2016 Ju ..... H01R 24/78
9,276,365 B2 * 3/2016 Yu ..... H01R 13/6594
9,281,643 B1 * 3/2016 Tseng ..... H01R 13/518
9,300,091 B2 * 3/2016 Katayanagi ..... H01R 24/76
9,337,585 B1 * 5/2016 Yang ..... H01R 13/6583
9,356,406 B2 * 5/2016 Yen ..... H01R 13/6581
9,379,494 B1 * 6/2016 Hu ..... H01R 13/6594
9,425,560 B1 * 8/2016 Su ..... H01R 13/6591
9,461,424 B2 * 10/2016 Kao ..... H01R 13/6583
9,472,910 B2 * 10/2016 Little ..... H01R 24/60
9,484,679 B2 * 11/2016 Guo ..... H01R 13/6585
9,490,580 B2 * 11/2016 Lan ..... H01R 13/646
9,502,821 B2 * 11/2016 Little ..... H01R 13/6582
9,525,241 B1 * 12/2016 Su ..... H01R 13/6581
9,537,272 B2 * 1/2017 Chien ..... H01R 24/62
9,577,373 B2 * 2/2017 Kato ..... H01R 13/405
9,590,364 B1 * 3/2017 Chang ..... H01R 13/6581
9,601,876 B2 * 3/2017 Jiang ..... H01R 13/6585
9,608,391 B2 * 3/2017 Little ..... H01R 24/60
9,634,437 B2 * 4/2017 Kao ..... H01R 13/6471
9,647,369 B2 * 5/2017 Tsai ..... H01R 4/02
9,673,569 B2 * 6/2017 Zhang ..... H01R 13/6585
9,685,728 B2 * 6/2017 Yao ..... H01R 13/521
9,692,166 B2 * 6/2017 Kao ..... H01R 24/60
9,698,541 B2 * 7/2017 Tsai ..... H01R 13/6585
9,742,121 B2 * 8/2017 Hayashi ..... H01R 13/6585
9,755,336 B2 * 9/2017 Cheng ..... H01R 12/712
9,761,973 B2 * 9/2017 Tsai ..... H01R 12/716
9,843,141 B2 * 12/2017 Peng ..... H01R 13/6581
9,847,605 B2 * 12/2017 Liao ..... H01R 43/18
9,882,316 B2 * 1/2018 Chen ..... H01R 13/405
9,893,473 B2 * 2/2018 Kong ..... H01R 13/6594
9,917,391 B2 * 3/2018 Zhang ..... H01R 13/04
9,917,405 B2 * 3/2018 Ju ..... H01R 13/6585
9,923,286 B2 * 3/2018 Cheng ..... H01R 13/405
9,923,317 B2 * 3/2018 Yao ..... H01R 24/62
9,935,401 B2 * 4/2018 Tsai ..... H01R 13/652
9,966,693 B2 * 5/2018 Liu ..... H01R 13/22
9,991,640 B2 * 6/2018 Tziviskos ..... H01R 13/6581
9,997,853 B2 * 6/2018 Little ..... H01R 13/6471
9,997,871 B2 * 6/2018 Zhong ..... H01R 24/28
10,008,793 B2 * 6/2018 Ju ..... H01R 24/78
10,020,619 B2 * 7/2018 Zhang ..... H01R 12/7082
10,027,063 B2 * 7/2018 Peng ..... H01R 12/594
10,063,012 B2 * 8/2018 Chang ..... H01R 13/646
10,063,015 B2 * 8/2018 Zhao ..... H01R 13/5202
10,079,456 B2 * 9/2018 Chen ..... H01R 13/6461
10,096,936 B2 * 10/2018 Ju ..... H01R 13/6275
10,122,124 B2 * 11/2018 Daughtry, Jr. ..... H01R 13/405
10,148,040 B2 * 12/2018 Chien ..... H01R 13/514
10,153,566 B2 * 12/2018 Zhang ..... H01R 12/55
10,164,791 B2 * 12/2018 Wang ..... H01R 12/7023
10,170,867 B2 * 1/2019 Ju ..... H01R 13/6585
10,177,485 B2 * 1/2019 Ono ..... H01R 13/5202
2015/0340791 A1 11/2015 Kao et al.
2017/0033519 A1 2/2017 Little et al.
2017/0279234 A1 * 9/2017 Tsai ..... H01R 13/6585
2017/0302035 A1 * 10/2017 Ju ..... H01R 13/6585
2017/0310058 A1 * 10/2017 Ju ..... H01R 13/6585

* cited by examiner

200

100

ELECTRICAL CONNECTOR AND ELECTRICAL CONNECTOR ASSEMBLY

CROSS-REFERENCE TO RELATED PATENT APPLICATION

This application is a continuation application of U.S. application Ser. No. 14/626,709, filed Feb. 19, 2015, which itself claims priority to and the benefit of, pursuant to 35 U.S.C. § 119(e), U.S. provisional patent application Ser. No. 61/942,830, filed Feb. 21, 2014, entitled "ELECTRICAL CONNECTOR," by Chin Chi Lin, and U.S. provisional patent application Ser. No. 62/024,728, filed Jul. 15, 2014, entitled "ELECTRICAL CONNECTOR," by Ted Ju. The entire contents of the above identified applications are incorporated herein by reference.

Some references, if any, which may include patents, patent applications and various publications, may be cited and discussed in the description of this invention. The citation and/or discussion of such references, if any, is provided merely to clarify the description of the present invention and is not an admission that any such reference is "prior art" to the invention described herein. All references listed, cited and/or discussed in this specification are incorporated herein by reference in their entireties and to the same extent as if each reference was individually incorporated by reference.

FIELD

The present invention relates to an electrical connector and an electrical connector assembly, and more particularly to an electrical connector with high-frequency performance and an electrical connector assembly.

BACKGROUND

The background description provided herein is for the purpose of generally presenting the context of the disclosure. Work of the presently named inventors, to the extent it is described in this background section, as well as aspects of the description that may not otherwise qualify as prior art at the time of filing, are neither expressly nor impliedly admitted as prior art against the present disclosure.

With fast development of electronic elements, design specifications of the universal serial bus (USB) organization are also always being updated and upgraded. From USB 2.0 at beginning to USB 3.0 and USB 3.1 at present, or even the USB TYPE C specification, the transmission speed is higher and higher. To satisfy higher high-frequency requirements, a large quantity of efforts and capitals has been required in cooperatively developing those types of products, so that mass production can be implemented, and efficiency can be improved.

Therefore, it is necessary to design an improved electrical connector and an electrical connector assembly, so as to overcome the foregoing problem.

SUMMARY

To achieve the foregoing objective, the present invention uses the following technical means.

An electrical connector is used for mating with a mating connector. The mating connector has at least two metal elastic sheets. The electrical connector includes: an insulation body, where the insulation body has a base portion and a tongue located at a front end of the base portion; multiple terminals fixedly disposed in the base portion and grouped into an upper row of terminals and a lower row of terminals, where each of the terminals has a contact portion exposed from either an upper surface or a lower surface of the tongue, and the mating connector and the contact portion are contacted; a middle shielding sheet, fixedly disposed at the base portion and the tongue, where the middle shielding sheet is located between the upper row of terminals and the lower row of terminals; at least two snap-fit portions disposed at two sides of the middle shielding sheet and exposed from two sides of the tongue, where two of the metal elastic sheets buckle the snap-fit portions to stop the metal elastic sheet from being disengaged; and an outer metal casing, where the outer metal casing wraps peripheries of the base portion and the tongue.

In one embodiment, the electrical connector further has an inner metal casing. The inner metal casing has at least one covering portion disposed on an upper surface of the tongue, and at least one extending portion extending from the covering portion toward the base portion. The extending portion has at least one contact arm, and the contact arm urges an inner wall of the outer metal casing. The extending portion is provided with two positioning portions, the base portion is provided with two positioning slots corresponding to the two positioning portions, and the two positioning slots accommodate and fix the two positioning portions.

In one embodiment, the upper row of multiple terminals are separately two grounding terminals, two power supply terminals and two signal terminals, the lower row of multiple terminals are separately two grounding terminals, two power supply terminals and two signal terminals, and the upper row of multiple terminals and the lower row of multiple terminals are disposed symmetrically on the upper surface and the lower surface of the tongue.

In one embodiment, the middle shielding sheet has a plate portion fixedly disposed in the tongue. Two protruding portions extend separately from two sides of the plate portion out of the two sides of the tongue, two of the snap-fit portions are grooves disposed at the two protruding portions, and the two grooves are located out of the two sides of the tongue.

In one embodiment, the outer metal casing has a wrapping casing and a shielding casing. The wrapping casing wraps the peripheries of the base portion and the tongue. The shielding casing is disposed out of the wrapping casing. Each of two sides of the wrapping casing has a first soldering pin. Each of two sides of the shielding casing has a second soldering pin. The first soldering pin and the second soldering pin are staggered front and back. The first soldering pin is close to a lateral side of the base portion, and the second soldering pin is close to a lateral side of the tongue.

In one embodiment, the wrapping casing has a first rear wall, and the shielding casing has a second rear wall. The first rear wall has a first middle portion and first sheltering portions located at two sides of the first middle portion. The second rear wall has a second middle portion and a second sheltering portion connected to a lower part of the second middle portion. The first middle portion and the second middle portion are approximately superposed front and back, the second rear wall forms a notch at a place corresponding to the first sheltering portion, and the second sheltering portion exceeds the first middle portion downward.

In another aspect, an electrical connector assembly includes an electrical connector and a mating connector. The electrical connector includes: an insulation body, where the insulation body has a base portion and a tongue located at a front end of the base portion, multiple terminals are fixedly disposed in the base portion and grouped into an upper row of terminals and a lower row of terminals, and each of the terminals has a contact portion exposed from either of an upper surface and a lower surface of the tongue;

a middle shielding sheet, fixedly disposed at the base portion and the tongue, where the middle shielding sheet is located between the upper row of terminals and the lower row of terminals; at least two snap-fit portions disposed at two sides of the middle shielding sheet and exposed from two sides of the tongue; and an outer metal casing, where the outer metal casing wraps peripheries of the base portion and the tongue, and two of the metal elastic sheets buckle the snap-fit portions to stop the metal elastic sheet from being disengaged. The mating connector has two metal elastic sheets corresponding to two of the snap-fit portions. When the mating connector and the electrical connector are mated, the two metal elastic sheets are respectively cooperatively fixed to two of the snap-fit portions, and the mating connector and the contact portion are contacted.

In one embodiment, the mating connector has an insertion portion, the insertion portion has a mating space, each of two sides of the insertion portion has a hollowing portion in communication with the mating space, the two metal elastic sheets are at least partially located at the two sides of the insertion portion, and pass through the hollowing portion to enter the mating space, and the tongue and the snap-fit portions are located in the mating space.

In one embodiment, the mating connector has a metal cover. The metal cover is formed by means of one-piece drawing or stretching. The metal cover has a front segment and a rear segment connected to each other. The front segment has a top surface and a bottom surface provided opposite to each other, and two side surfaces connected to the top surface and the bottom surface. A place at where the top surface or the bottom surface is connected to the rear segment is provided with a step. The two side surfaces and the rear segment are in a form of direct extension.

In another aspect, an electrical connector, which is used for mating a mating connector, is characterized by including an insulation body having a base portion and a tongue extending forward from the base portion. The tongue has an upper surface and a lower surface which are arranged opposite to each other, and has a front surface connected to the upper surface and the lower surface. The electrical connector further includes multiple terminals divided into an upper row and a lower row and fixed to the insulation body, where the upper row of terminals are exposed on the upper surface, and the lower row of terminals are exposed on the lower surface. The electrical connector further includes a middle shielding sheet embedded in the tongue and located between the upper row of terminals and the lower row of terminals, where the middle shielding sheet has a front end surface extending out of the front surface. A slot is formed on the front end surface, a first projection portion extends into the slot, and overlaps a central line of the middle shielding sheet along a longitudinal direction. And the first projection portion is located behind the front surface.

In one embodiment, the terminals include a pair of signal terminals which are in compliance with the USB 2.0 specifications, and the pair of signal terminals are arranged to vertically correspond to the first projection portion.

In one embodiment, the middle shielding sheet has a first hole, the first hole is located behind the first projection portion, and overlaps the central line of the middle shielding sheet along the longitudinal direction, and moreover, the first hole is arranged to vertically correspond to the pair of signal terminals.

In one embodiment, the middle shielding sheet has two second holes, the two second holes are located behind the first projection portion, and are located on both sides of the central line of the middle shielding sheet along the longitudinal direction, and the two second holes are arranged to one-to-one vertically correspond to the pair of signal terminals.

In one embodiment, the middle shielding sheet has a third hole, the third hole is located between the slot and the side edge of the middle shielding sheet, the terminals include a grounding terminal, and the third hole is arranged to vertically correspond to the grounding terminal.

In one embodiment, the slot defines a first space, the first space is located on one side of the first projection portion, the terminals include a power supply terminal, and the power supply terminal is arranged to vertically correspond to the first space.

In one embodiment, each row of the terminals include at least one pair of differential signal terminals, each differential signal terminal has a first portion and a second portion extending from the first portion, the first portion and the second portion are arranged on the tongue, and moreover, the width of the first portion is larger than the width of the second portion.

In one embodiment, the distance between the two neighboring first portions is larger than the distance between the two neighboring second portions.

In one embodiment, each row of the terminals include two non-high-speed terminals, the two non-high-speed terminals are arranged on two sides of the pair of differential signal terminals, and the distance between the first portion and the neighboring non-high-speed terminal is less than the distance between the second portion and the neighboring non-high-speed terminal.

In one embodiment, each terminal has a soldering portion, the soldering portion extends out of the base portion, the soldering portions of the upper row of terminals are arranged in a row, and the soldering portions of the lower row of terminals are arranged in two rows.

In one embodiment, the middle shielding sheet bends and extends to form a pin, the pin extends out of the base portion, each terminal has a soldering portion, which extends out of the base portion, and the soldering portions of the lower row of terminals and the pin are located on the same straight line.

In one embodiment, the electrical connector further has a metal casing wrapping the insulation body, the metal casing comprises a shielding casing and a wrapping casing, the wrapping casing wraps the base portion and the tongue, and the shielding casing is arranged outside of the wrapping casing.

In one embodiment, each of two sides of the wrapping casing has a first soldering pin, each of two sides of the shielding casing has a second soldering pin, the first soldering pins and the second soldering pins are staggered in the longitudinal direction, the first soldering pins are closer to the base portion than the second soldering pins are, and the second soldering pins are closer to the tongue than the first soldering pins are.

In one embodiment, the wrapping casing has a first rear wall, the shielding casing has a second rear wall, the first rear wall and the second rear wall cover the base portion, each terminal is provided with a connecting portion, the connecting portion is embedded in the base portion, and projections of the first rear wall, the second rear wall and connecting portions of the terminals in the longitudinal direction overlap each other.

In one embodiment, each of two sides of the shielding casing has a second soldering pin, the two second soldering portions are located on two sides of the insulation body, a fixing pin extends from the second rear wall, and the fixing pin is located between the two second soldering pins.

Compared with the related art, the present invention has the following beneficial effects.

When the mating connector is inserted into the electrical connector after the electrical connector is completely assembled, two of the snap-fit portions are disposed at two sides of the tongue and cooperatively fixed to the mating connector, thereby being in firm snap-fit to ensure stable high-frequency performance.

The multiple terminals are arranged on the upper surface and the lower surface of the tongue. The tongue has the front surface. A middle shielding sheet, embedded in the tongue, is located between the upper row of terminals and the lower row of terminals. The front end of the middle shielding sheet is provided with the slot. The first projection portion is located in the slot, overlaps the central line, and is arranged to vertically correspond to the pair of signal terminals, thereby enhancing the shielding effect. The front end surface extends beyond the front surface to protect the tongue. The first projection portion does not extend beyond the front surface, so that the middle shielding sheet and the tongue can be better fixed, and the probability of short-circuiting caused by the electrical contact between the terminals and the middle shielding sheet due to foreign matters (such as dust and moisture) attached on the tongue is effectively decreased.

These and other aspects of the present disclosure will become apparent from the following description of the preferred embodiment taken in conjunction with the following drawings and their captions, although variations and modifications therein may be affected without departing from the spirit and scope of the novel concepts of the disclosure.

BRIEF DESCRIPTION OF THE DRAWINGS

The present disclosure will become more fully understood from the detailed description and the accompanying drawings.

DETAILED DESCRIPTION

Figure 1:
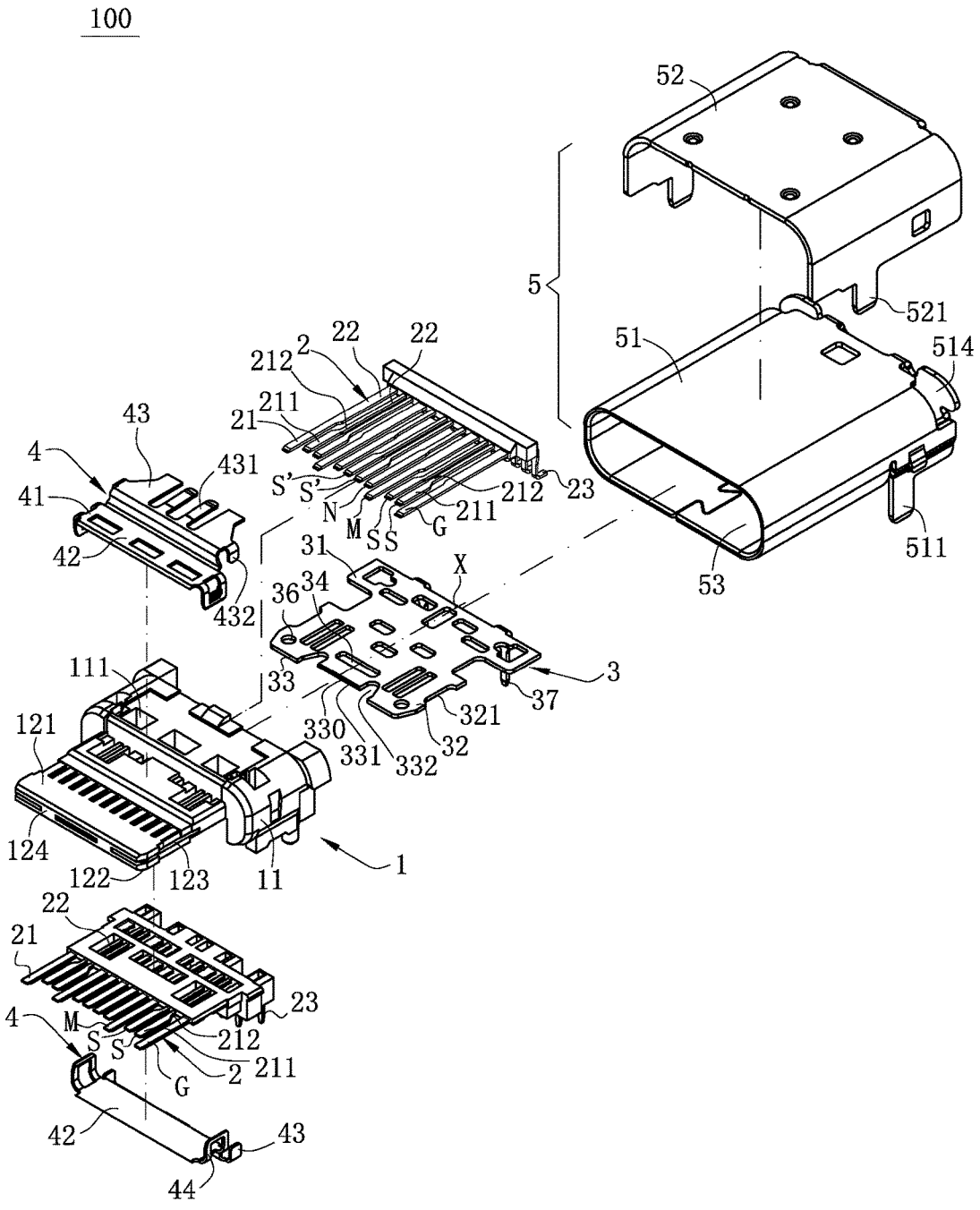
FIG. 1 is a three-dimensional exploded view of an electrical connector according to one embodiment of the present invention.

The present disclosure is more particularly described in the following examples that are intended as illustrative only since numerous modifications and variations therein will be apparent to those skilled in the art. Various embodiments of the disclosure are now described in detail. Referring to the drawings, like numbers, if any, indicate like components throughout the views. As used in the description herein and throughout the claims that follow, the meaning of "a", "an", and "the" includes plural reference unless the context clearly dictates otherwise. Also, as used in the description herein and throughout the claims that follow, the meaning of "in" includes "in" and "on" unless the context clearly dictates otherwise. Moreover, titles or subtitles may be used in the specification for the convenience of a reader, which shall have no influence on the scope of the present disclosure. Additionally, some terms used in this specification are more specifically defined below.

The terms used in this specification generally have their ordinary meanings in the art, within the context of the disclosure, and in the specific context where each term is used. Certain terms that are used to describe the disclosure are discussed below, or elsewhere in the specification, to provide additional guidance to the practitioner regarding the description of the disclosure. For convenience, certain terms may be highlighted, for example using italics and/or quotation marks. The use of highlighting has no influence on the scope and meaning of a term; the scope and meaning of a term is the same, in the same context, whether or not it is highlighted. It will be appreciated that same thing can be said in more than one way. Consequently, alternative language and synonyms may be used for any one or more of the terms discussed herein, nor is any special significance to be placed upon whether or not a term is elaborated or discussed herein. Synonyms for certain terms are provided. A recital of one or more synonyms does not exclude the use of other synonyms. The use of examples anywhere in this specification including examples of any terms discussed herein is illustrative only, and in no way limits the scope and meaning of the disclosure or of any exemplified term. Likewise, the disclosure is not limited to various embodiments given in this specification.

Unless otherwise defined, all technical and scientific terms used herein have the same meaning as commonly understood by one of ordinary skill in the art to which this disclosure pertains. In the case of conflict, the present document, including definitions will control.

As used herein, the term "and/or" includes any and all combinations of one or more of the associated listed items.

As used herein, "around", "about" or "approximately" shall generally mean within 20 percent, preferably within 10 percent, and more preferably within 5 percent of a given value or range. Numerical quantities given herein are approximate, meaning that the term "around", "about" or "approximately" can be inferred if not expressly stated.

As used herein, "plurality" and/or "multiple" means two or more.

As used herein, the terms "comprising," "including," "carrying," "having," "containing," "involving," and the like are to be understood to be open-ended, i.e., to mean including but not limited to.

As used herein, the phrase at least one of A, B, and C should be construed to mean a logical (A or B or C), using a non-exclusive logical OR. It should be understood that one or more steps within a method may be executed in different order (or concurrently) without altering the principles of the present disclosure.

It will be understood that, although the terms first, second, third, etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, a first element, component, region, layer or section discussed below can be termed a second element, component, region, layer or section without departing from the teachings of the present invention.

It will be understood that when an element is referred to as being "on", "attached" to, "connected" to, "coupled" with, "contacting", etc., another element, it can be directly on, attached to, connected to, coupled with or contacting the other element or intervening elements may also be present. In contrast, when an element is referred to as being, for example, "directly on", "directly attached" to, "directly connected" to, "directly coupled" with or "directly contacting" another element, there are no intervening elements present. It will also be appreciated by those of skill in the art that references to a structure or feature that is disposed "adjacent" to another feature may have portions that overlap or underlie the adjacent feature.

Furthermore, relative terms, such as "lower" or "bottom" and "upper" or "top", may be used herein to describe one element's relationship to another element as illustrated in the figures. It will be understood that relative terms are intended to encompass different orientations of the device in addition to the orientation shown in the figures. For example, if the device in one of the figures is turned over, elements described as being on the "lower" side of other elements would then be oriented on the "upper" sides of the other elements. The exemplary term "lower" can, therefore, encompass both an orientation of lower and upper, depending on the particular orientation of the figure. Similarly, if the device in one of the figures is turned over, elements described as "below" or "beneath" other elements would then be oriented "above" the other elements. The exemplary terms "below" or "beneath" can, therefore, encompass both an orientation of above and below.

As used herein, the term "module" may refer to, be part of, or include an Application Specific Integrated Circuit (ASIC); an electronic circuit; a combinational logic circuit; a field programmable gate array (FPGA); a processor (shared, dedicated, or group) that executes code; other suitable hardware components that provide the described functionality; or a combination of some or all of the above, such as in a system-on-chip. The term module may include memory (shared, dedicated, or group) that stores code executed by the processor.

The terms "chip" or "computer chip", as used herein, generally refer to a hardware electronic component, and may refer to or include a small electronic circuit unit, also known as an integrated circuit (IC), or a combination of electronic circuits or ICs.

As shown in FIG. 1, FIG. 16, FIG. 7, and FIG. 12, an electrical connector 100 of the present invention is an electrical connector socket supporting high-speed data transmission, and a mating connector 200 is an electrical connection plug supporting high-speed data transmission.

Figure 16:
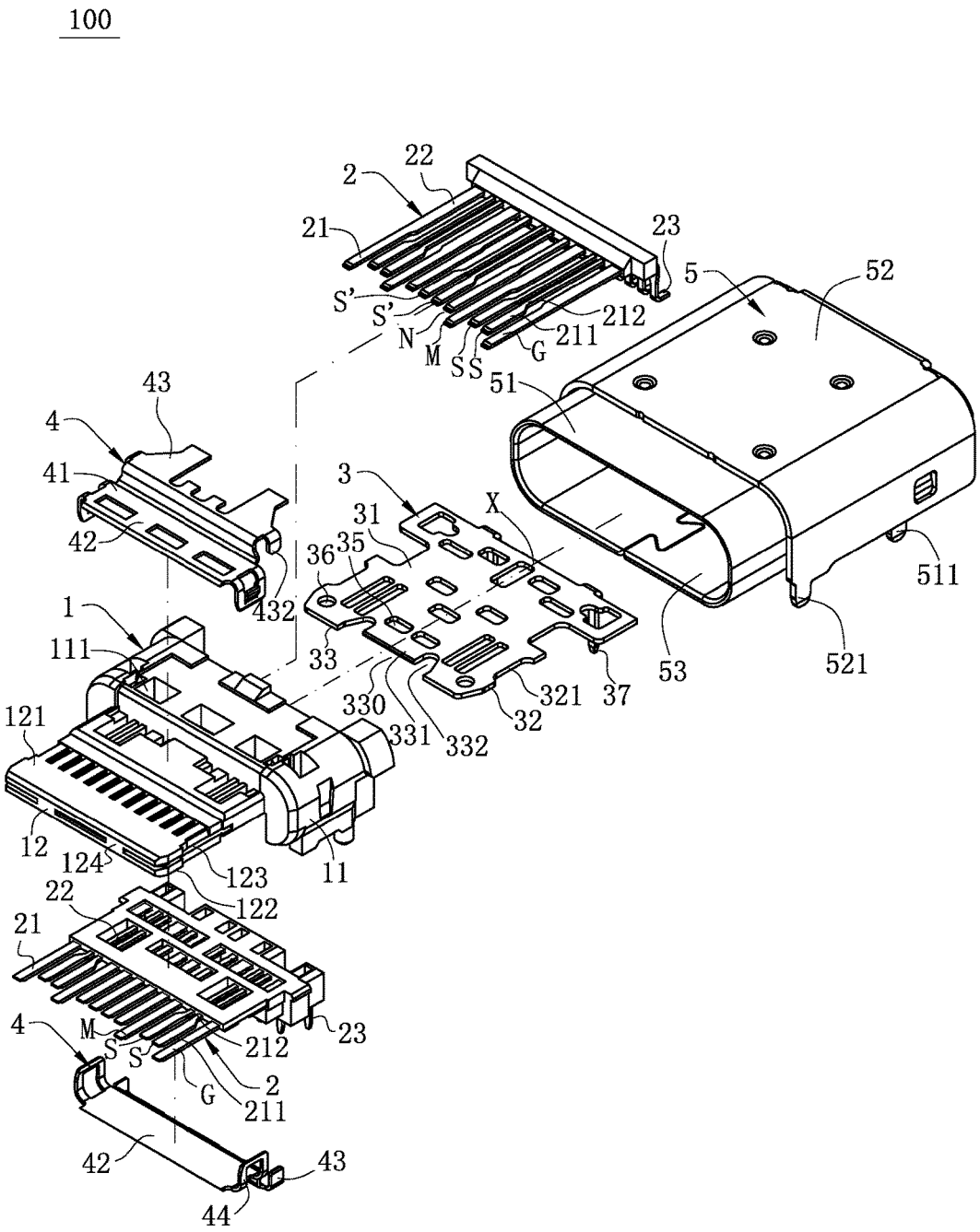
FIG. 16 is a three-dimensional exploded view of an electrical connector according to a third embodiment of the present invention.
Figure 17:
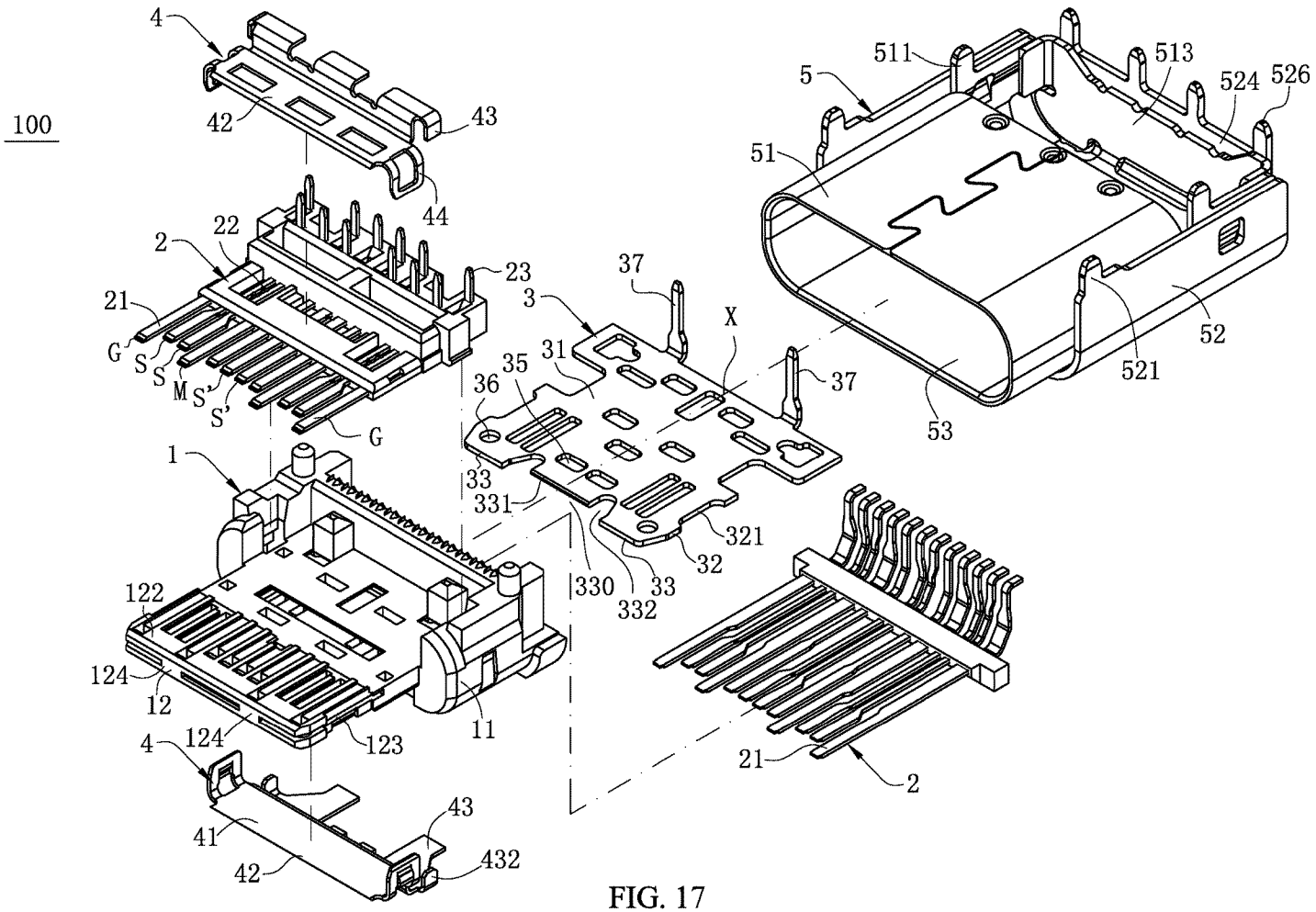
FIG. 17 is a three-dimensional exploded view of the electrical connector viewed from another viewing angle according to the third embodiment of the present invention.

As shown in FIG. 1 and FIG. 16, the electrical connector 100 includes an insulation body 1; multiple terminals 2 fixedly disposed at the insulation body 1; a middle shielding sheet 3 fixedly disposed at the insulation body 1; an inner metal casing 4, covering and fixed onto the insulation body 1; and an outer metal casing 5, framing the insulation body 1 and the inner metal casing 4 to form an insertion space 53.

As shown in FIG. 7 to FIG. 11, the mating connector 200 has a main body 6 and an insertion portion 7 formed by extending forward from the main body 6. The insertion portion 7 has a mating space 73. Each of two sides of the insertion portion 7 has a hollowing portion 74 in communication with the mating space 73. Two metal elastic sheets 8 are fixed to two sides of the main body 6, and partially extend forward and are located at the two sides of the insertion portion 7. The two metal elastic sheets 8 pass through the hollowing portion 74 to enter the mating space 73, and are conveniently for stable snap-fitting with the electrical connector 100. An upper grounding sheet 81 and a lower grounding sheet 82 are respectively disposed at a top 71 and a bottom 72 of the insertion portion 7. The upper grounding sheet 81 and the lower grounding sheet 82 at least partially pass through the insertion portion 7 to enter the mating space 73, so as to be cooperatively fixed to the electrical connector 100, and a grounding objective may further be achieved. A middle grounding sheet 83 is located in the main body 6 and the insertion portion 7.

As shown in FIG. 12 to FIG. 15, the mating connector 200 further has a metal cover 9 surrounding the main body 6 and the insertion portion 7. The metal cover 9 is formed by means of one-piece drawing or stretching. The metal cover 9 has a front segment 91 and a rear segment 92 connected to each other. The front segment 91 has a top surface 911 and a bottom surface 912 disposed opposite to each other, and two side surfaces 913 connected to the top surface 911 and the bottom surface 912. A place at which the top surface 911 or the bottom surface 912 is connected to the rear segment 92 is provided with a step 93. The two side surfaces 913 and the rear segment 92 are in a form of direct extension, that is, the top surface 911 and the bottom surface 912 of the front segment 91 are backward reamed, so that the place at which the top surface 911 or the bottom surface 912 is connected to the rear segment 92 is provided with the step 93, while the two side surfaces 913 of the front segment 91 are not backward reamed, and therefore a place at which each of the two side surfaces 913 is connected to the rear segment 92 is not provided with any step 93, so as to facilitate molding and save the space in the width direction. The upper grounding sheet 81, the lower grounding sheet 82 and the middle grounding sheet 83 all contact the metal cover 9, grounding paths become more, and the grounding effect is stable.

Figure 2:
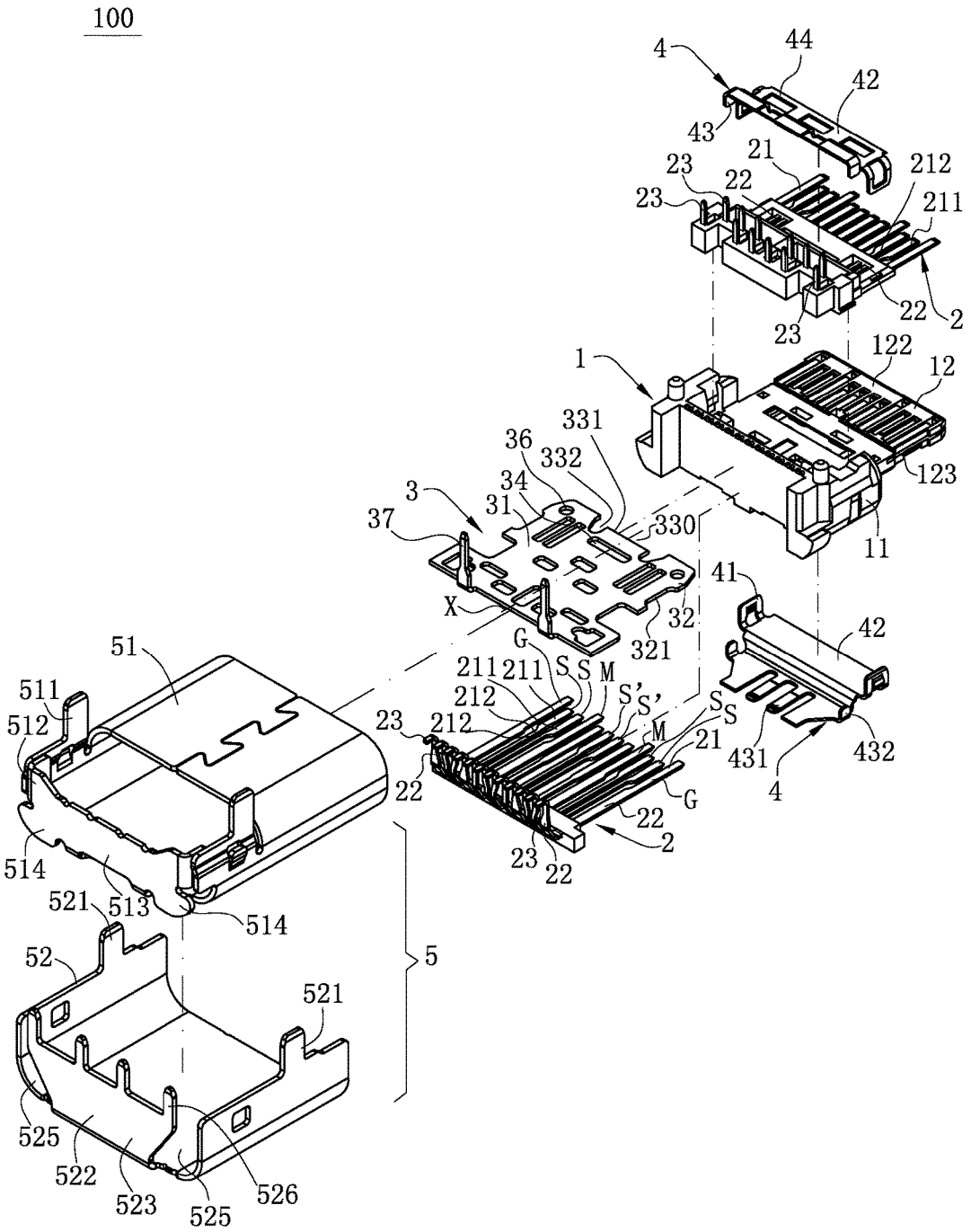
FIG. 2 is a three-dimensional exploded view of the electrical connector viewed from another viewing angle according to one embodiment of the present invention.
Figure 3:
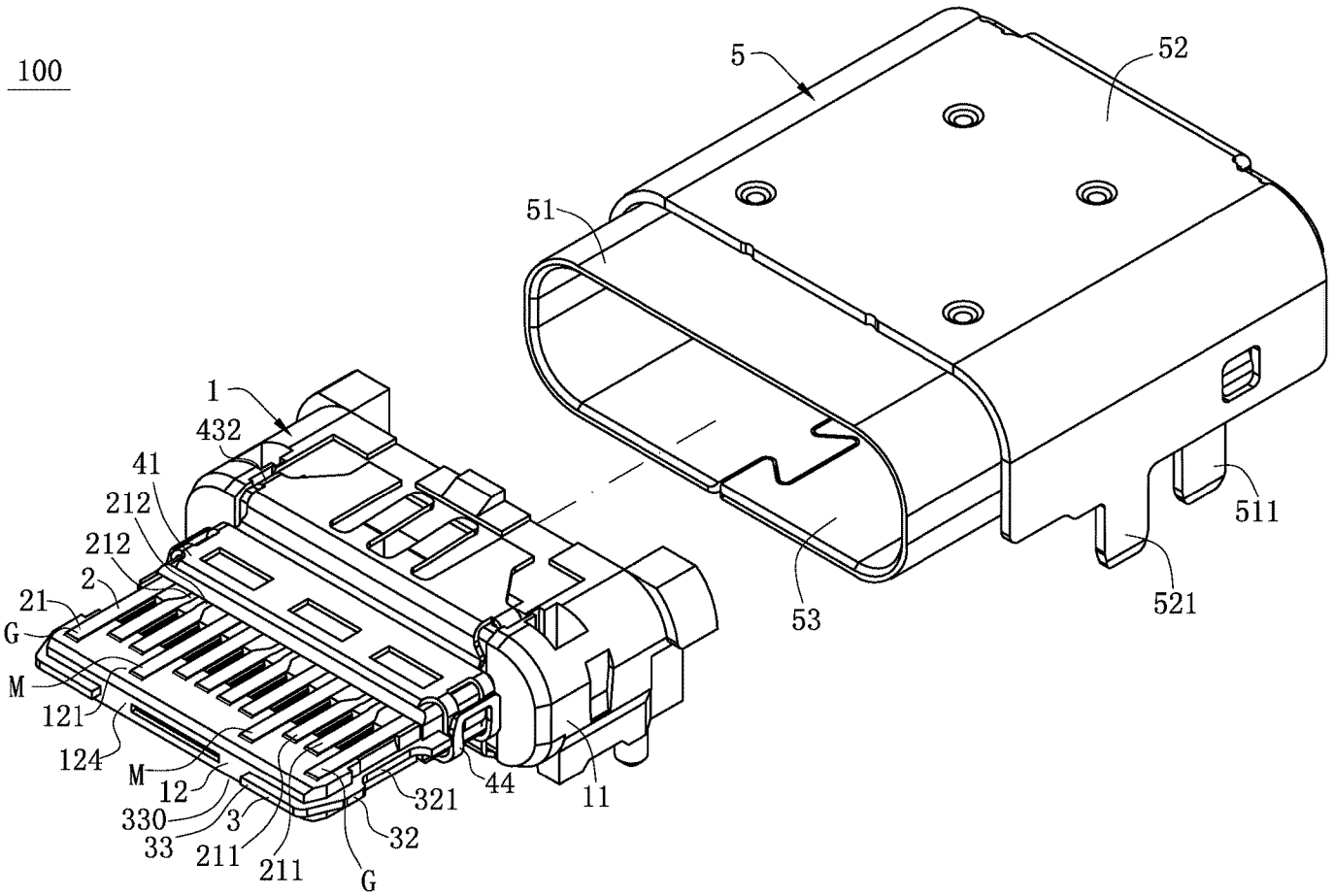
FIG. 3 is a partial three-dimensional exploded view of the electrical connector according to one embodiment of the present invention.
Figure 4:
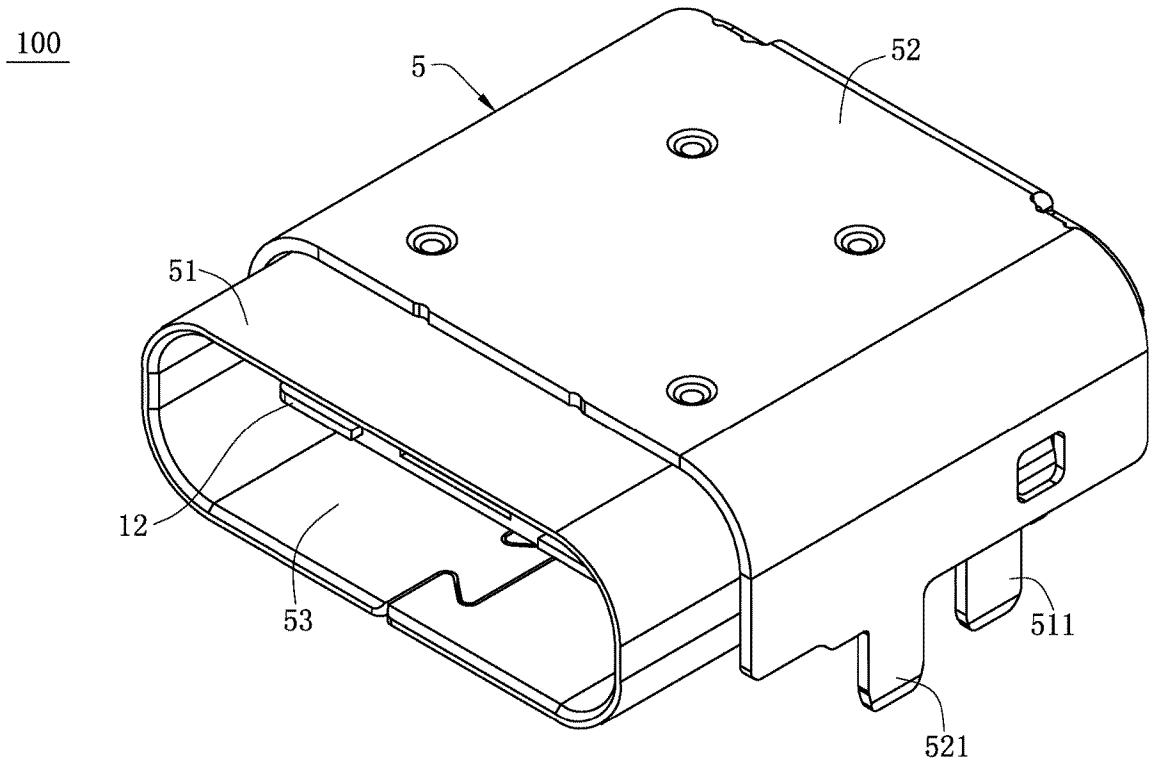
FIG. 4 is a three-dimensional assembly drawing of the electrical connector according to one embodiment of the present invention.

As shown in FIG. 1 to FIG. 3, the insulation body 1 has a base portion 11 and a tongue 12 located at a front end of the base portion 11. The base portion 11 is provided with two positioning slots 111. The tongue 12 has an upper surface 121 and a lower surface 122 disposed opposite to each other, and a front surface 124 is connected to the upper surface 121 and the lower surface 122. Each of two sides of the tongue 12 is provided with a snap-fit slot 123, and the two snap-fit slots 123 are formed into two snap-fit portions (not labeled). When the mating connector 200 and the electrical connector 100 are mated, the two metal elastic sheets 8 are respectively cooperatively fixed to the two snap-fit portions, and the tongue 12 and the snap-fit slots 123 are all located in the mating space 73.

As shown in FIG. 1 to FIG. 3, the multiple terminals 2 are fixedly disposed in the base portion 11 and grouped into an upper row of terminals and a lower row of terminals. Each of the terminals has a contact portion 21 exposed from an upper surface 121 or a lower surface 122 of the tongue 12, so that the mating connector 200 and the contact portions 21 are contacted. The multiple terminals 2 include multiple pairs of high-speed terminals S, two power supply terminals M, two grounding terminals G, two reserved terminals N and the like. In other embodiments (not shown), the upper row of multiple terminals 2 are separately two grounding terminals G, two power supply terminals M, two signal terminals S' and two reserved terminals N, the lower row of multiple terminals 2 are separately two grounding terminals G, two power supply terminals M, two signal terminals S' and two reserved terminals N, the upper row of multiple terminals 2 and the lower row of multiple terminals 2 are disposed symmetrically on the upper surface 121 and the lower surface 122 of the tongue 12, where the signal terminals S', the grounding terminals G and the power supply terminals M are non-high-speed terminals. Certainly, in some embodiments, the reserved terminals N may further be removed. That is, the terminal type may be adjusted when necessary, and the functionality is enhanced. The high-speed terminals S of the multiple terminals 2 are differential signal terminals S. The high-speed terminals S among the multiple terminals 2 are differential signal terminals S, parts of the differential signal terminals S located in the base portion 11 and the tongue 12 are close to one another, and the differential signal terminals are away from the grounding terminals G at an adjacent side. Specifically, the contact portion 21 of the differential signal terminal S has a first portion 211, a second portion 212 extends from the first portion 211, the width of the first portion 211 is larger than the width of the second portion 212, the distance between each two neighboring first portions 211 is larger than the distance between each two neighboring second portions 212, the distance between the grounding terminal G and the neighboring first portion 211 is less than the distance between the grounding terminal G and the neighboring second portion 212, and the distance between the power supply terminal M and the neighboring first portion 211 is less than the distance between the power supply terminal M and the neighboring second portion 212.

Figure 34:
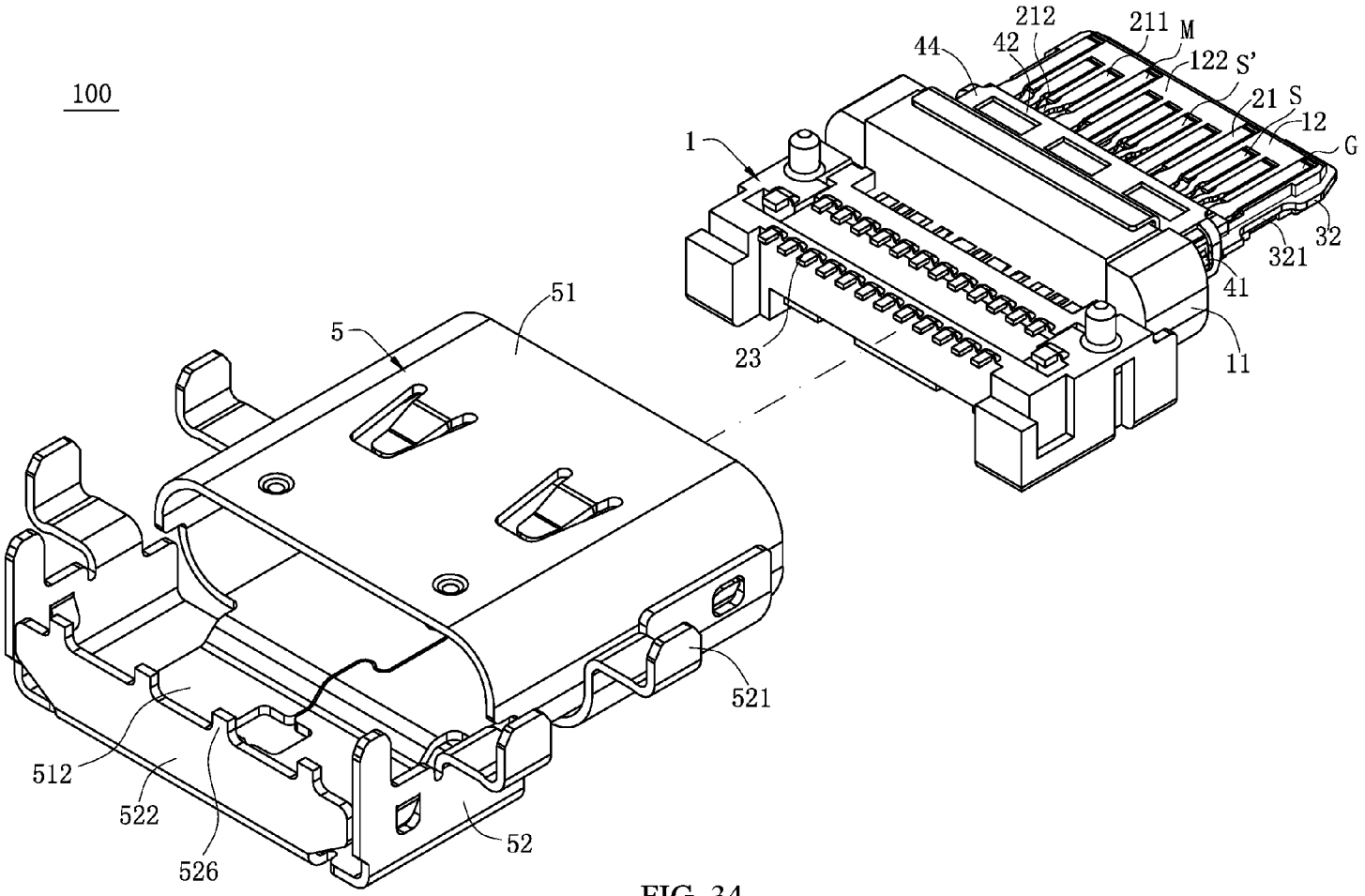
FIG. 34 is a partial three-dimensional exploded view of the electrical connector according to the tenth embodiment of the present invention.
Figure 35:
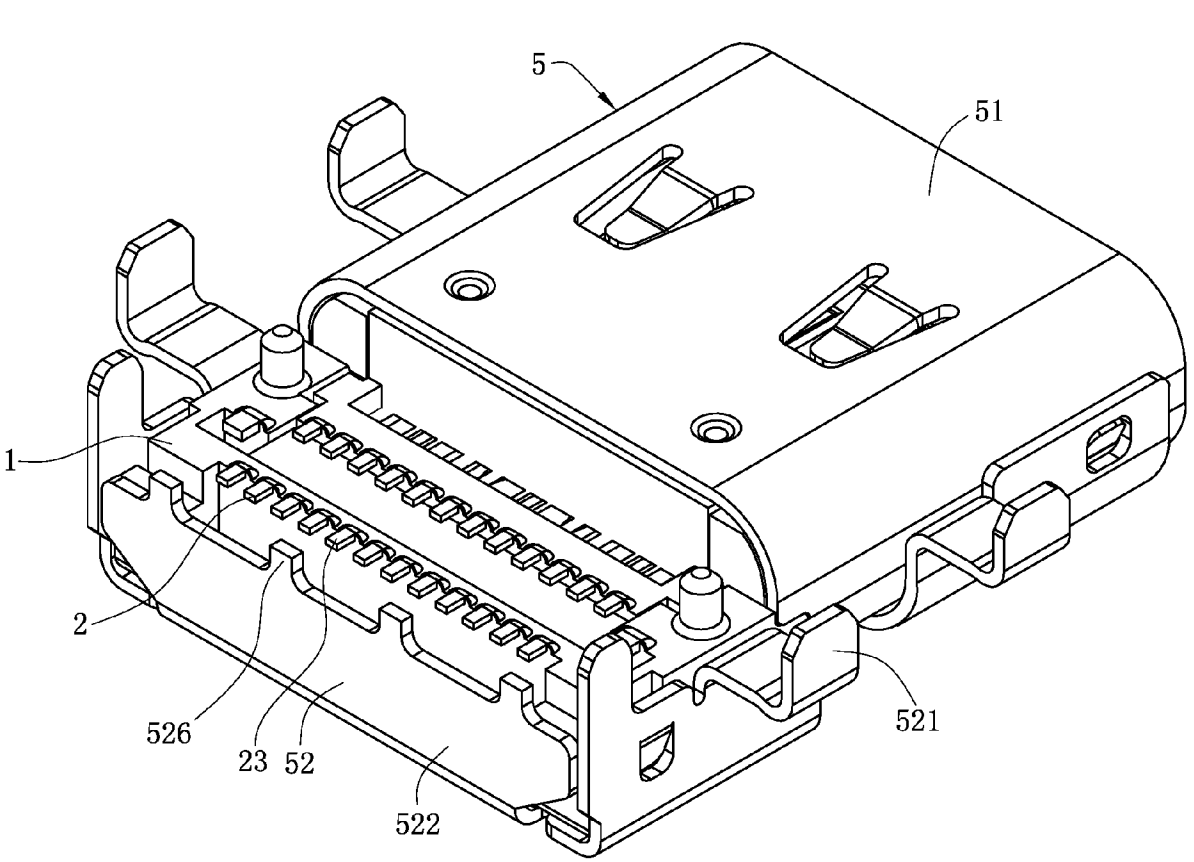
FIG. 35 is a three-dimensional assembly view of the electrical connector viewed from another viewing angle according to the tenth embodiment of the present invention.

A connecting portion 22 extends backward from the contact portion 21, the connecting portion 22 is embedded in the base portion 11, the connecting portion 22 includes a horizontally arranged portion and a vertically arranged portion, a soldering portion 23 extends from the vertical portion of the connecting portion 22, and extends out of the base portion 11, and moreover, the multiple soldering portions 23 of the lower row of terminals 2 are arranged in two rows or, according to an actual requirement, can also be arranged in a row (see FIG. 34).

As shown in FIG. 1 and FIG. 3, the number of the multiple terminals 2 may reach to 24. The upper row of terminals 2 are 12 in number, and are separately a grounding terminal G, a pair of high-speed terminals S, a power supply terminal M, a reserved terminal N, two USB 2.0 terminals (signal terminals S'), a reserved terminal N, a power supply terminal M, a pair of high-speed terminals S and a grounding terminal G.

Correspondingly, the lower row of terminals 2 are 12 in number, and are distributed corresponding to the upper row of terminals 2, so that the mating connector 200 may be inserted into the electrical connector 100 in dual orientation. The grounding terminals G are located on the outer sides of each row of terminals 2, and the pair of signal terminals S' are located in the middle of each row of terminals 2. Among each row of the terminals 2, the two power supply terminals M are located on two sides of the pair of signal terminals S' and the reserved terminals N.

The terminals 2 are large in number, and the electrical connector 100 is very small in volume, and therefore the multiple terminals 2 are arranged very densely in the insulation body 1. In this way, the assembly difficulty increases, and the electrical connector 100 is in the USB C TYPE, which has very high requirements on volume and high-frequency, and therefore the terminals 2 in the electrical connector 100 cannot be mounted to the insulation body 1 in an assembly manner. Therefore, the insulation body 1 has three parts independent from each other. The upper row of terminals 2 are integrally formed in a first part of the insulation body 1 by means of injection molding, the lower row of terminals 2 are integrally formed in a second part of the insulation body 1 by means of injection molding, and then the two are mounted in a third part of the insulation body 1. Certainly, in other embodiments, it may also be that, the insulation body 1 has two parts independent from each other, the upper row of terminals 2 are integrally formed in a first part of the insulation body 1 by means of injection molding, the lower row of terminals 2 are integrally formed in a second part of the insulation body 1 by means of injection molding, then the two are mounted and fixed together, and a third part does not need to be used. Alternatively, when requirements on high-frequency and functions of the electrical connector 100 are low, the terminals 2 are correspondingly reduced in number, and it may be appropriately considered that some of the terminals 2 are mounted, and other terminals are integrally formed by means of injection molding.

Multiple locations of the insulation body 1, corresponding to the terminals 2, are each provided with an adjustment hole (not labeled). The adjustment hole enables the terminals 2 to be exposed out of the insulation body 1, and is used for adjusting impedance of the terminals 2, so that the electrical connector 100 may meet the high-frequency requirements in the industry.

As shown in FIG. 1, the middle shielding sheet 3 is fixedly disposed at the base portion 11 and the tongue 12, a central line X of the middle shielding sheet 3 extends along a longitudinal direction, and the middle shielding sheet 3 is located between the upper row of terminals 2 and the lower row of terminals 2, so as to ensure the shielding effect, and ensure high-frequency performance. The middle shielding sheet 3 has a plate portion 31 fixedly disposed in the tongue 12. Two protruding portions 32 separately extend out of the two sides of the tongue 12 from two sides of the plate portion 31. The two snap-fit portions are grooves 321 disposed at the two protruding portions 32. The two grooves 321 are located out of the two sides of the tongue 12, and locations of the grooves 321 are corresponding to locations of the snap-fit slots 123. When the mating connector 200 is inserted into the electrical connector 100 (not shown), the insertion portion 7 enters the insertion space 53, and the metal elastic sheet 8 is snap-fit in the snap-fit slots 123 and the grooves 321.

Certainly, in other embodiments, the tongue 12 is not provided with the snap-fit slots 123, and only the protruding portions 32 are provided with the grooves 321 cooperatively fixed to the metal elastic sheet 8, or, only the tongue 12 is provided with the snap-fit slots 123 cooperatively fixed to the metal elastic sheets 8.

Figure 6:
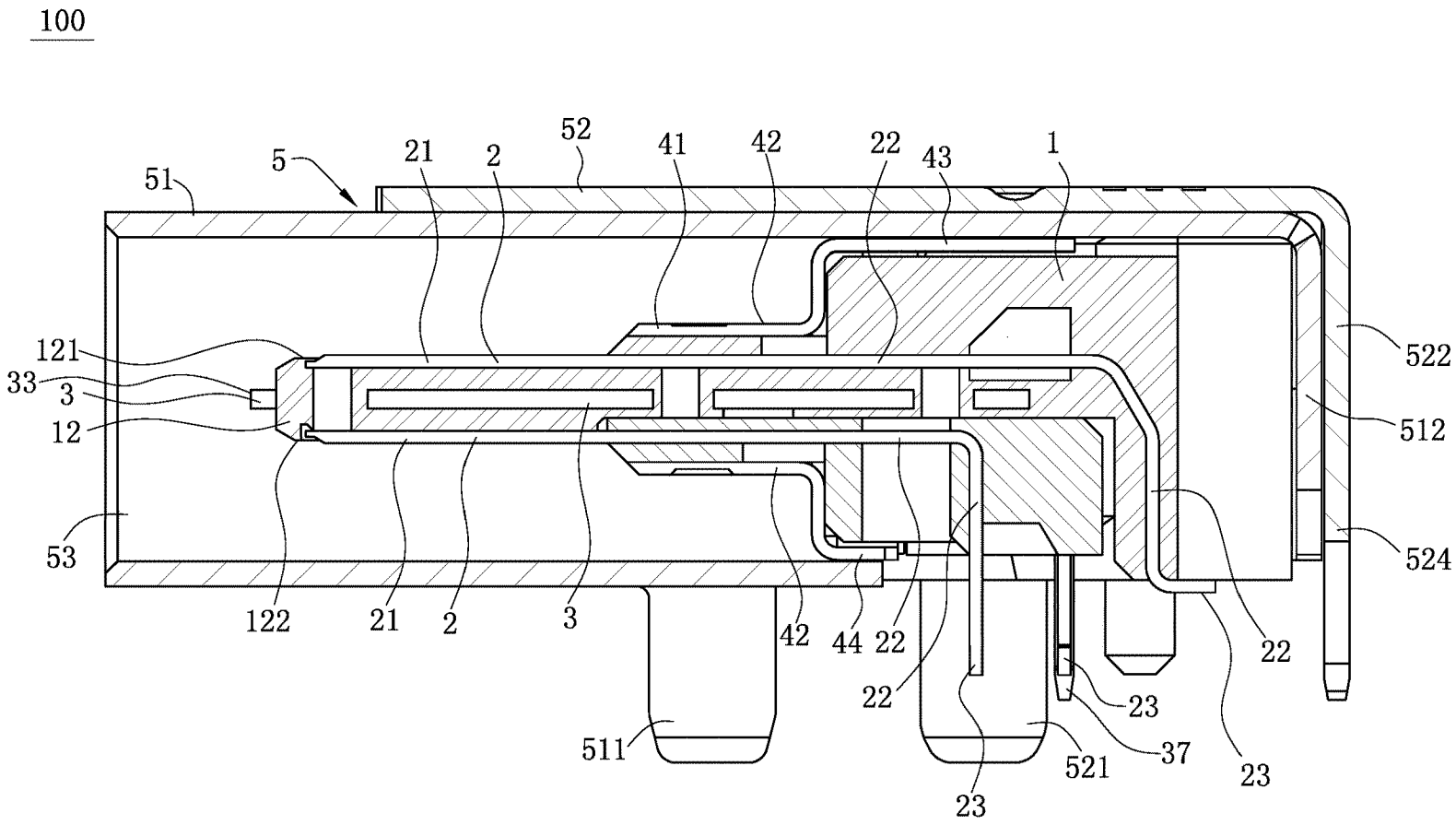
FIG. 6 is a sectional view of the electrical connector according to one embodiment of the present invention.
Figure 7:
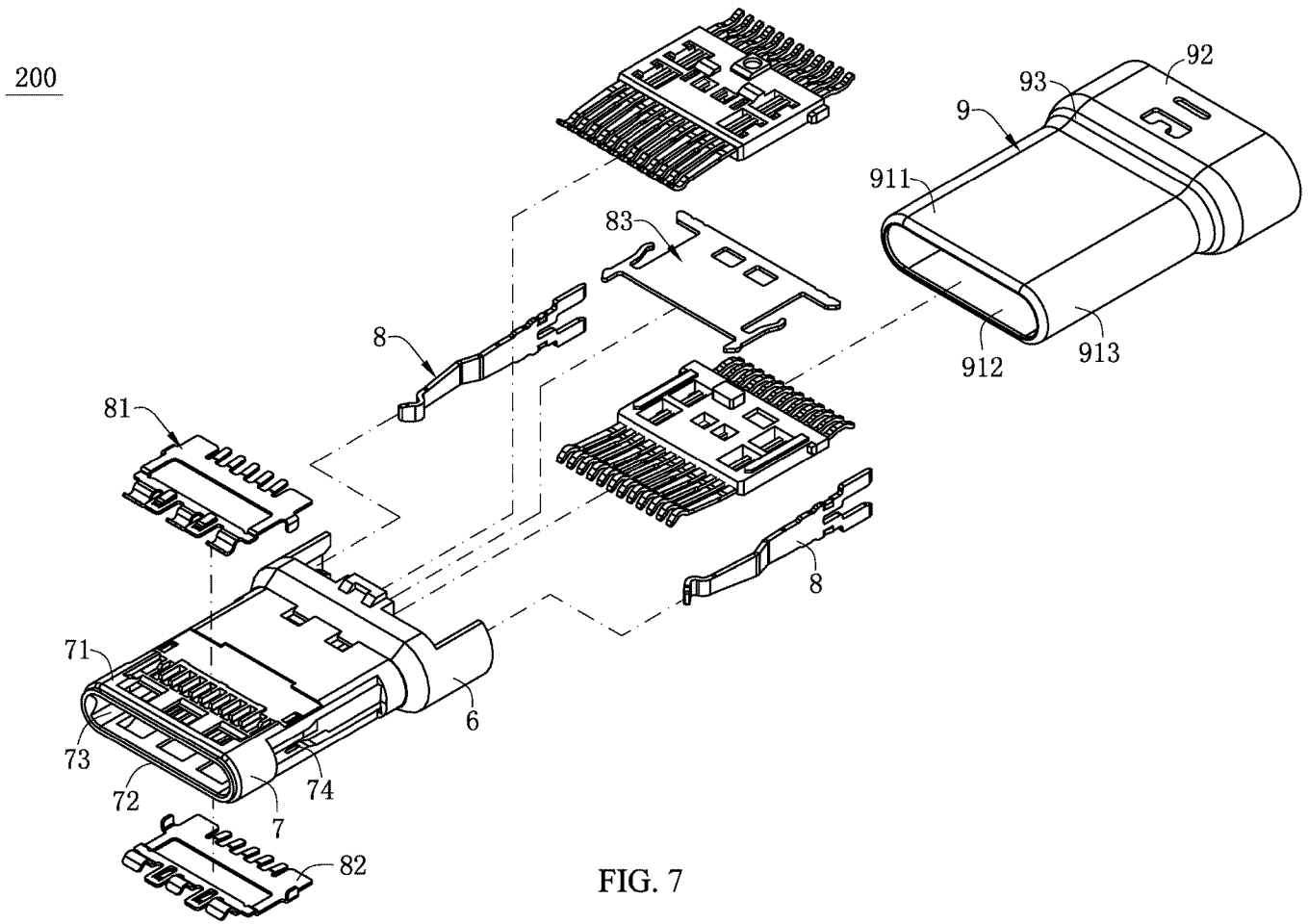
FIG. 7 is a three-dimensional exploded view of a mating connector according to one embodiment of the present invention.
Figure 8:
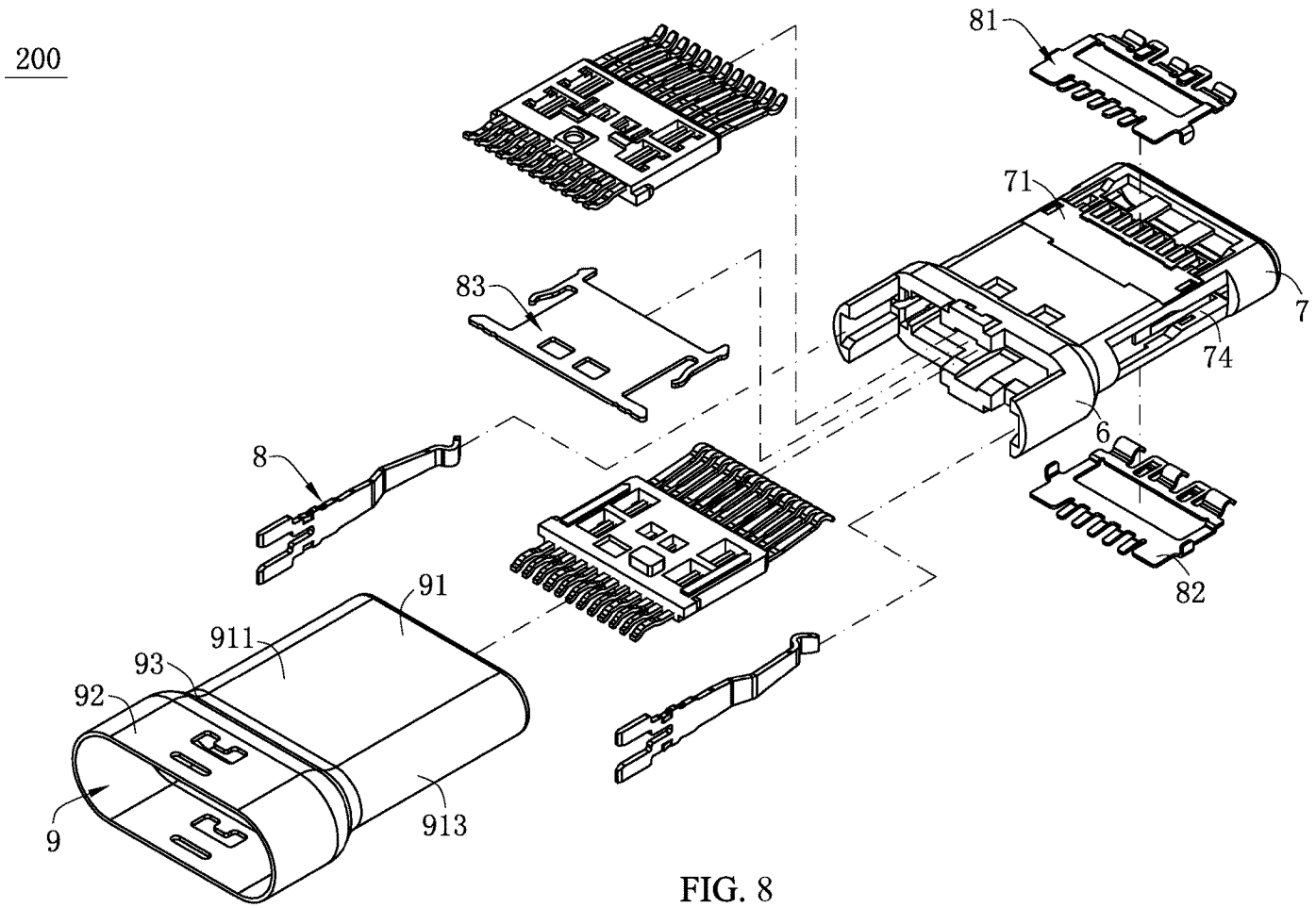
FIG. 8 is a three-dimensional exploded view of the mating connector viewed from another viewing angle according to one embodiment of the present invention.
Figure 9:
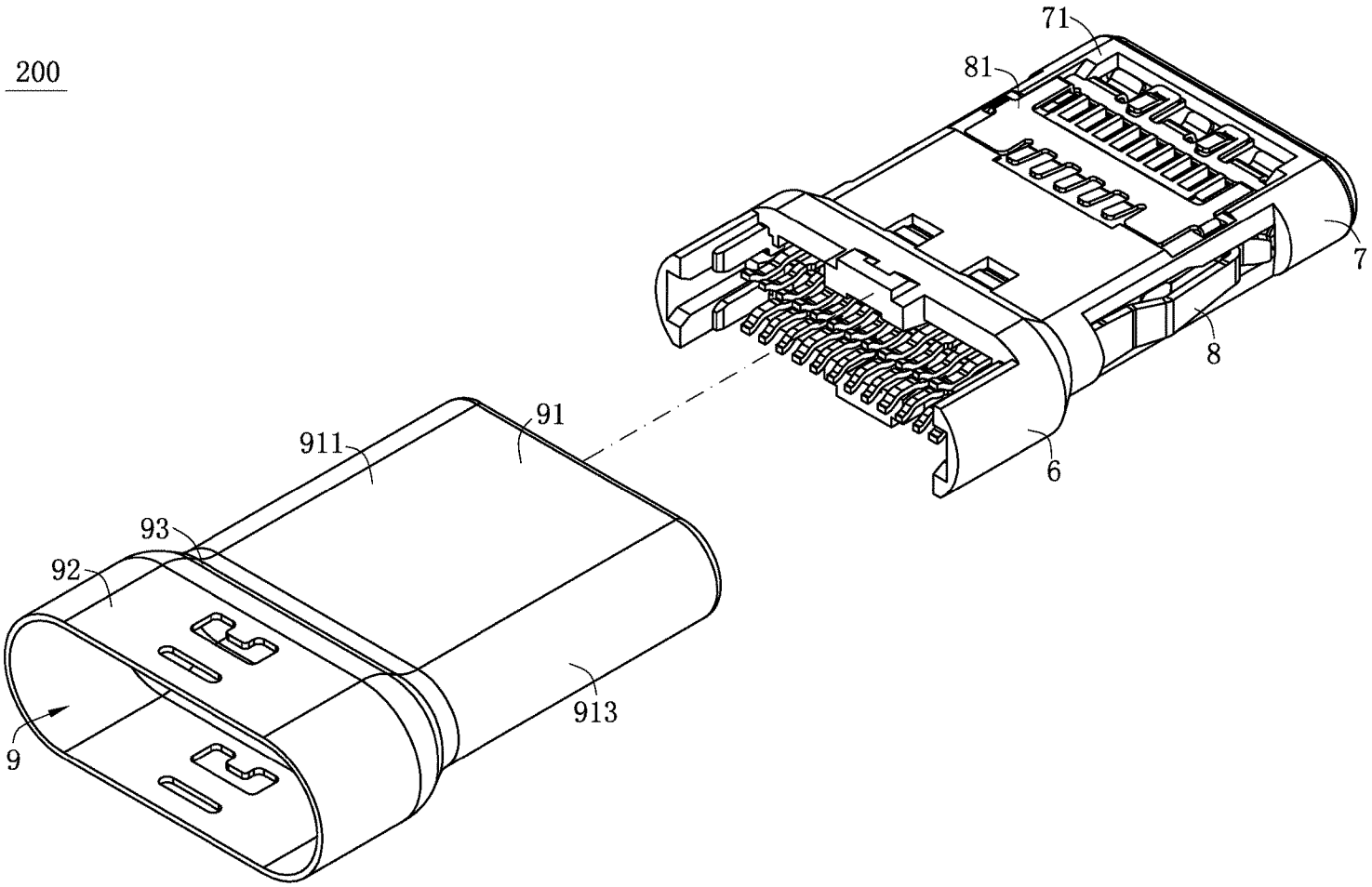
FIG. 9 is a partial three-dimensional exploded view of the mating connector according to one embodiment of the present invention.
Figure 10:
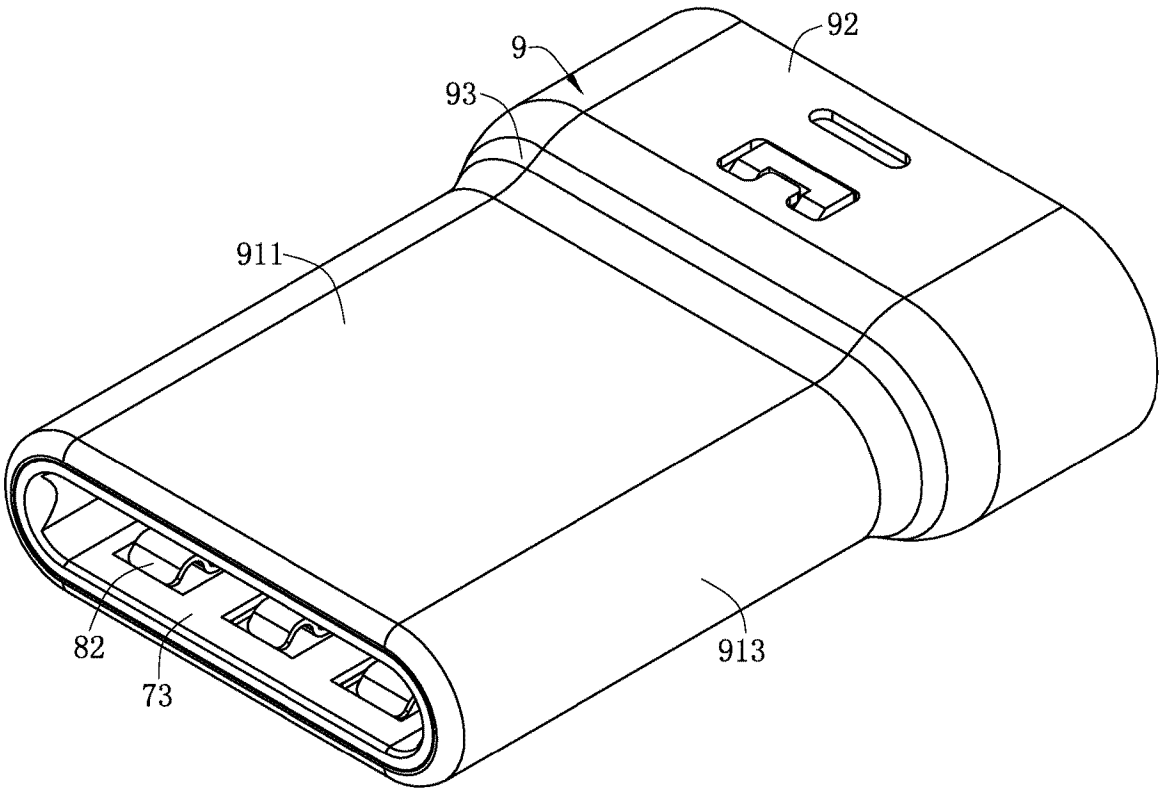
FIG. 10 is a three-dimensional assembly drawing of the mating connector according to one embodiment of the present invention.
Figure 11:
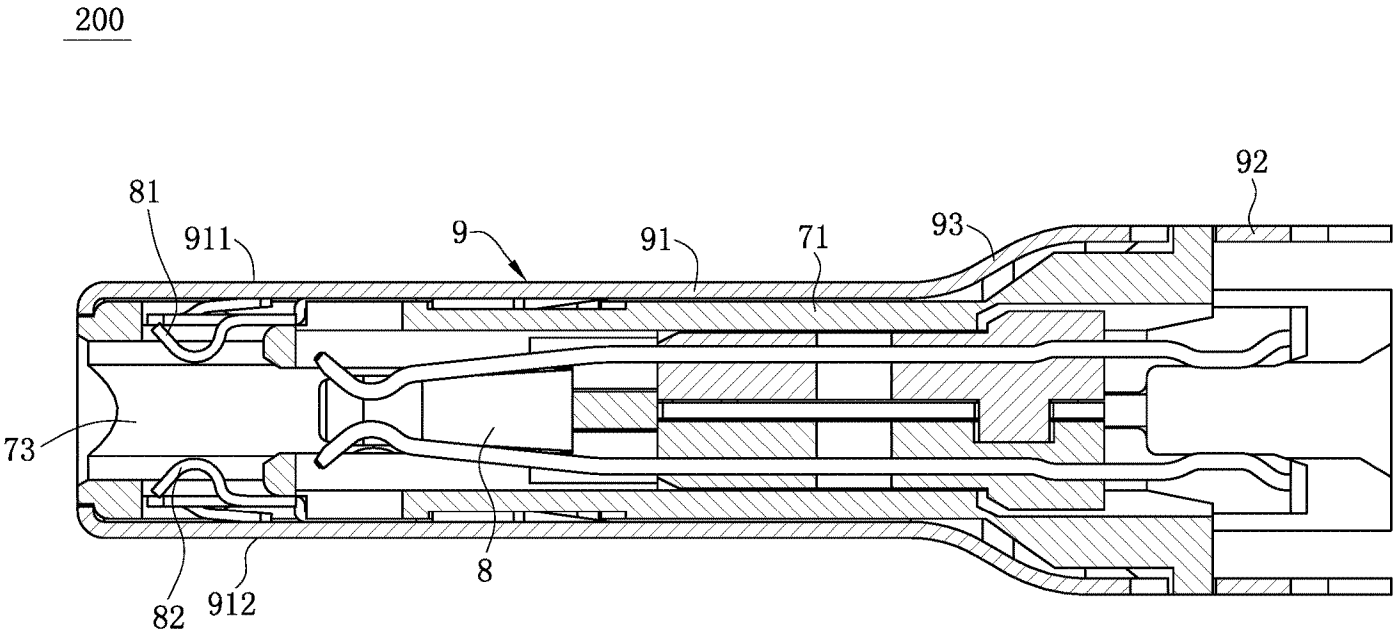
FIG. 11 is a sectional view of the mating connector according to one embodiment of the present invention.
Figure 12:
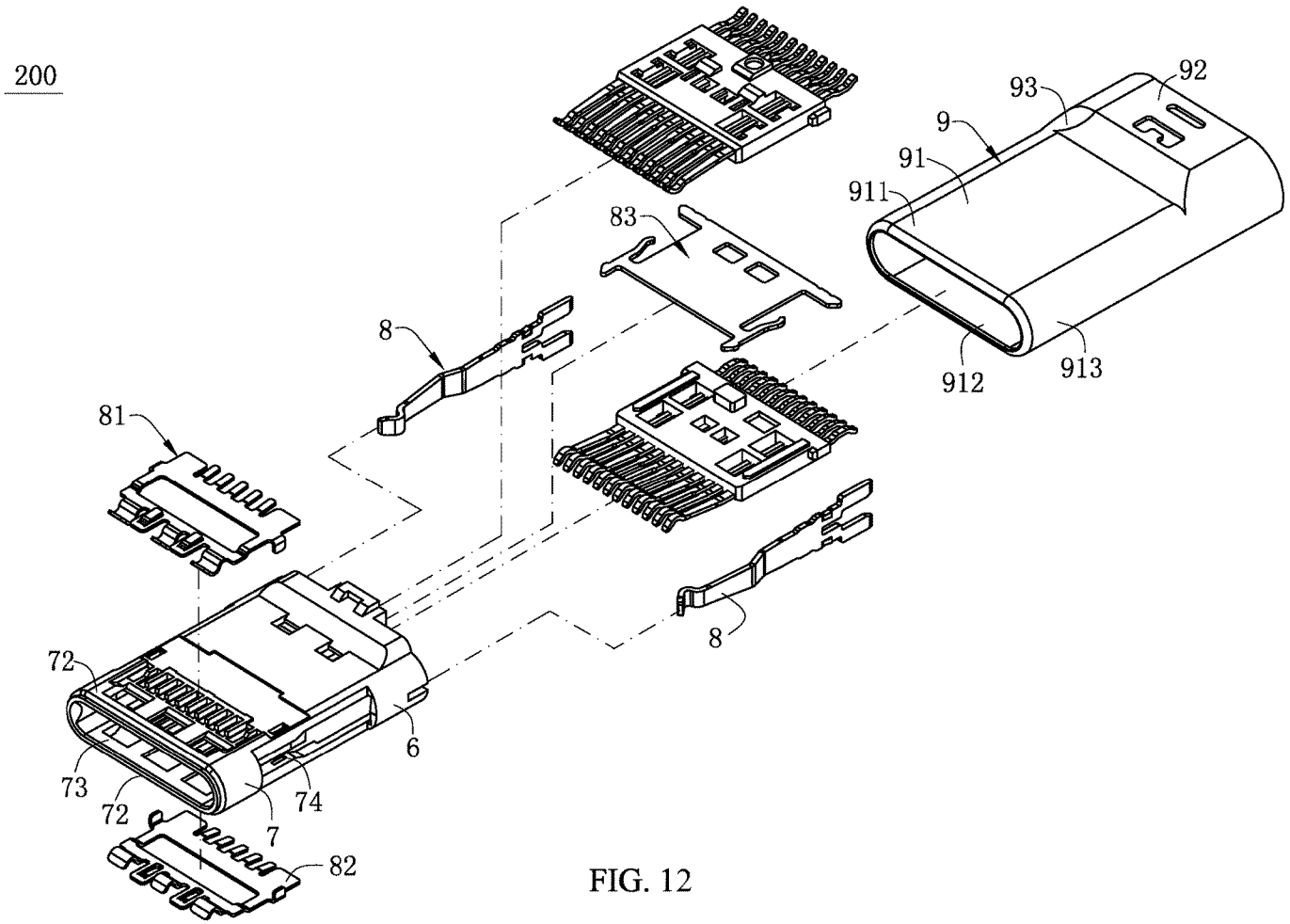
FIG. 12 is a three-dimensional exploded view of a mating connector according to a second embodiment of the present invention.
Figure 13:
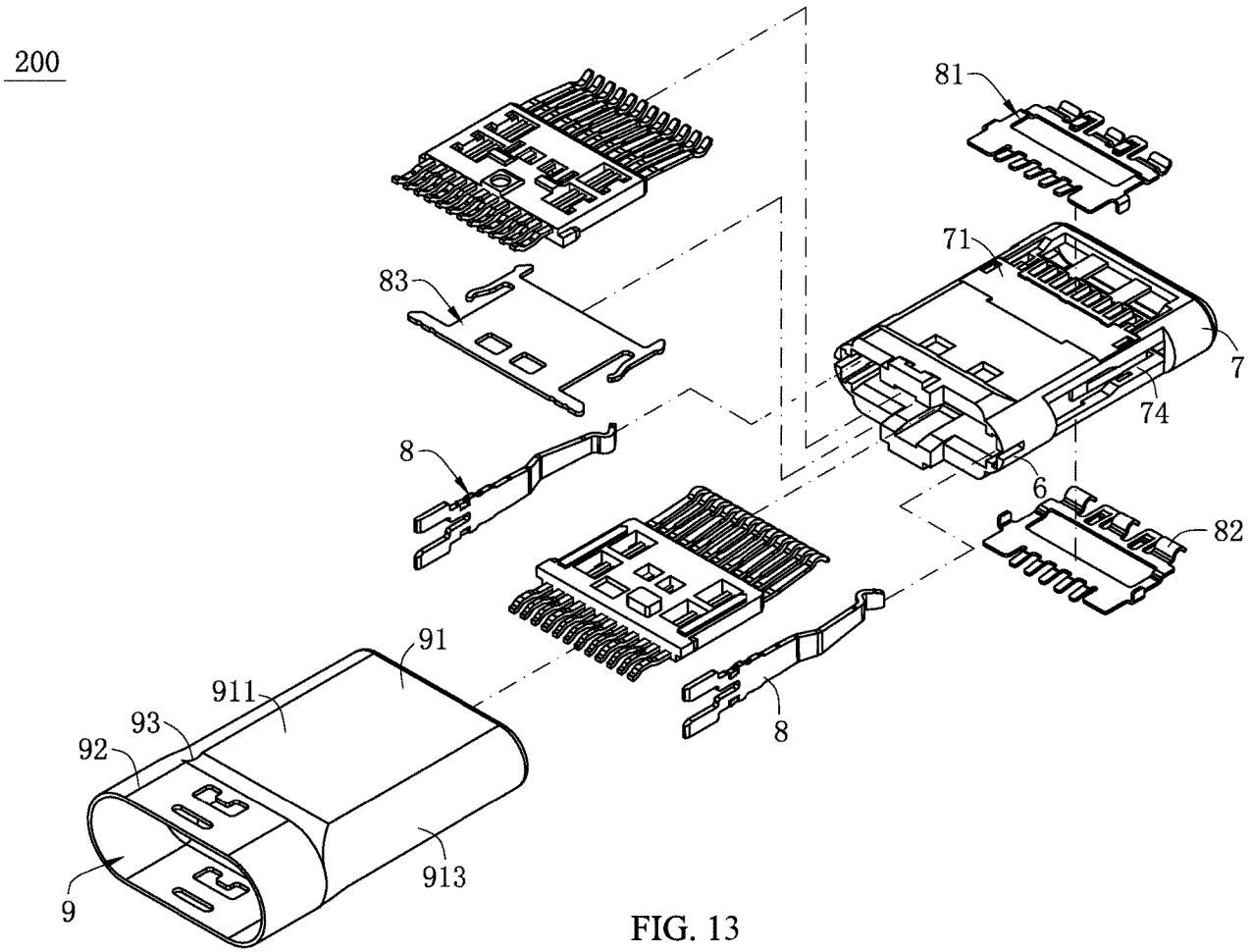
FIG. 13 is a three-dimensional exploded view of the mating connector viewed from another viewing angle according to the second embodiment of the present invention.
Figure 14:
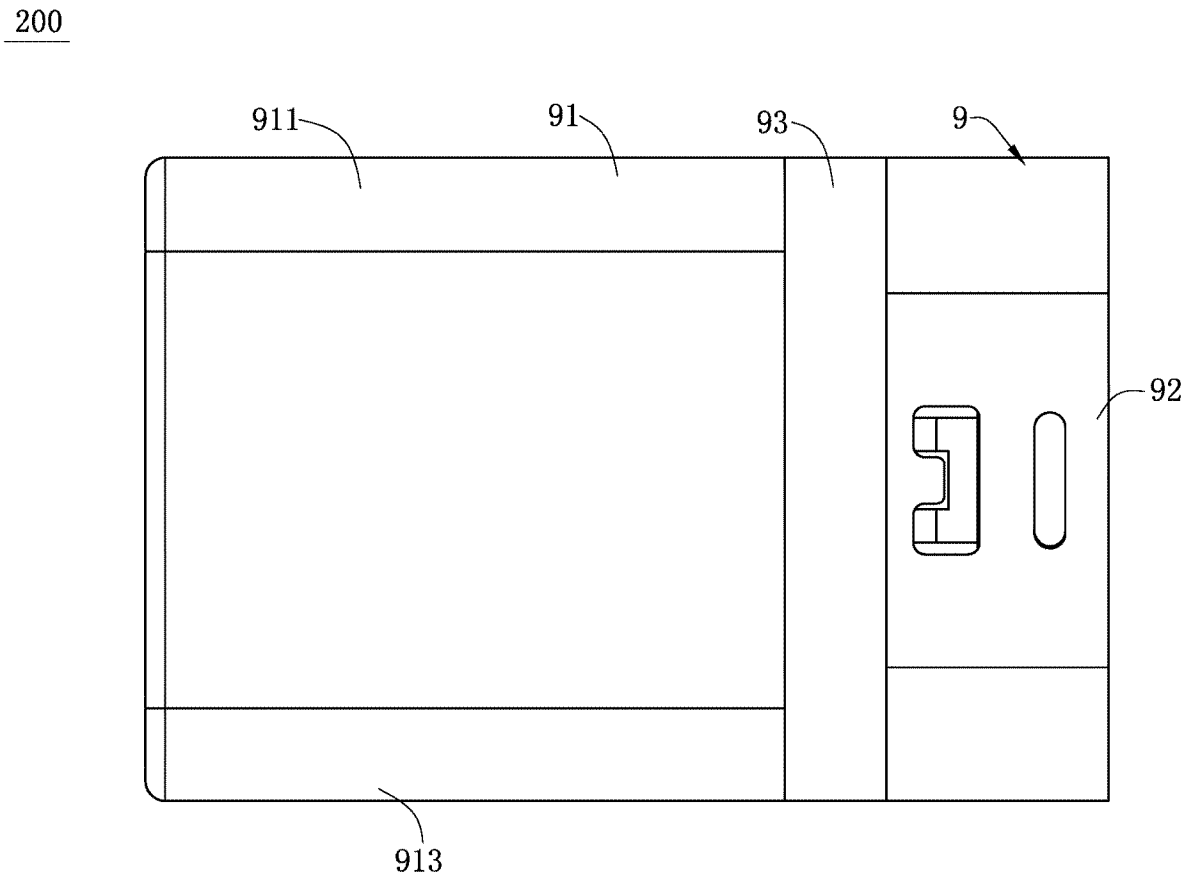
FIG. 14 is a top view of a metal cover of the mating connector according to the second embodiment of the present invention.
Figure 15:
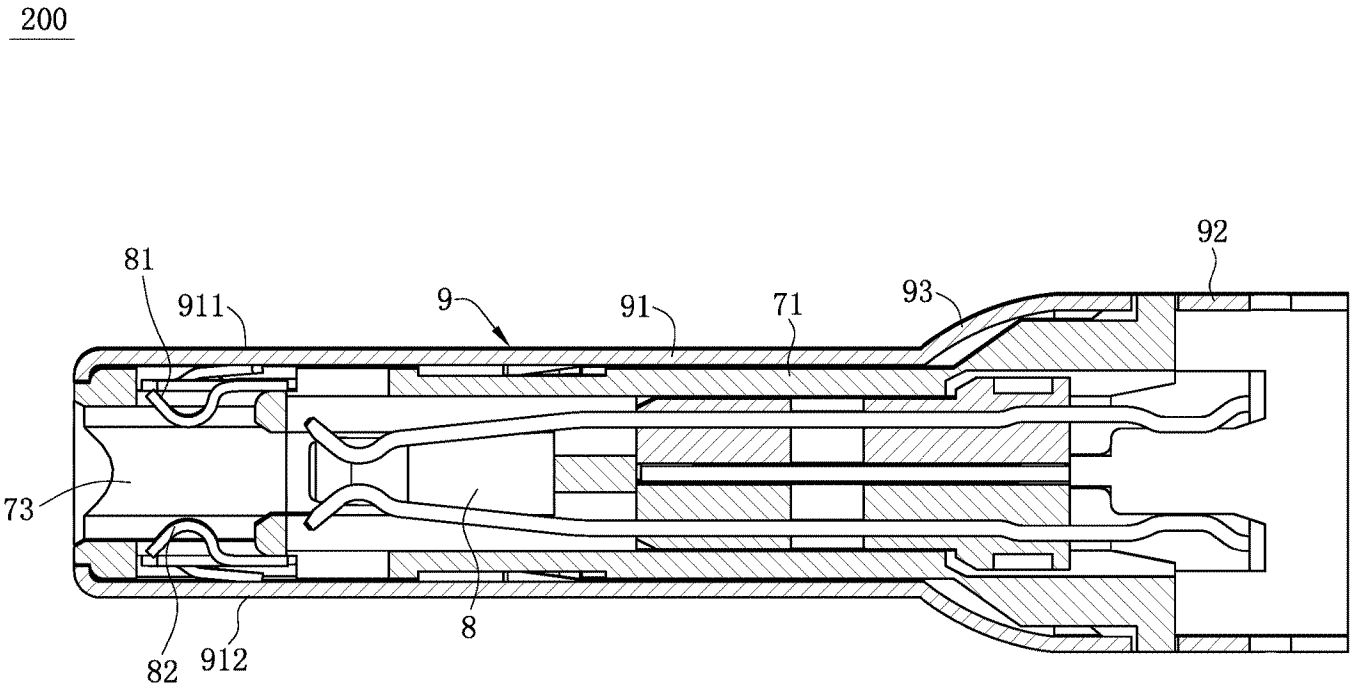
FIG. 15 is a sectional view of the mating connector according to the second embodiment of the present invention.

As shown in FIG. 1, FIG. 3 and FIG. 6, the plate portion 31 has a front end surface 33, a slot 330 is formed on the front end surface 33, overlaps the central line X and is located in front of the groove 321. A first projection portion 331 extends from the plate portion 31 into the slot 330, and the first projection portion 331 extends along the longitudinal direction. The slot 330 defines two first spaces 332, and the two first spaces 332 are respectively located on two sides of the first projection portion 331, that is, the first spaces 331 are located between the first projection portion 331 and the side edges of the slot 330. As shown in FIG. 3, the middle shielding sheet 3 is embedded in the insulation body 1, the two power supply terminals M are arranged to vertically correspond to the slot 330, the first spaces 332 are close to the two side edges of the slot 330, the power supply terminals M are close to the two side edges of the slot 330, and thereby the first spaces 332 and the power supply terminals M are arranged in vertical correspondence. The first projection portion 331 overlaps the central line X, moreover, the width of the first projection portion 331 is larger than the widths of the pair of signal terminals S' plus the distance between the pair of signal terminals S', consequently, the pairs of signal terminals S' of the two rows of terminals 2 are arranged in vertical correspondence, and thereby the shielding effect is enhanced. The first projection portion 331 is located behind the front end surface 33, which helps fix the tongue 12 on the middle shielding sheet 3, and can also enhance the strength of the plate portion 31. Further, because the first projection portion 331 does not extend beyond the front surface 124, the probability of short-circuiting caused by the electrical contact between the terminals 2 and the middle shielding sheet 3 due to foreign matters (such as dust and moisture) attached outside of the tongue 12 is effectively decreased. Further, a first hole 34 and two third holes 36 run through the plate portion 31, the first hole 34 overlaps the central line X and located behind the first projection portion 331, the width of the first hole 34 is slightly less than the width of the first projection portion 331 and larger than the widths of the pair of signal terminals S' plus the distance between the pair of signal terminals S', and thereby the first hole 34 and the pair of signal terminals S' are arranged in vertical correspondence. Each third hole 36 is located between the slot 330 and the side edge of the middle shielding sheet 3 and is relatively close to the side edge of the middle shielding sheet 3, moreover, the third hole 36 is located in front of the groove 321, and thereby the third hole 36 is arranged opposite to the grounding terminal G.

Two sides of the middle shielding sheet 3 separately extend out of the tongue 12 laterally, the front end of the middle shielding sheet 3 extends forward out of the front end of the tongue 12, specifically, the front end surface 33 extends out of the front surface 124, and when the mating connector 200 and the electrical connector 100 are butted, the front end of the tongue 12 may be prevented from abrasion. A baffle plate (not labeled) extends from the rear end of the middle shielding sheet 3, and the baffle plate is located between the soldering portions 23 of the upper row of terminals 2 and the soldering portions 23 of the lower row of terminals 2, and used for shielding signal interference between the two rows of terminals 2. Further, two pins 37 extend from the rear end of the middle shielding sheet 3, and the pins 37 extend out of the bottom of the base portion 11, and are arranged in a row along with the soldering portions 23 of the lower row of terminals 2.

As shown in FIG. 1, the inner metal casing 4 is formed by buckling an upper shielding sheet 41 and a lower shielding sheet 44 to each other, and is assembled simply and easily. Each of the upper shielding sheet 41 and the lower shielding sheet 44 has a covering portion 42 disposed respectively on the upper surface 121 or the lower surface 122 of the tongue 12, and an extending portion 43 extends backward from each of the covering portions 42. The extending portions 43 are stuck to and are covering the base portion 11. The extending portion 43 close to the upper surface 121 has two contact arms 431, and the contact arms 431 urge an inner wall of the outer metal casing 5, so as to increase shielding performance and be grounded. Certainly, in other embodiments, the extending portion 43 may extend backward only from the covering portion 42 stuck and covering to the upper surface 121, and the extending portion 43 has one or more contact arms 431, as long as the one or more contact arms 431 can contact the inner wall of the outer metal casing 5. Additionally, the extending portion 43 is provided with two positioning portions 432, and the two positioning slots 111 accommodate and fix the two positioning portions 432. The upper shielding sheet 41 and the lower shielding sheet 44 are in a frame shape and integrally formed, and the covering portion 42 of each of the upper shielding sheet 41 and the lower shielding sheet 44 is provided with at least one blind hole (not labeled), which helps the mating connector 200 snap-fit and fix with the blind hole. Certainly, the blind hole may also run through in the direction toward the tongue 12 to form a through-hole (not labeled), or even, a through-hole corresponding to the upper surface 121 and the lower surface 122 of the tongue 12 is also further depressed, which further helps the mating connector 200 snap-fit and fix with the blind hole, which is not easily disengaged.

Figure 18:
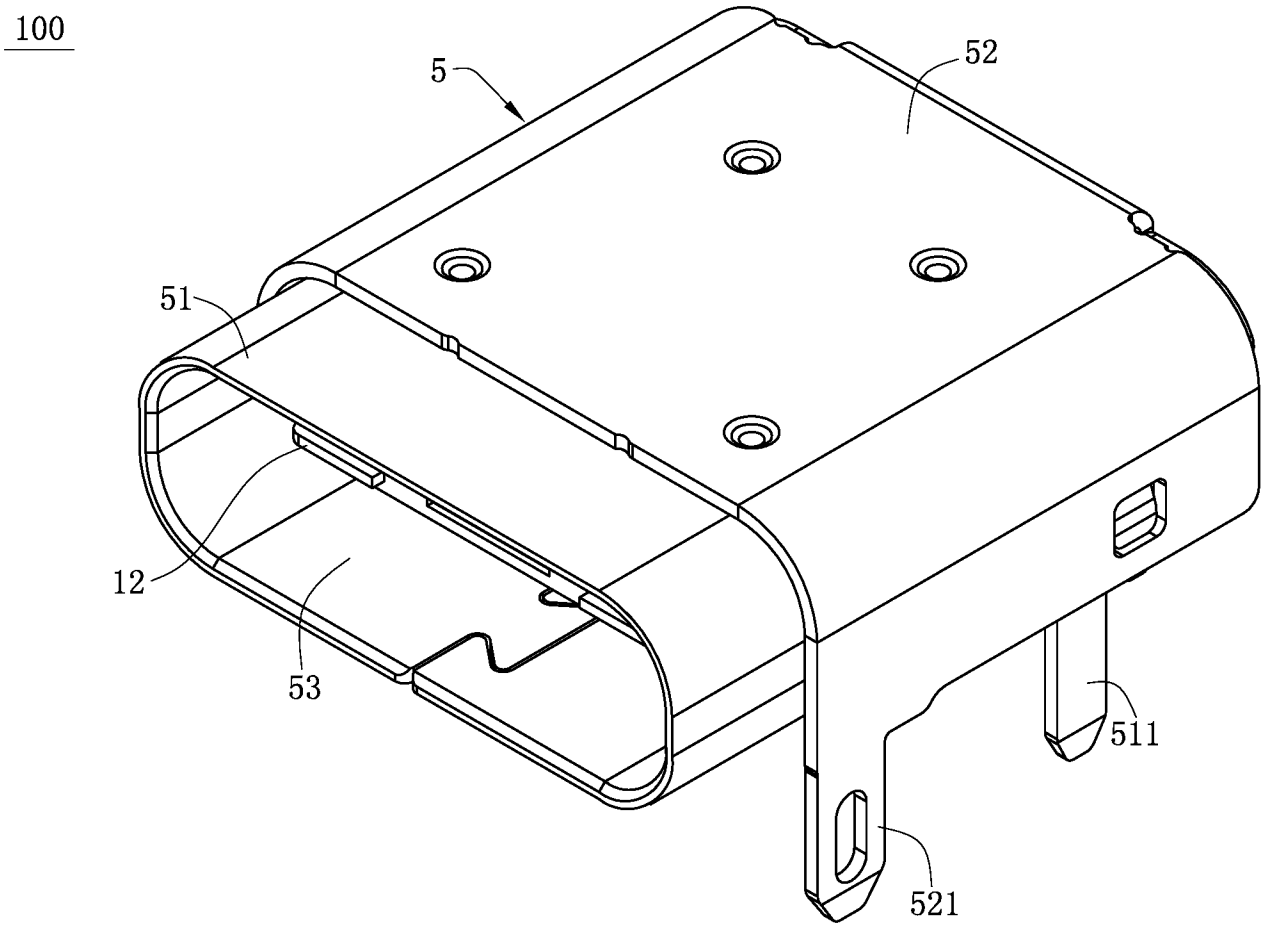
FIG. 18 is a three-dimensional assembly view of an electrical connector according to a fourth embodiment of the present invention.
Figure 19:
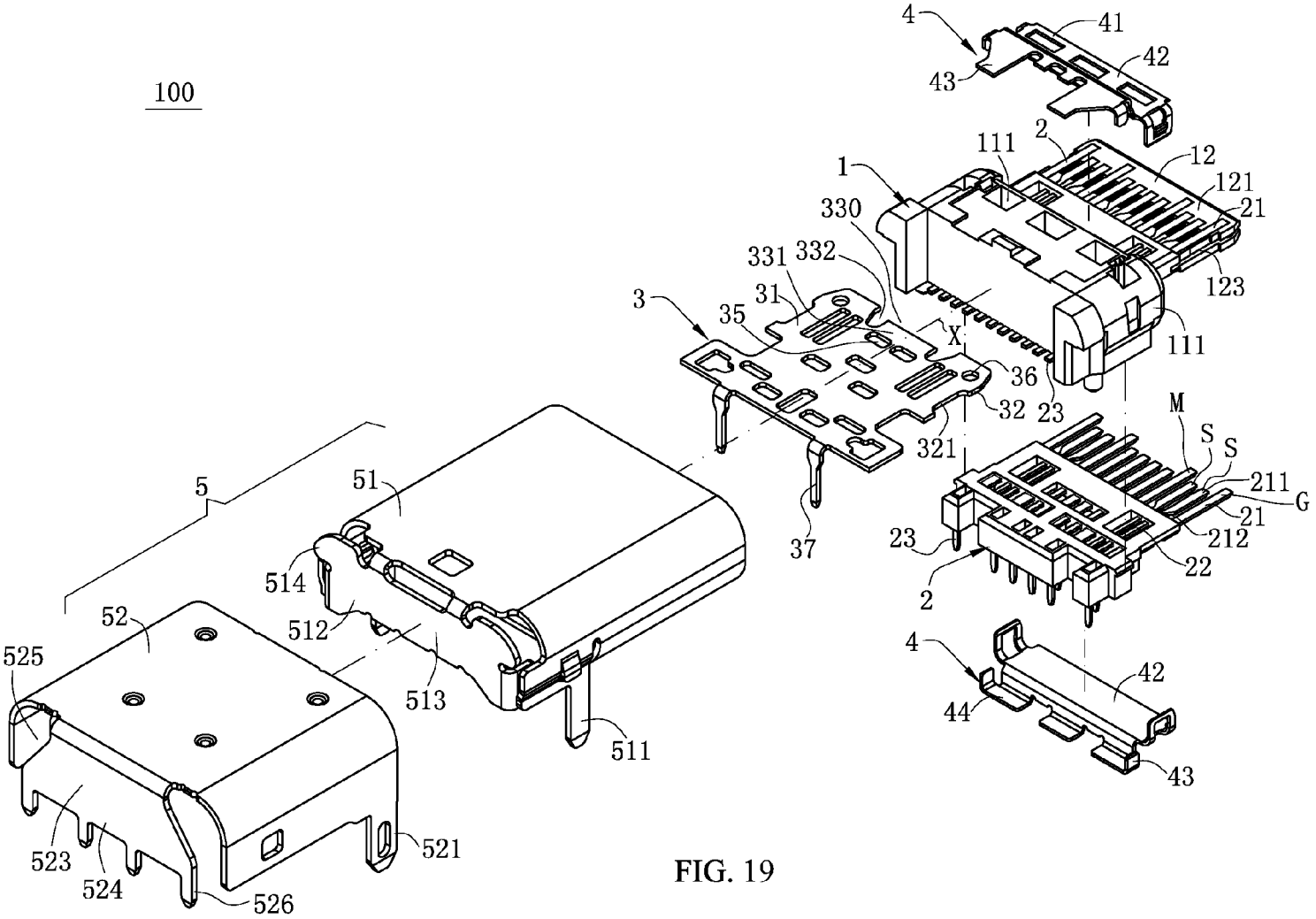
FIG. 19 is a three-dimensional exploded view of the electrical connector according to the fourth embodiment of the present invention.
Figure 20:
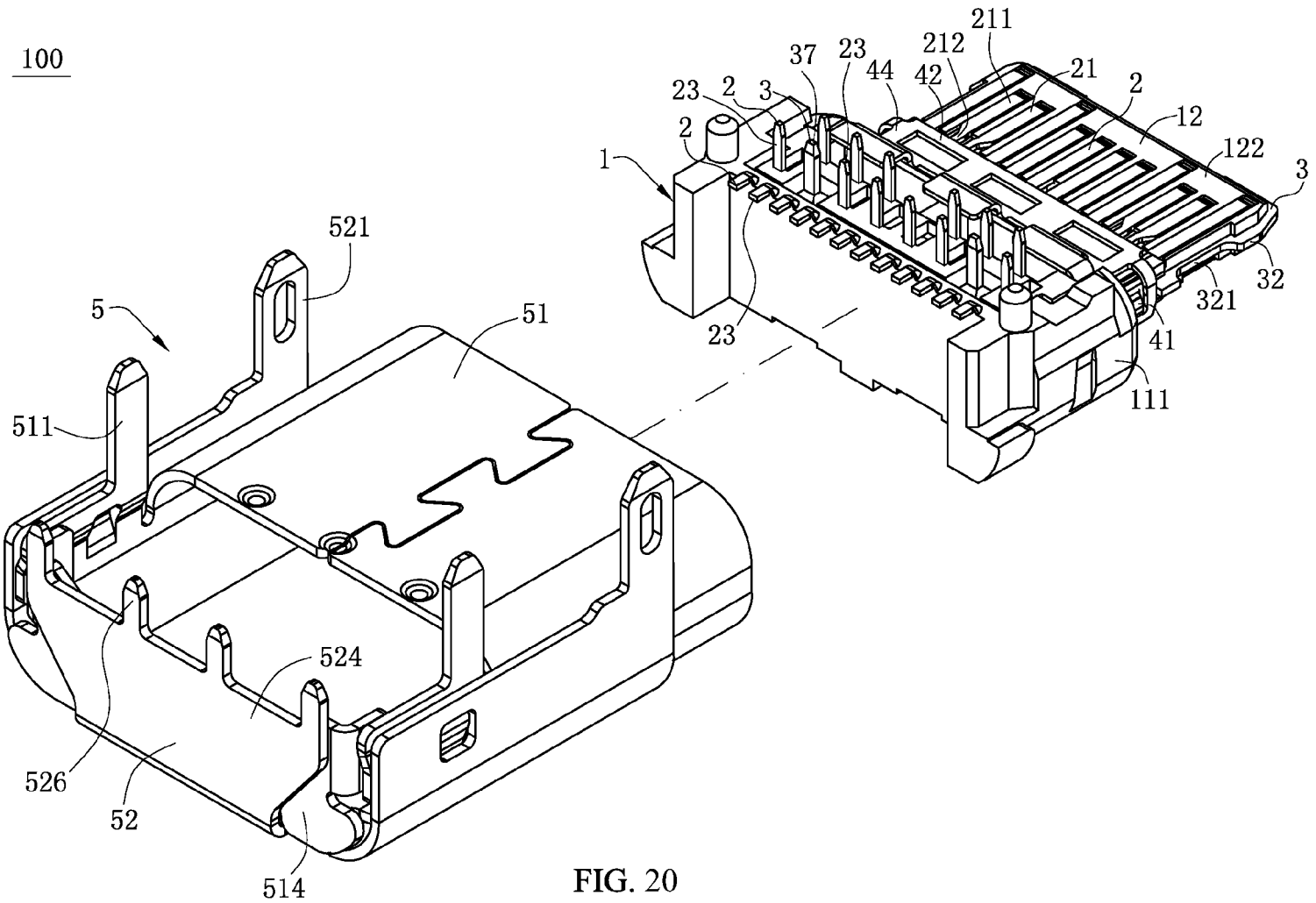
FIG. 20 is a partial three-dimensional exploded view of the electrical connector according to the fourth embodiment of the present invention.

As shown in FIG. 1 to FIG. 5, the outer metal casing 5 wraps peripheries of the base portion 11 and the tongue 12. The outer metal casing 5 has a wrapping casing 51 and a shielding casing 52. The wrapping casing 51 wraps the peripheries of the base portion 11 and the tongue 12, and the shielding casing 52 is disposed out of the wrapping casing 51. The double protection can reduce signal loss as much as possible. Each of two sides of the wrapping casing 51 has a first soldering pin 511, each of two sides of the shielding casing 52 has a second soldering pin 521. The first soldering pin 511 and the second soldering pin 521 are staggered front and back. The first soldering pin 511 is close to the lateral side of the base portion 11, and the second soldering pin 521 is close to the lateral side of the tongue 12, and therefore the electrical connector 100 is stably mounted on a circuit board 300, and not easily disengaged. Certainly, in other embodiments, it may also be that, the first soldering pins 511 and the second soldering pins 521 are all located at the front end, or are all located at the back end, the multiple terminals 2 in the electrical connector 100 are welded on the circuit board 300 at welding locations (not labeled), and from a side viewing angle, the front and back arrangement relationship among the first soldering pins 511, the second soldering pins 521 and the welding locations may be appropriately adjusted and changed, as long as the electrical connector 100 is well and stably mounted on the circuit board 300. As shown in FIG. 18, a through-hole (not labeled) runs through each of the second soldering pin 521, and when the second soldering pins 521 are welded onto the circuit board 300, the contact area of coated solder paste and the second soldering pins 521 increases, so as to ensure that the second soldering pins 521 and the circuit board 300 are stably positioned.

Figure 5:
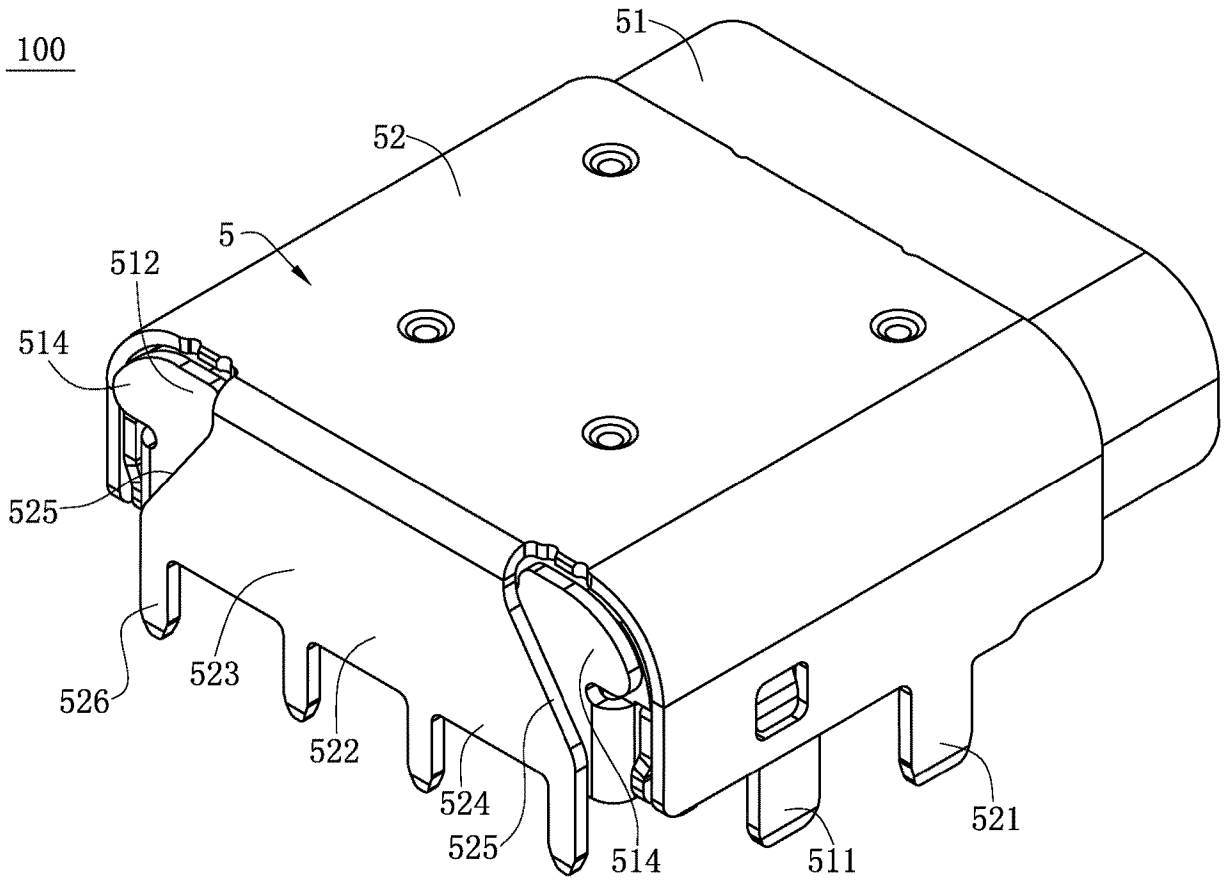
FIG. 5 is a three-dimensional exploded view of the electrical connector viewed from another viewing angle according to one embodiment of the present invention.

As shown in FIG. 5 and FIG. 6, the wrapping casing 51 has a first rear wall 512, and the shielding casing 52 has a second rear wall 522. The first rear wall 512 has a first middle portion 513 and first sheltering portions 514 located at two sides of the first middle portion 513. The second rear wall 522 has a second middle portion 523 and a second sheltering portion 524 connected to a lower part of the second middle portion 523. The first middle portion 513 and the second middle portion 523 are approximately superposed front and back. A place of the second rear wall 522 corresponding to the first sheltering portion 514 forms a notch 525, and the second sheltering portion 524 exceeds the first middle portion 513 downward. The electrical connector 100 can be conveniently welded, and a good shielding effect can be ensured, so as to prevent signals from being leaked from the behind, and save materials. Moreover, the projections of the first rear wall 512, the second rear wall 522 and the connecting portions 22 in the longitudinal direction overlap each other, and thereby the shielding effect in the longitudinal direction is enhanced. Multiple fixing pins 526 extend downward from the second rear wall 522, and the multiple fixing pins 526 are located between the two second soldering pins 521, and used for cooperating with the first soldering pins 511 and the second soldering pins 521 to stably position the electrical connector 100 onto the circuit board 300.

Figure 48:
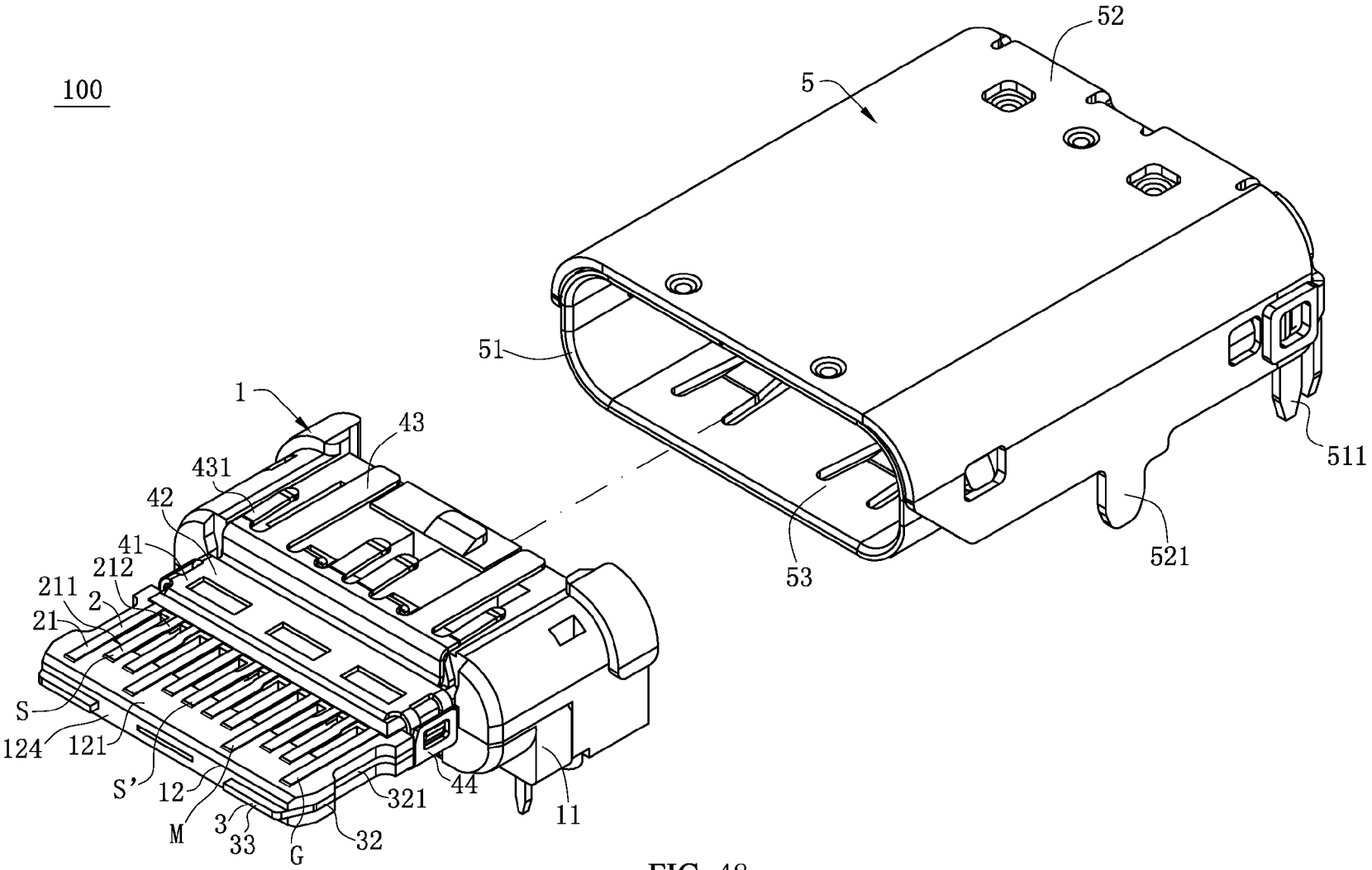
FIG. 48 is a partial three-dimensional exploded view of the electrical connector according to the thirteenth embodiment of the present invention.
Figure 49:
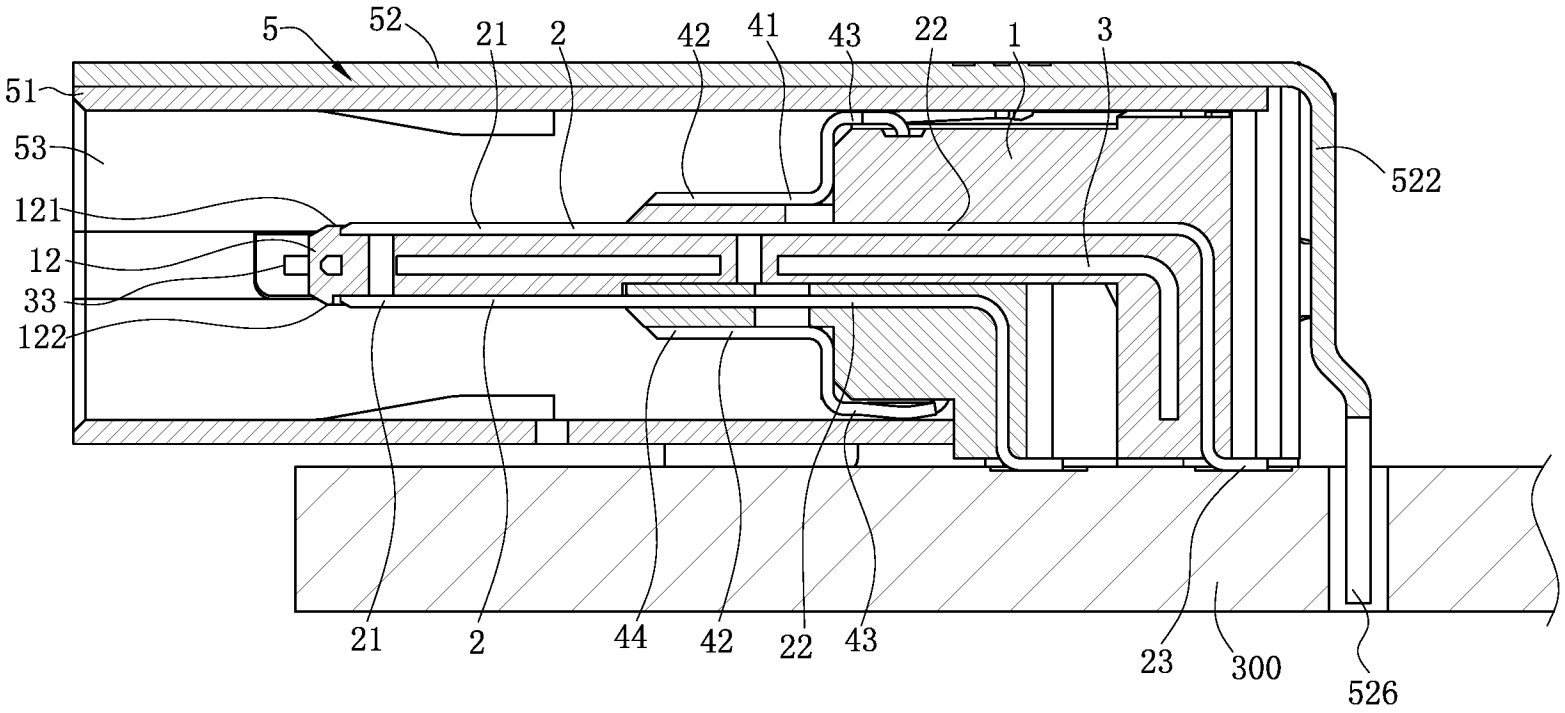
FIG. 49 is a sectional view of the electrical connector according to the thirteenth embodiment of the present invention.
Figure 50:
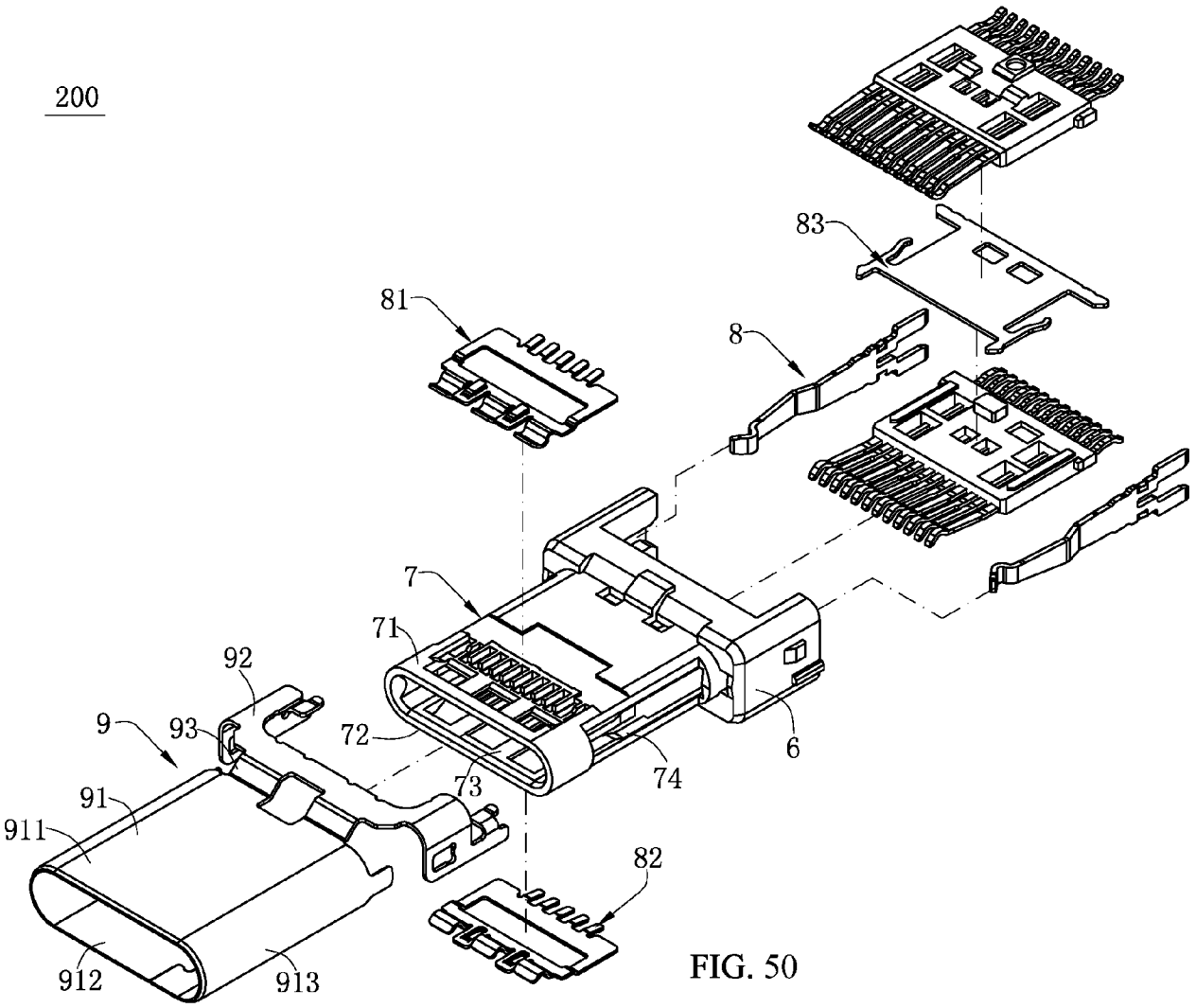
FIG. 50 is a three-dimensional exploded view of a mating connector according to a fourteenth embodiment of the present invention.
Figure 51:
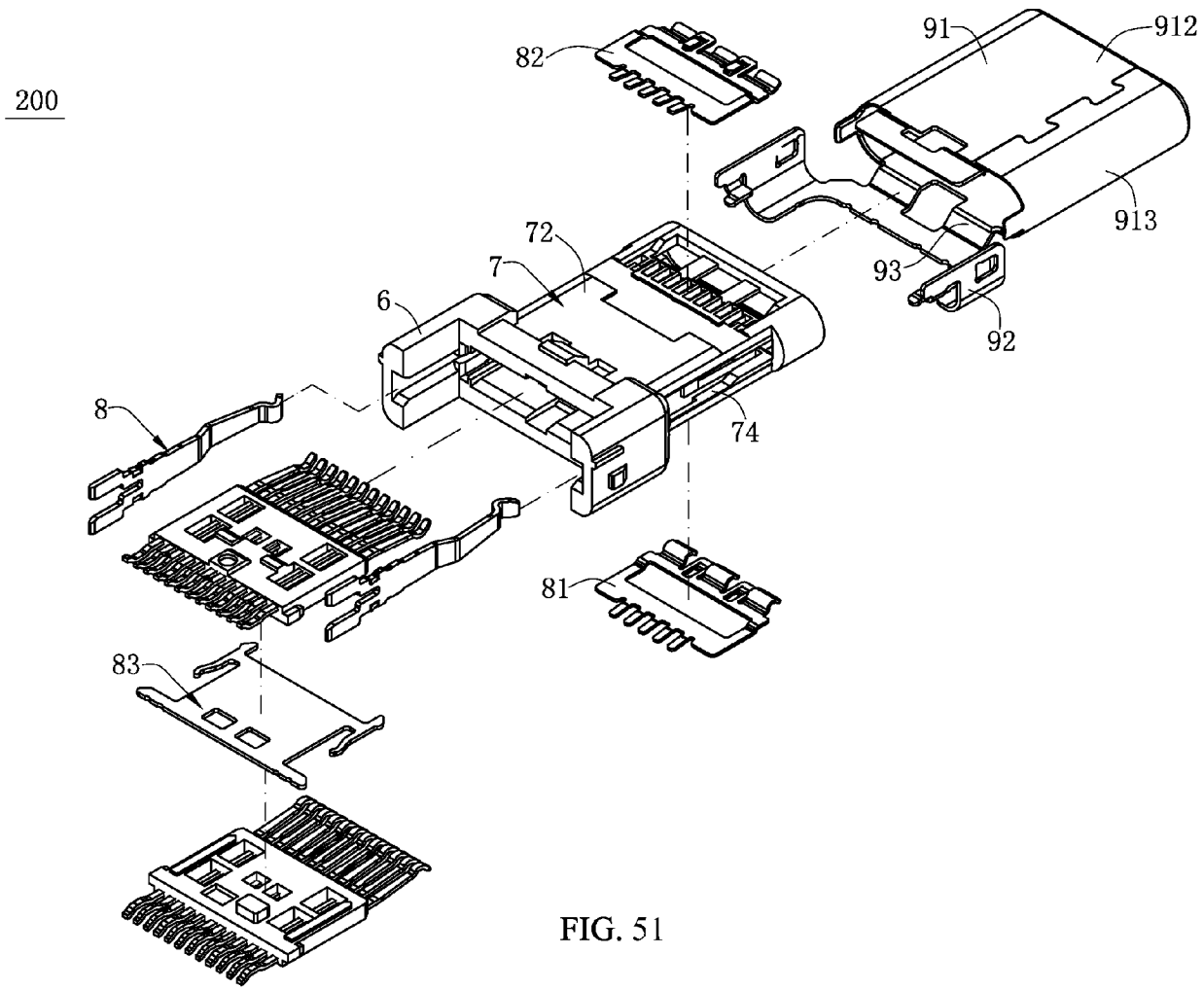
FIG. 51 is a three-dimensional exploded view of the mating connector viewed from another viewing angle according to the fourteenth embodiment of the present invention.
Figure 52:
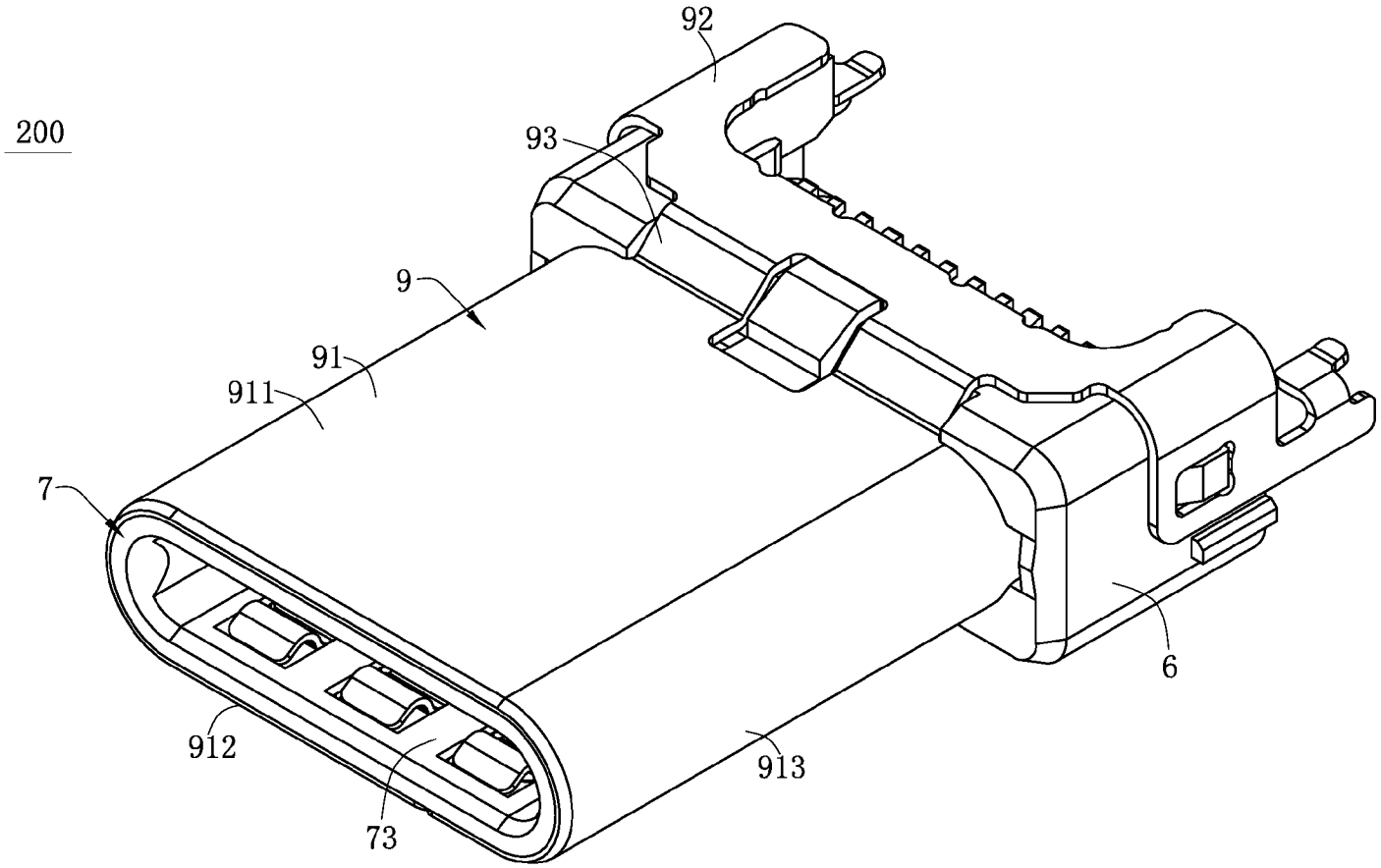
FIG. 52 is a three-dimensional assembly view of the mating connector according to the fourteenth embodiment of the present invention.
Figure 53:
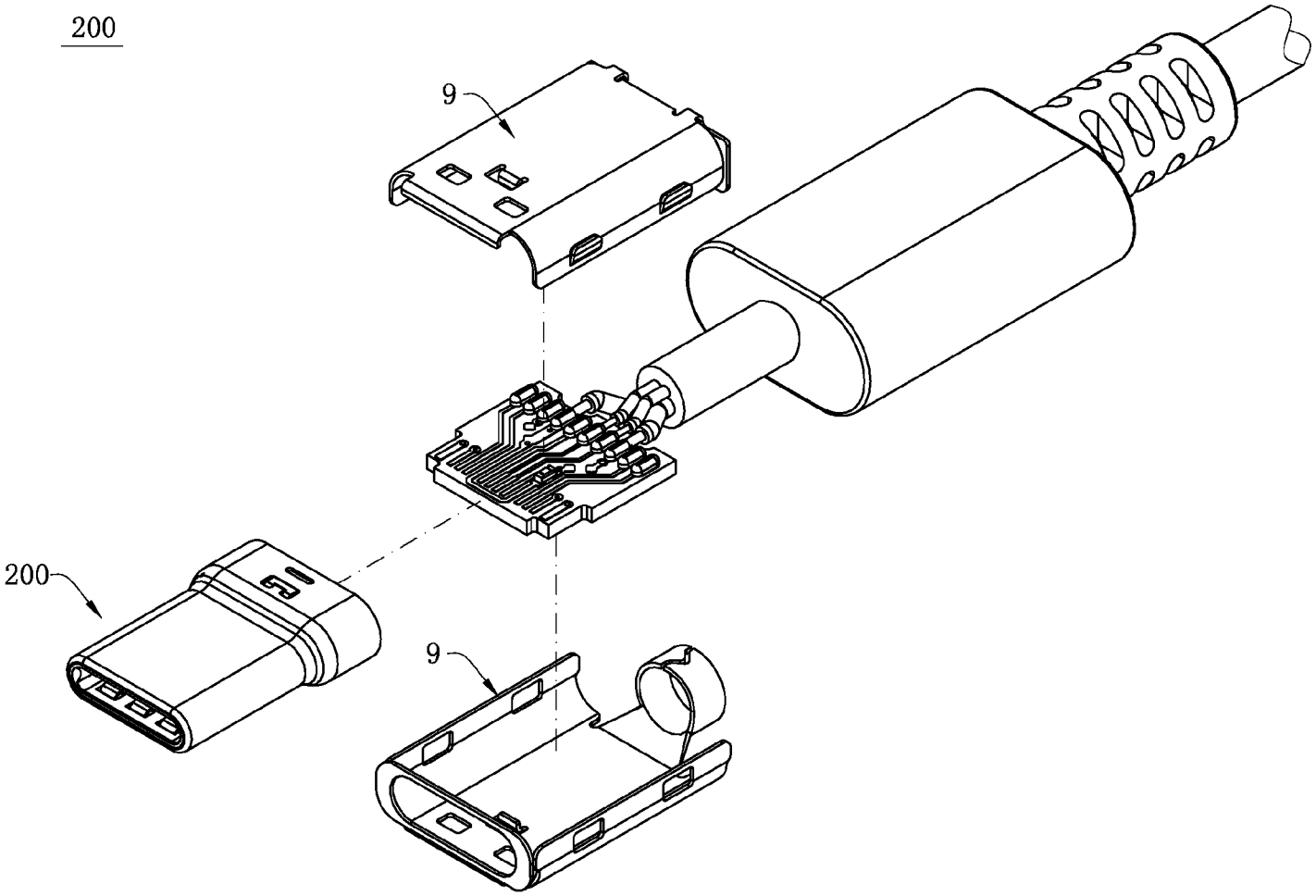
FIG. 53 is a three-dimensional exploded view of a mating connector according to a fifteenth embodiment of the present invention.
Figure 54:
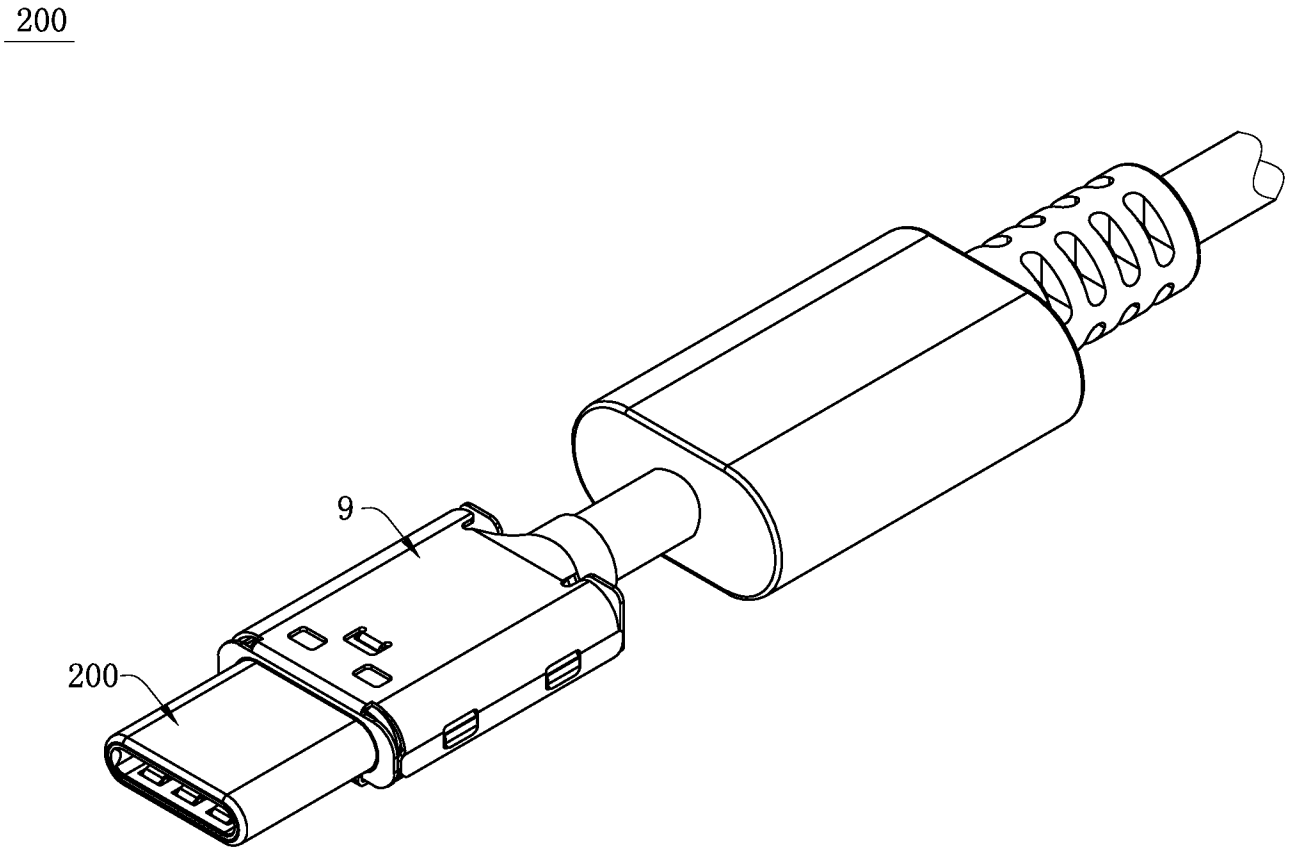
FIG. 54 is a three-dimensional assembly view of the mating connector according to the fifteenth embodiment of the present invention.

As shown in FIG. 48, structures bending forward are further disposed at two sides of the second rear wall 522, to further snap-fit two side walls of the shielding casing 52, so that the shielding casing 52 is not easily loosen, and it may also be ensure that the signals in the electrical connector 100 are not easily leaked from behind the rear side.

Figure 21:
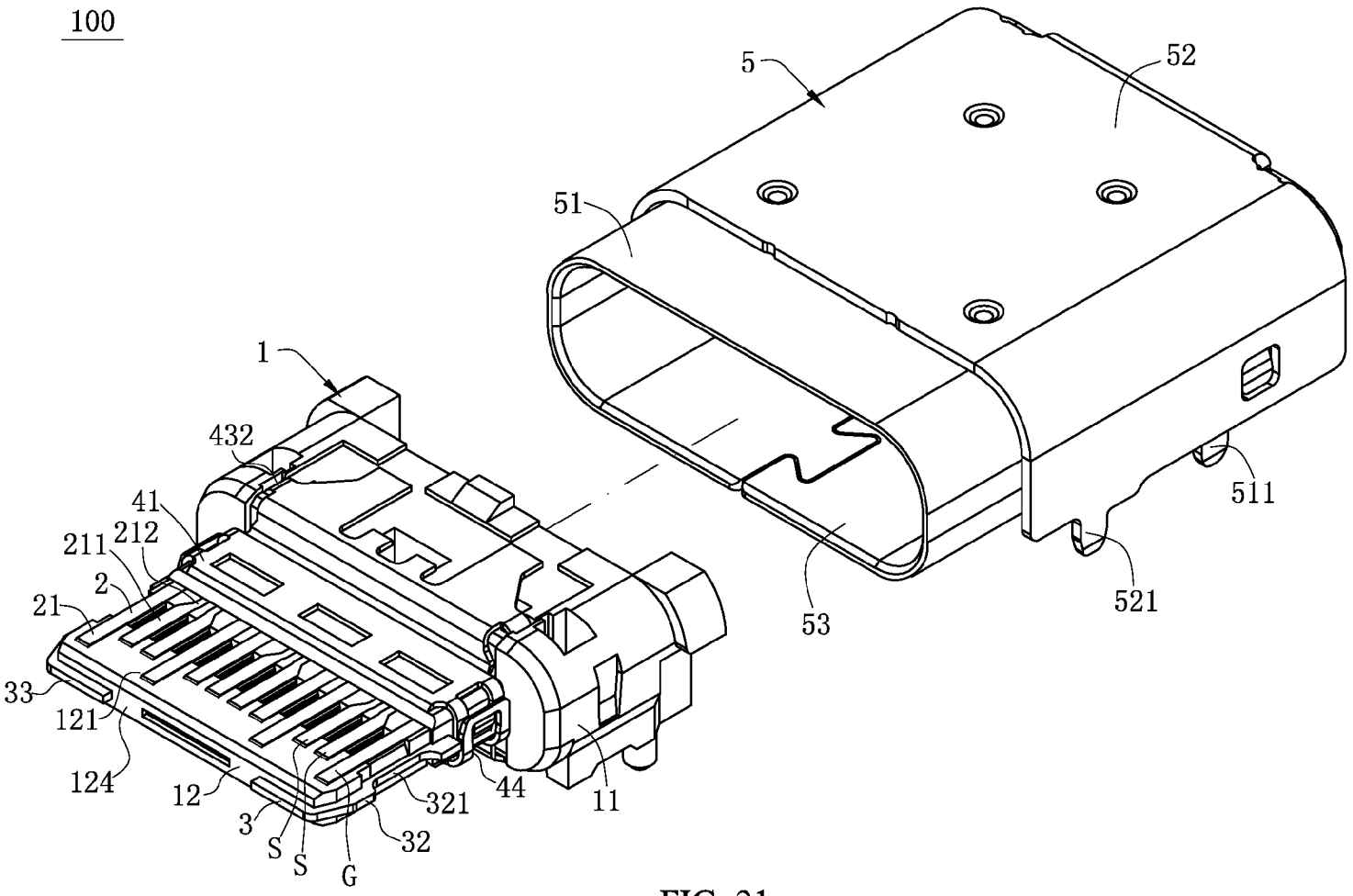
FIG. 21 is a partial three-dimensional exploded view of an electrical connector according to a fifth embodiment of the present invention.
Figure 22:
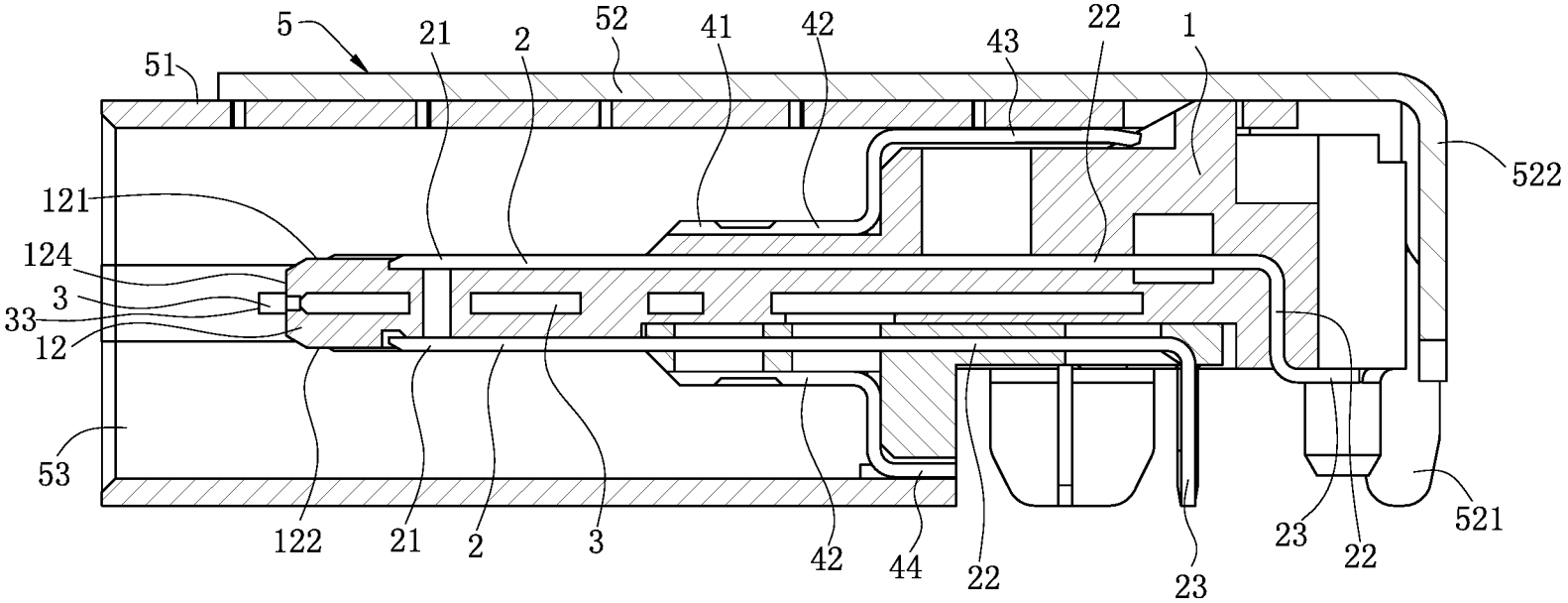
FIG. 22 is a sectional view of the electrical connector according to the fifth embodiment of the present invention.
Figure 23:
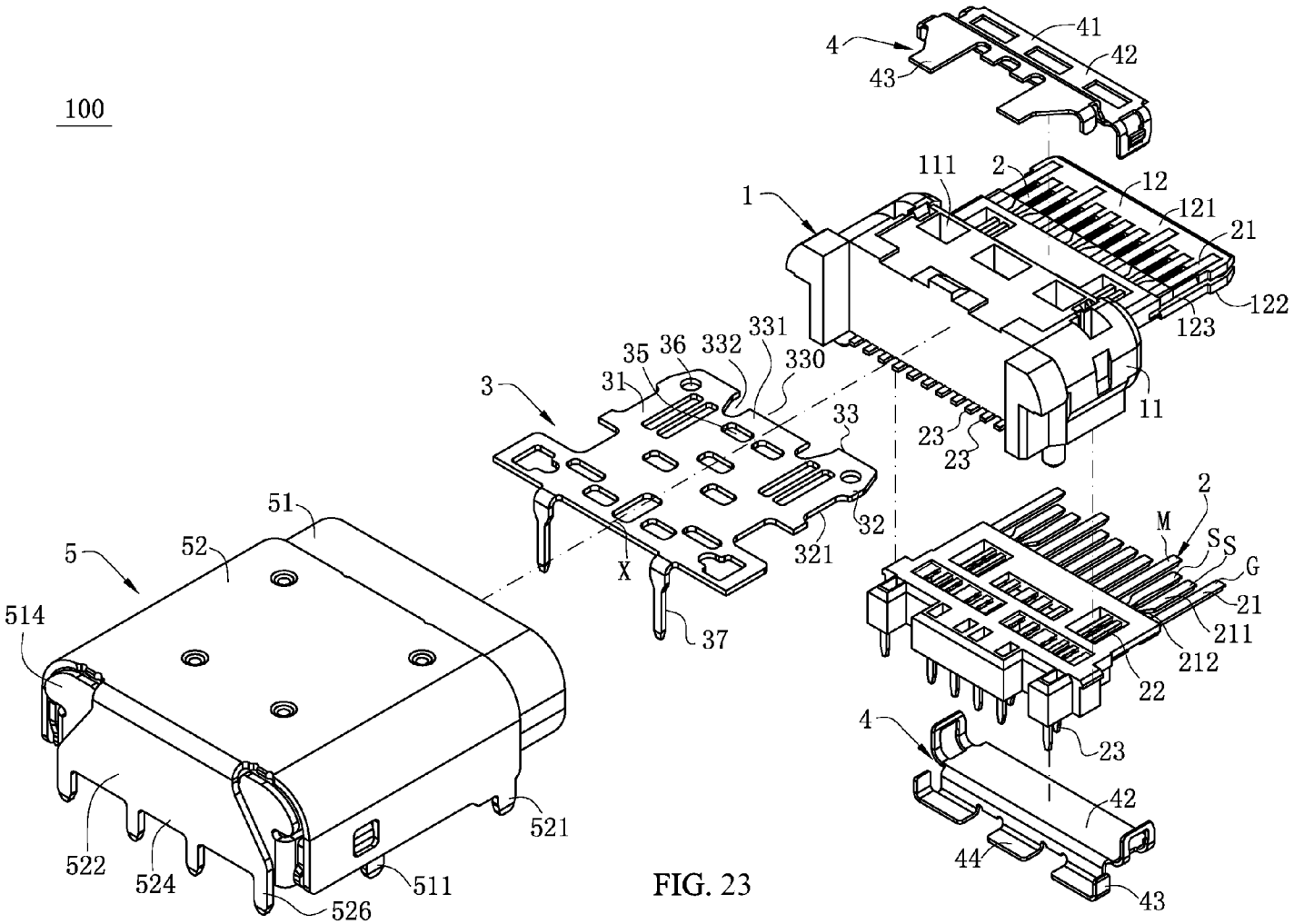
FIG. 23 is a three-dimensional exploded view of an electrical connector according to a sixth embodiment of the present invention.
Figure 24:
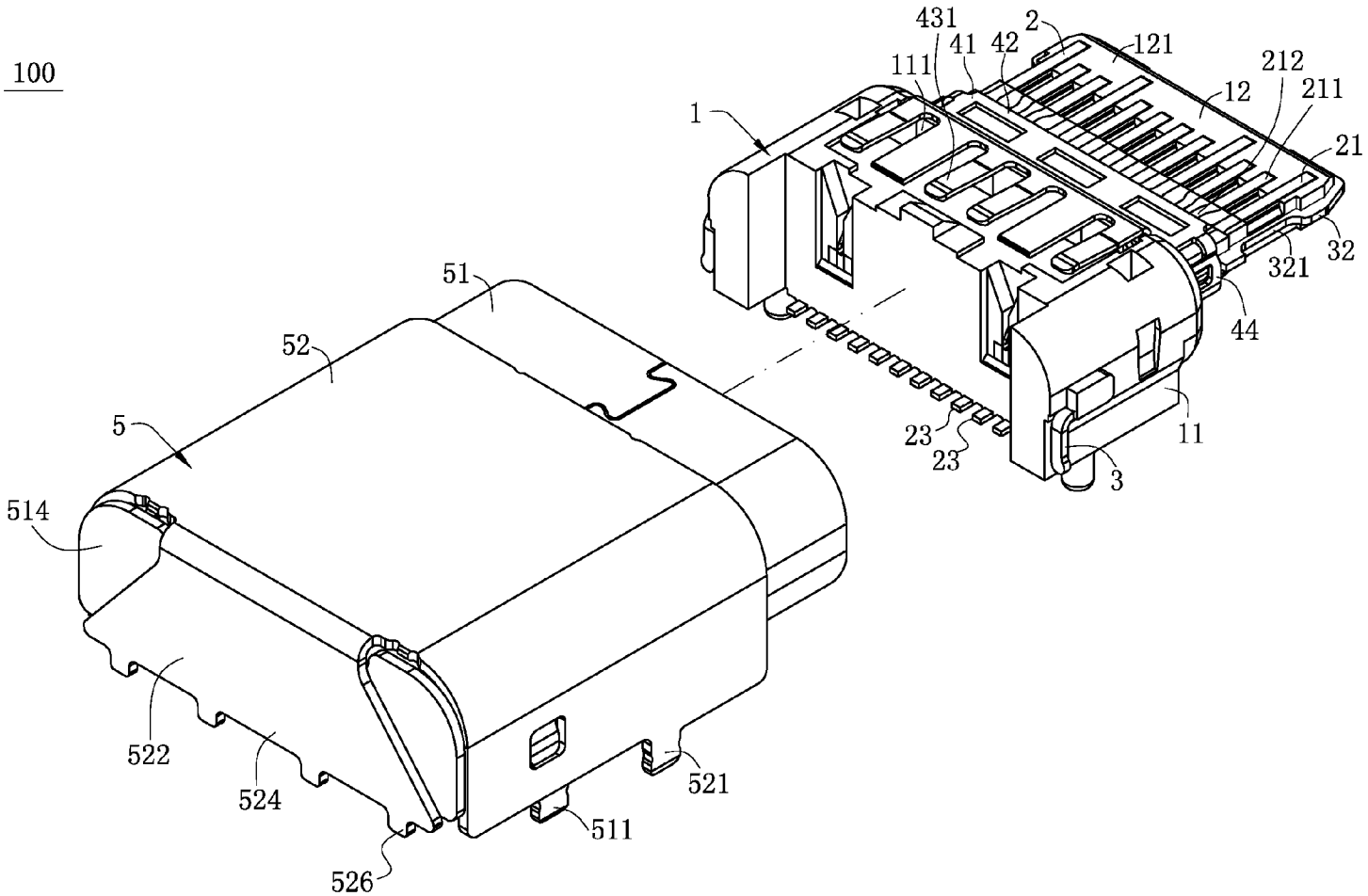
FIG. 24 is a partial three-dimensional exploded view of an electrical connector according to a seventh embodiment of the present invention.
Figure 25:
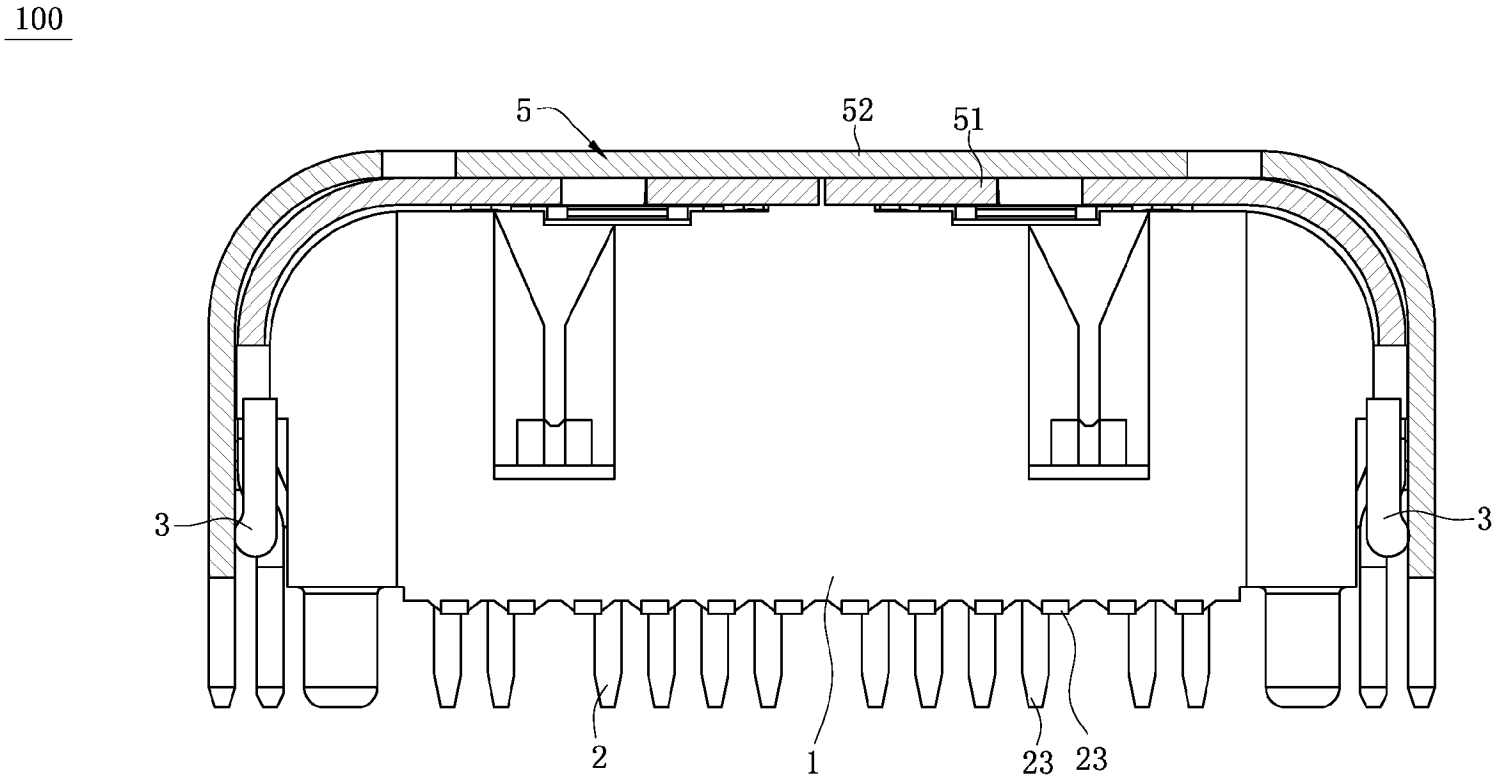
FIG. 25 is a sectional view of the electrical connector according to the seventh embodiment of the present invention.
Figure 26:
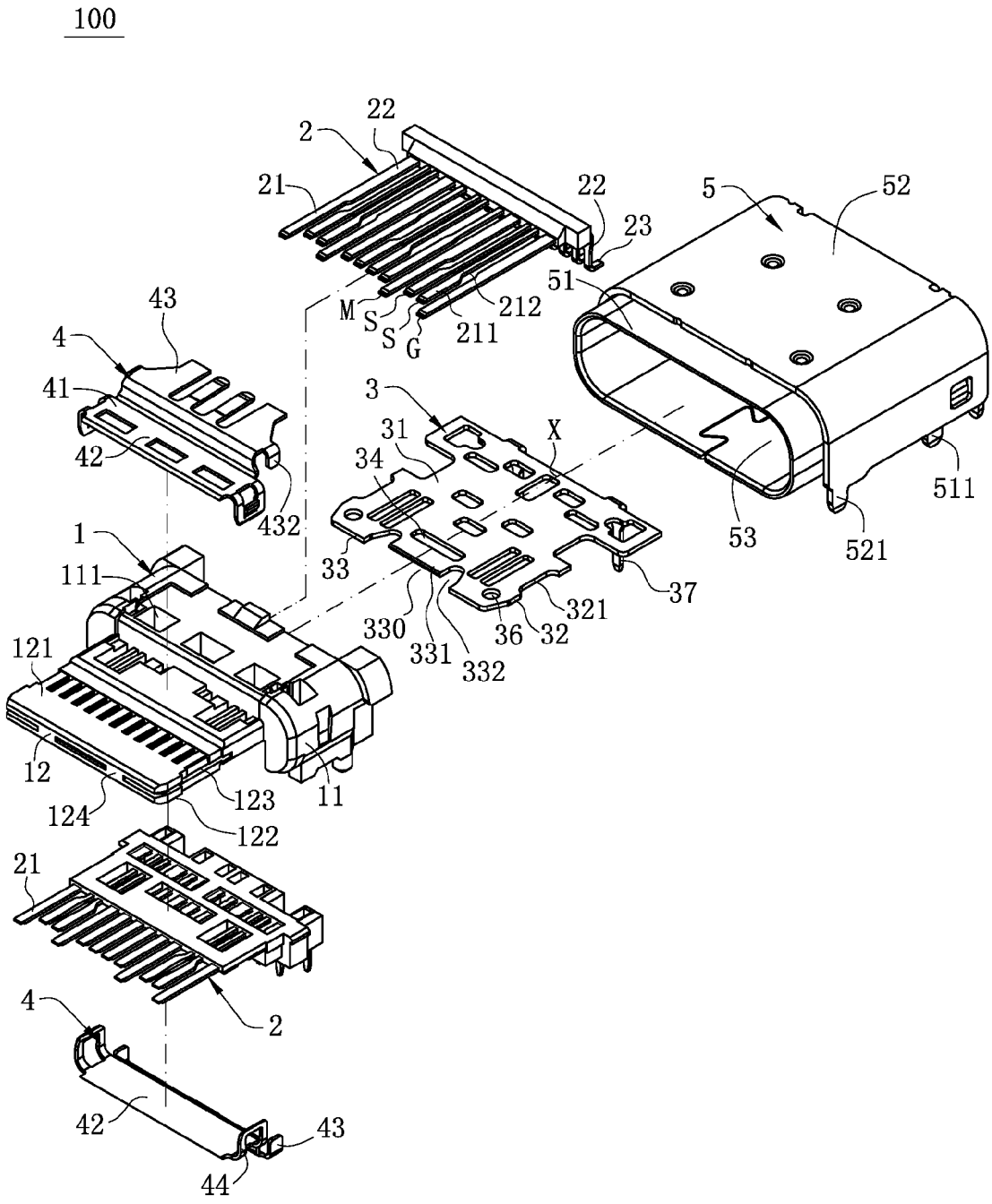
FIG. 26 is a three-dimensional exploded view of an electrical connector according to an eighth embodiment of the present invention.
Figure 27:
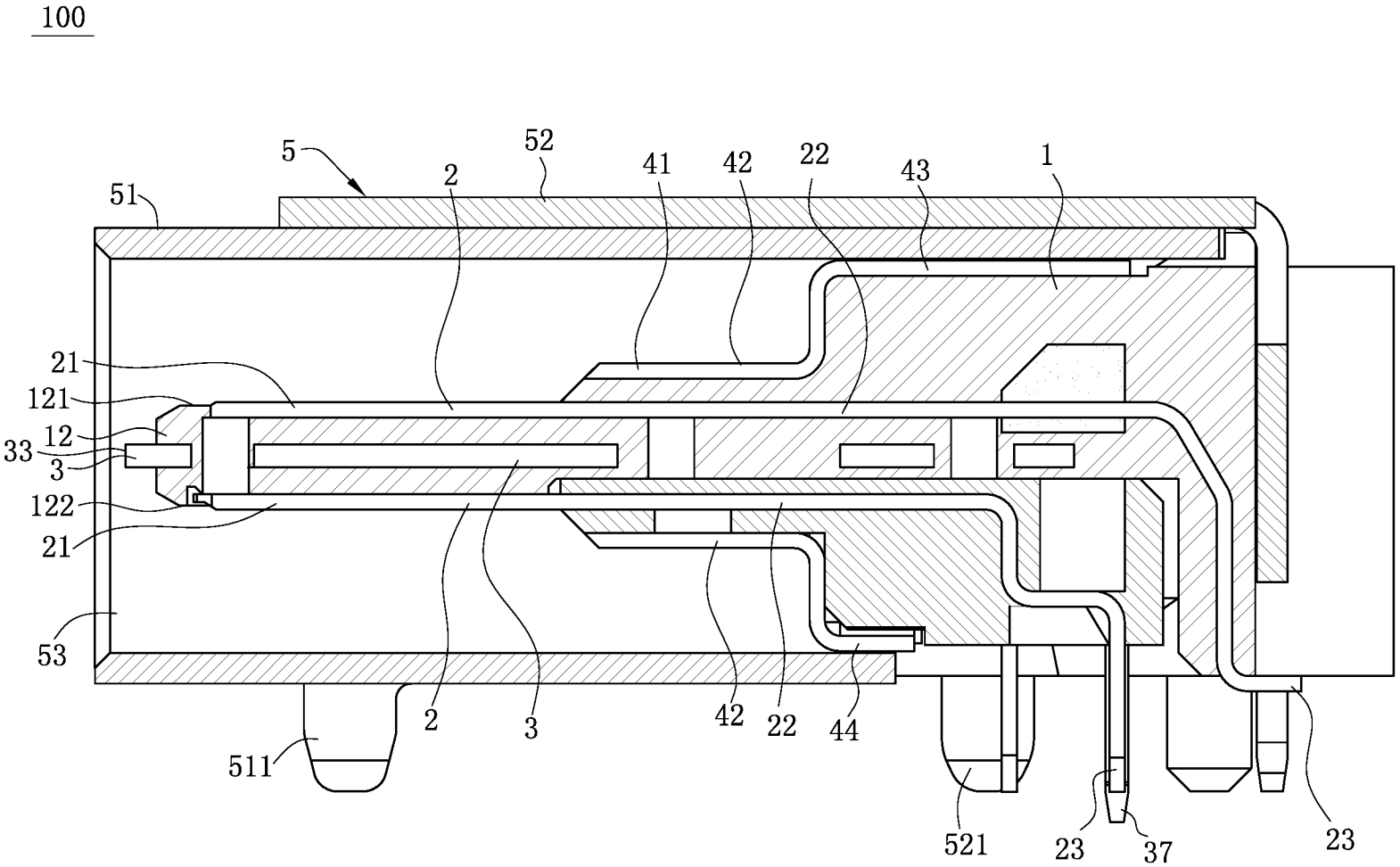
FIG. 27 is a sectional view of the electrical connector according to the eighth embodiment of the present invention.
Figure 28:
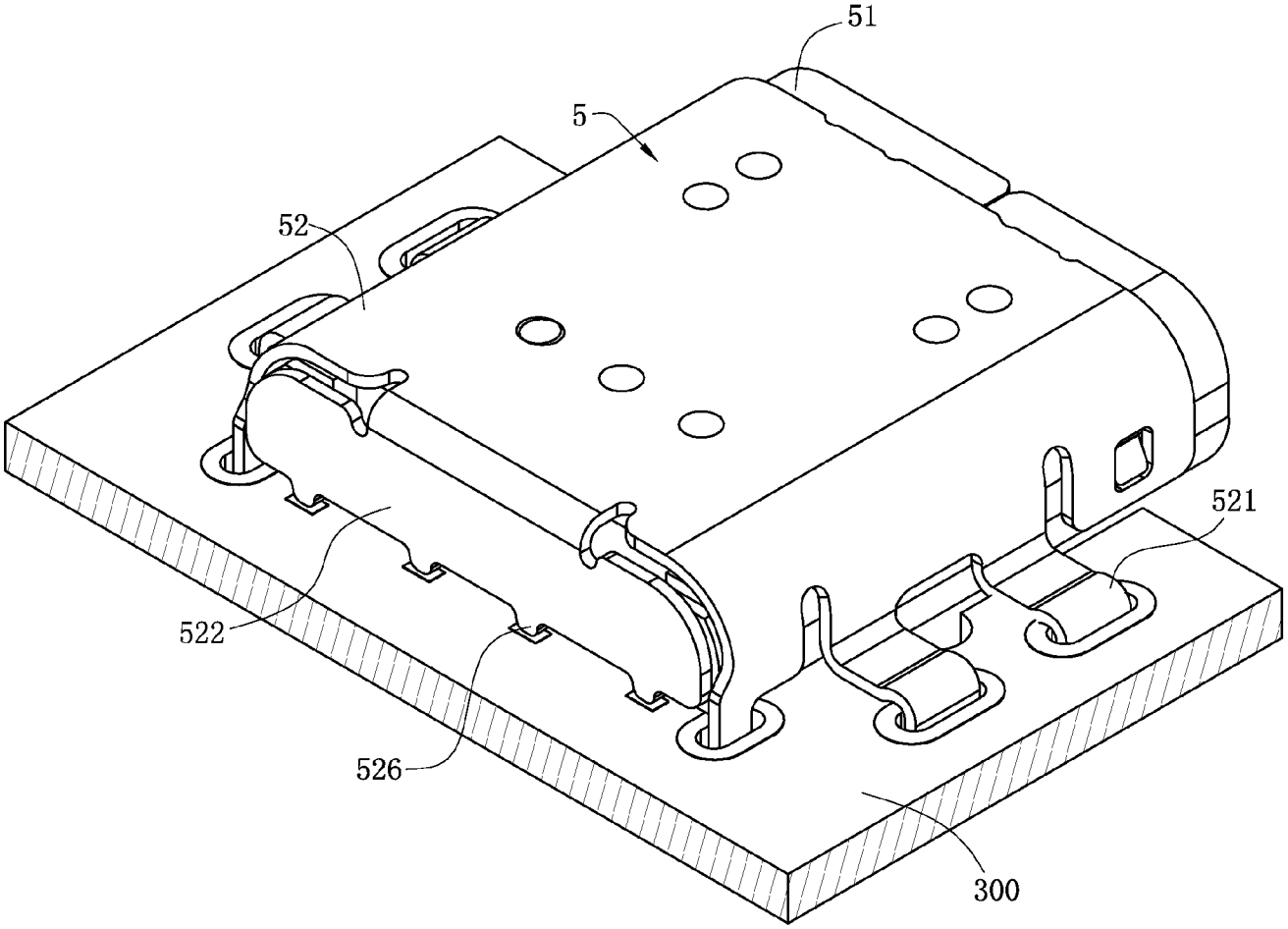
FIG. 28 is a three-dimensional assembly view of an electrical connector mounted on a circuit board according to a ninth embodiment of the present invention.
Figure 29:
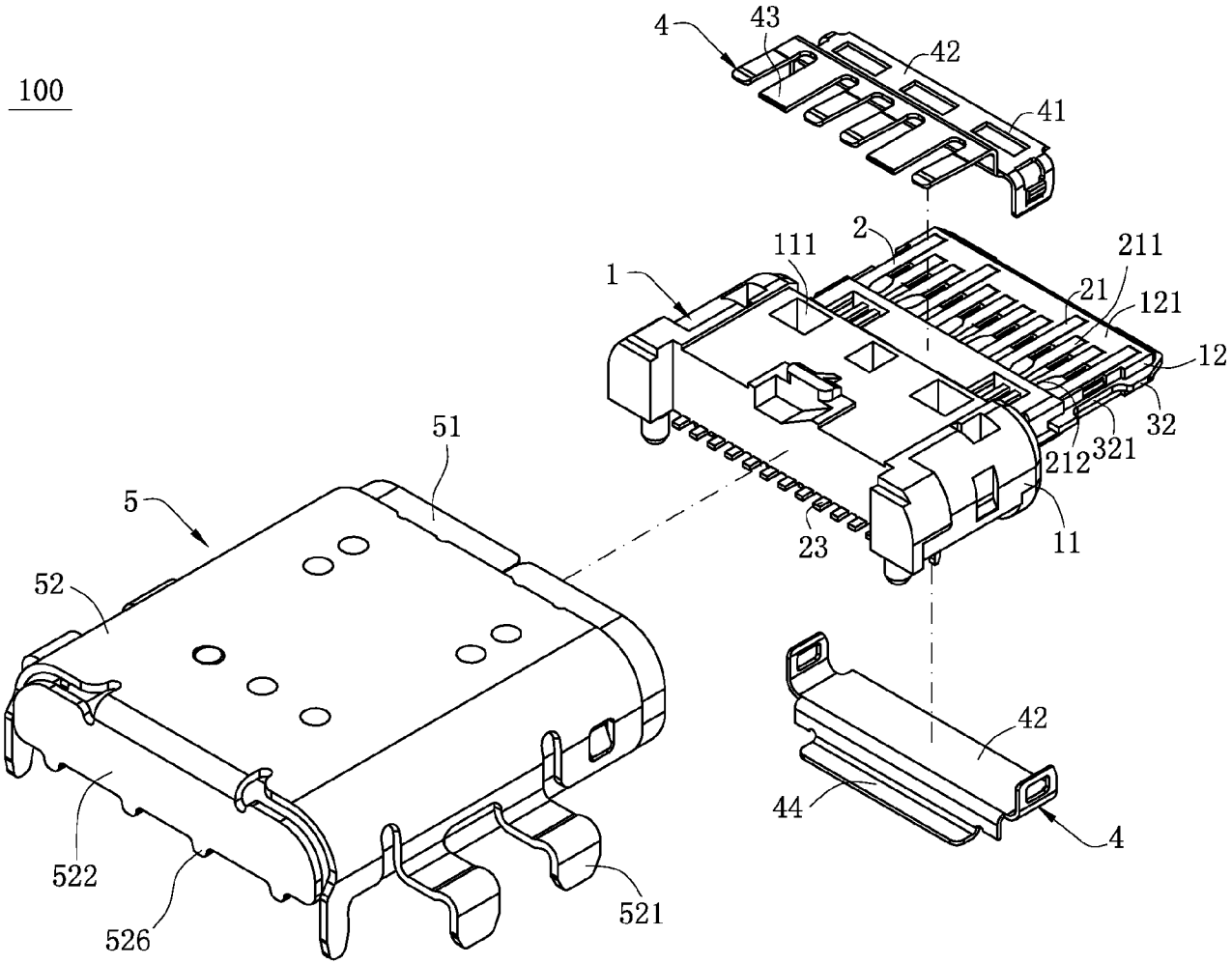
FIG. 29 is a three-dimensional exploded view of the electrical connector according to the ninth embodiment of the present invention.
Figure 30:
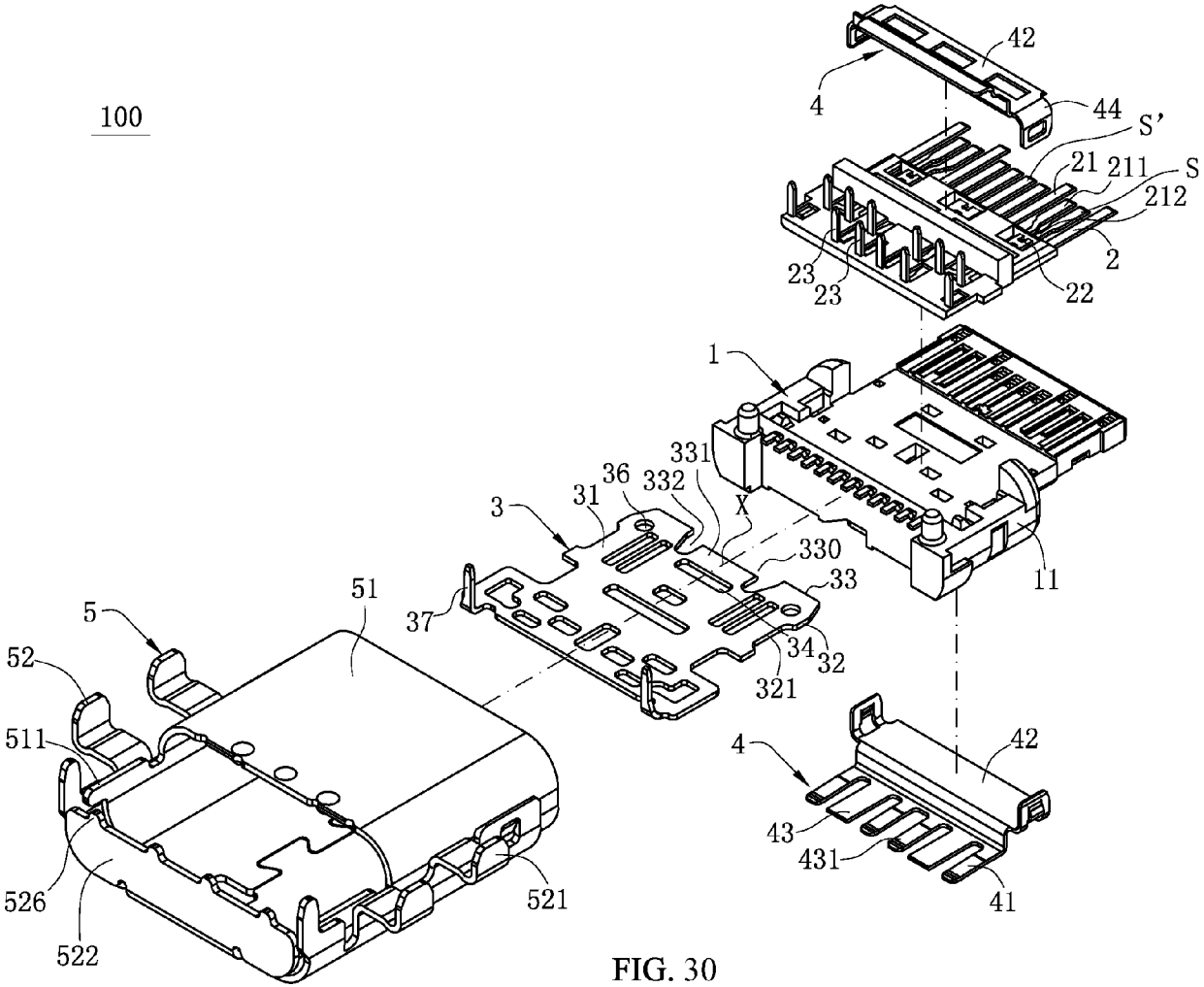
FIG. 30 is a three-dimensional exploded view of the electrical connector viewed from another viewing angle according to the ninth embodiment of the present invention.

As shown in FIG. 21 and FIG. 22, the electrical connector 100 is of a sinking board type, and the tongue 12 and the terminals 2 are all located above the circuit board 300.

Figure 31:
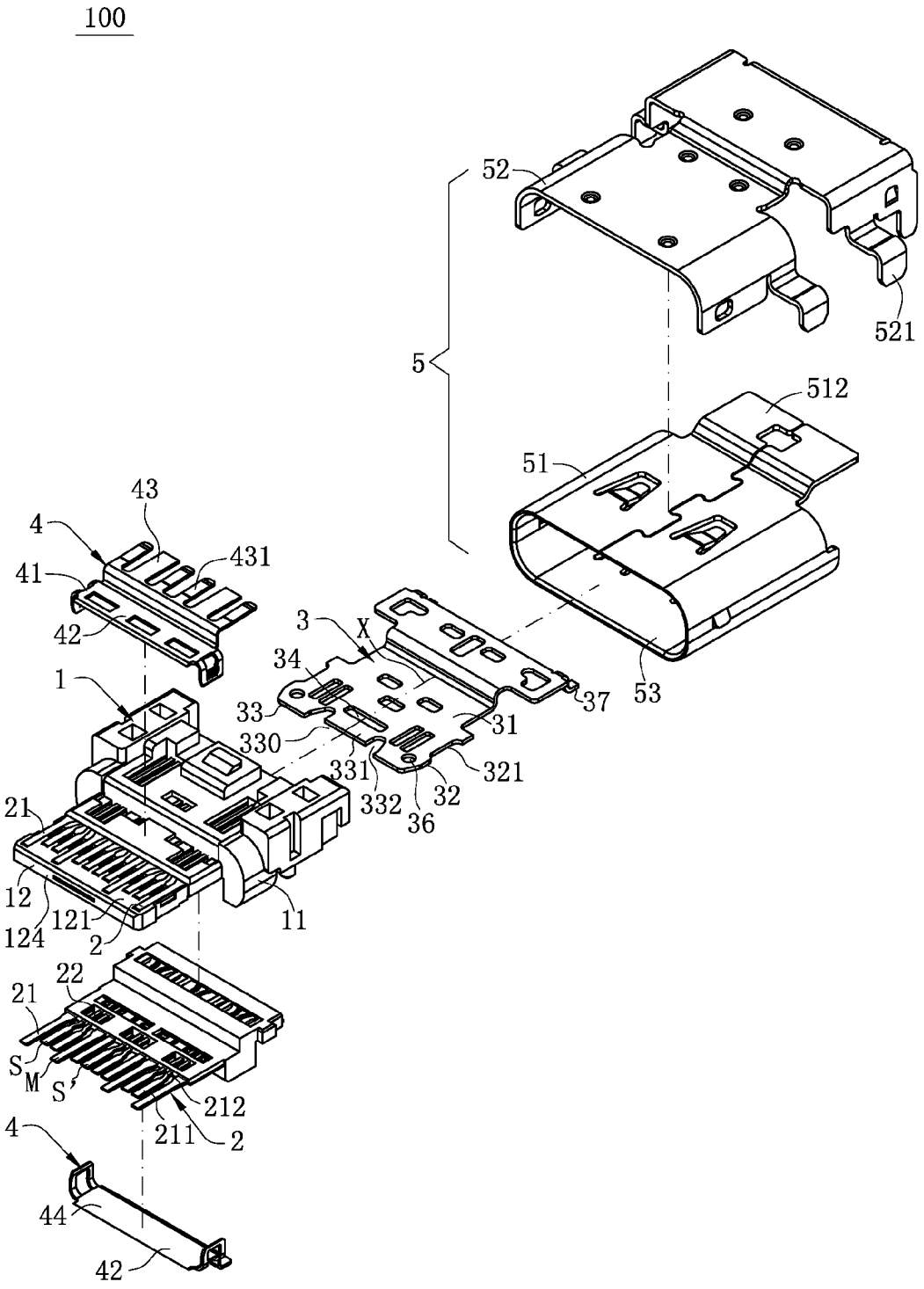
FIG. 31 is a three-dimensional exploded view of an electrical connector according to a tenth embodiment of the present invention.
Figure 32:
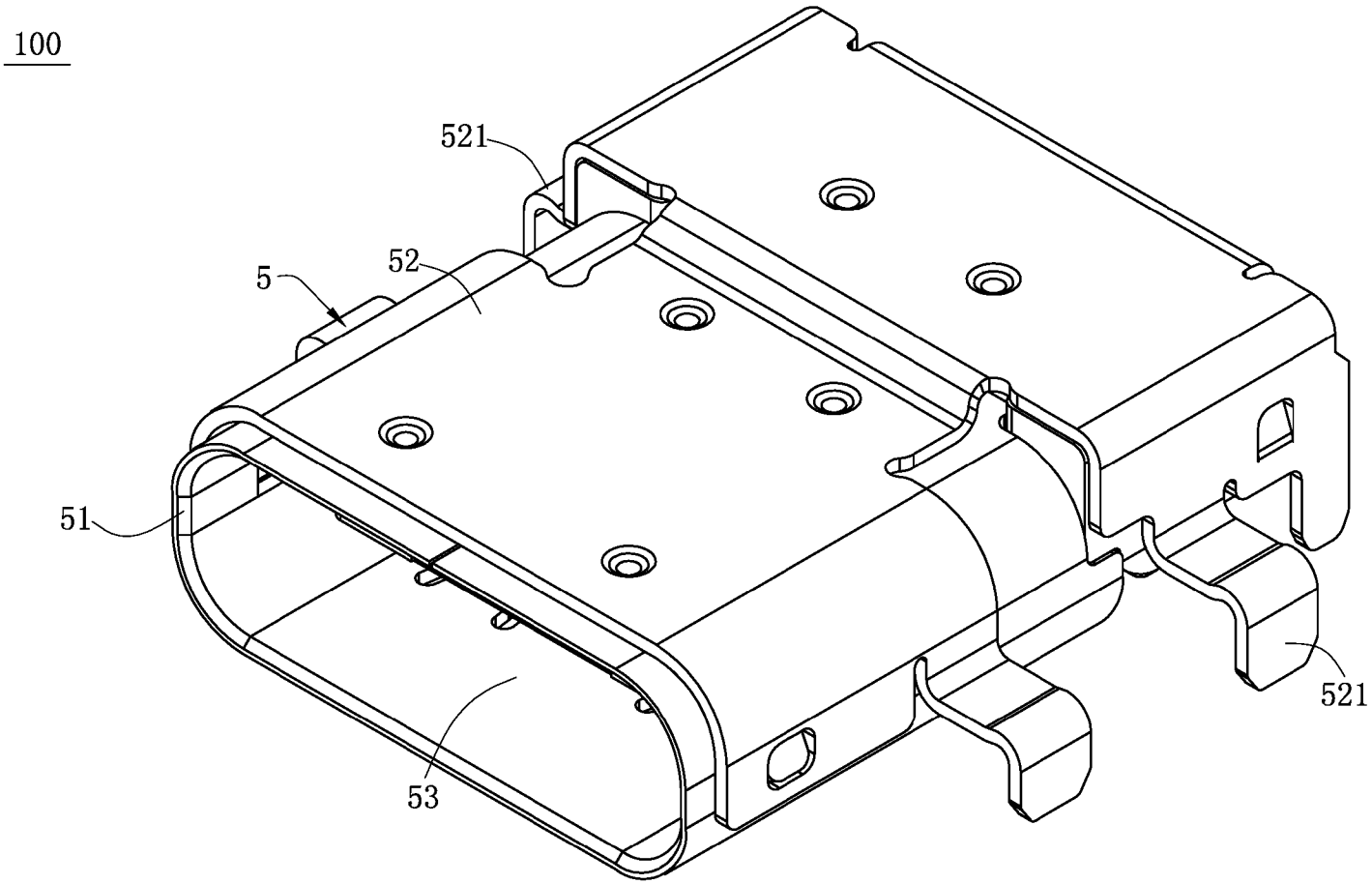
FIG. 32 is a three-dimensional assembly view of the electrical connector according to the tenth embodiment of the present invention.
Figure 33:
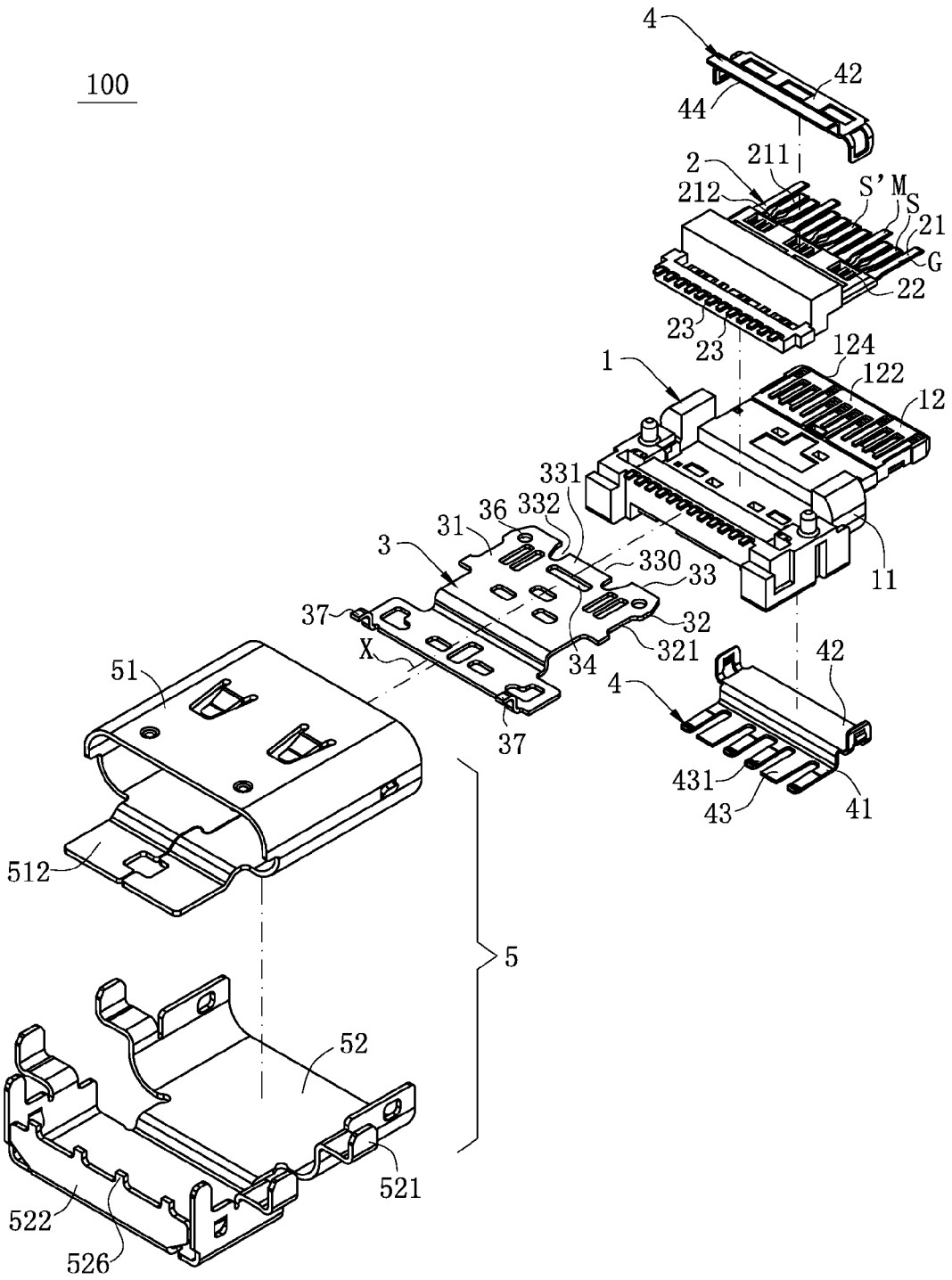
FIG. 33 is a three-dimensional exploded view of the electrical connector viewed from another viewing angle according to the tenth embodiment of the present invention.
Figure 36:
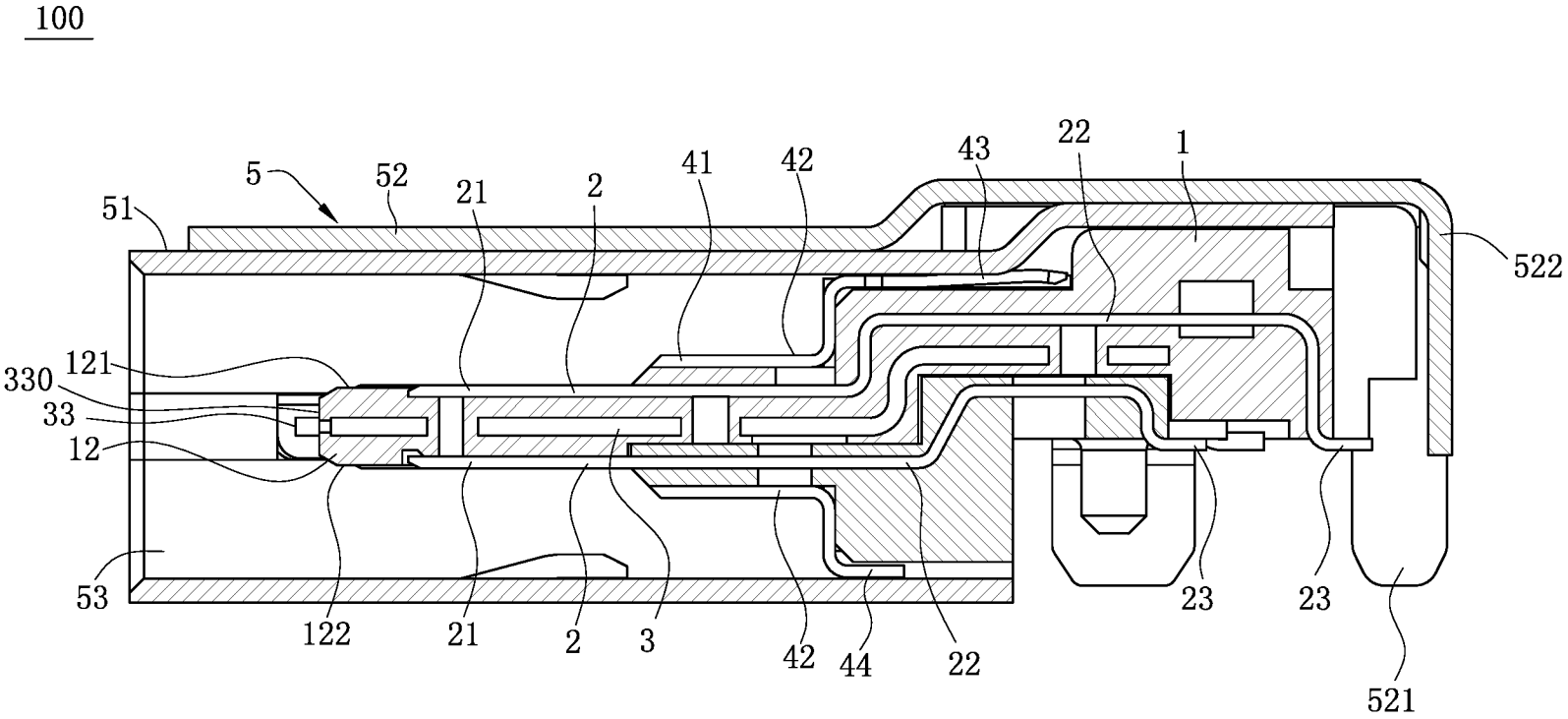
FIG. 36 is a sectional view of the electrical connector according to the tenth embodiment of the present invention.
Figure 37:
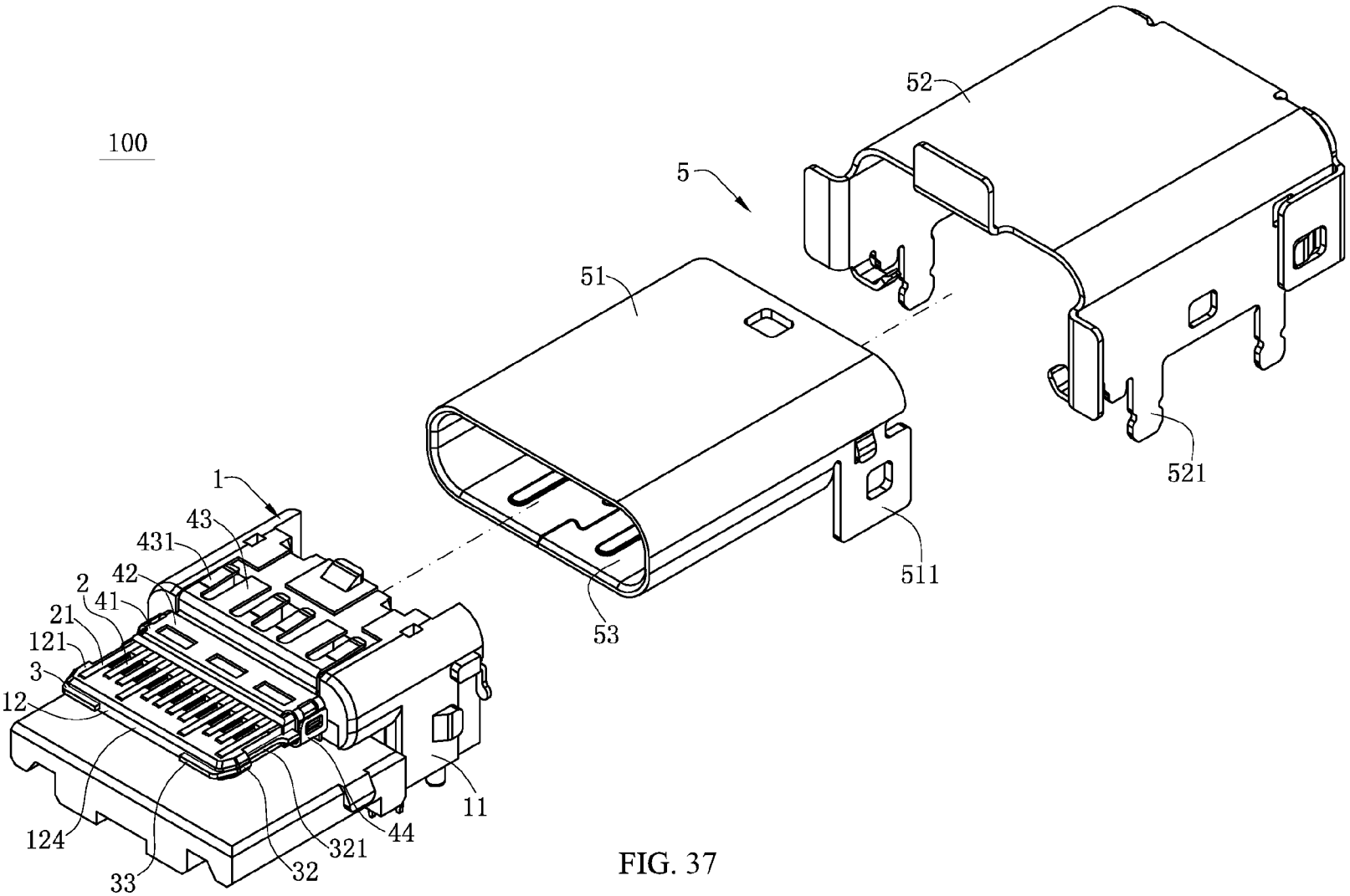
FIG. 37 is a partial three-dimensional exploded view of an electrical connector according to an eleventh embodiment of the present invention.
Figure 38:
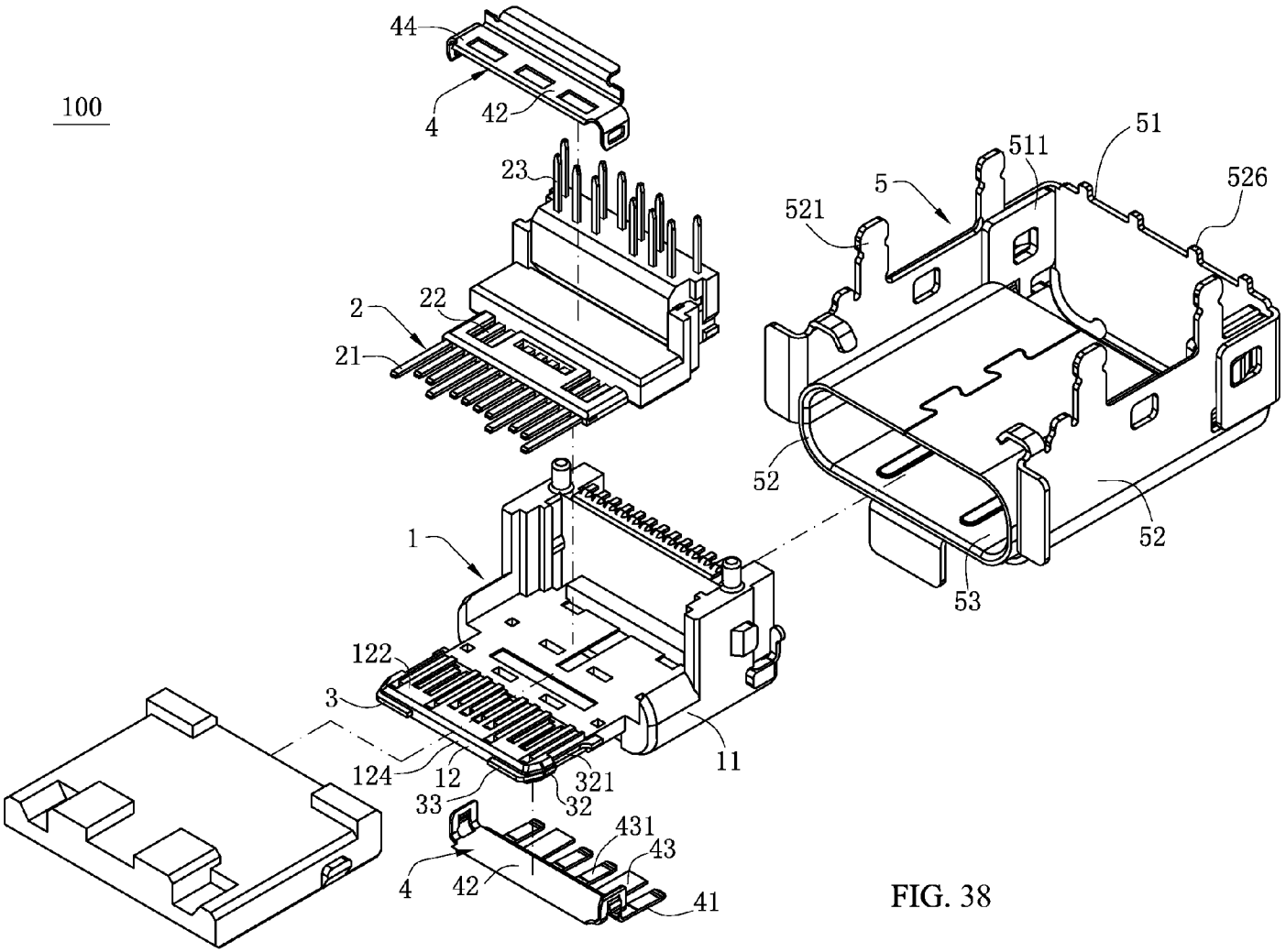
FIG. 38 is a three-dimensional exploded view of the electrical connector according to the eleventh embodiment of the present invention.
Figure 39:
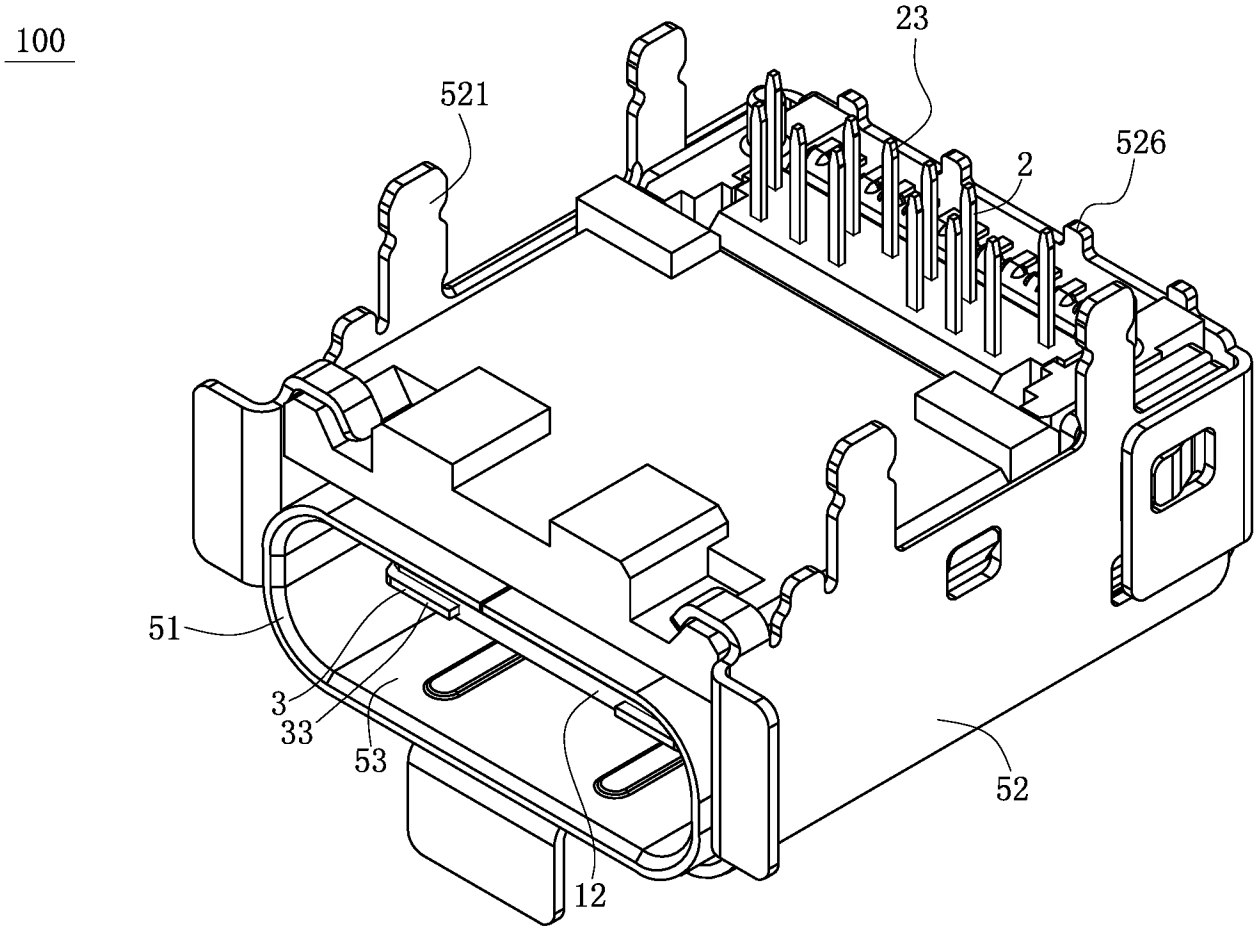
FIG. 39 is a three-dimensional assembly view of the electrical connector according to the eleventh embodiment of the present invention.
Figure 40:
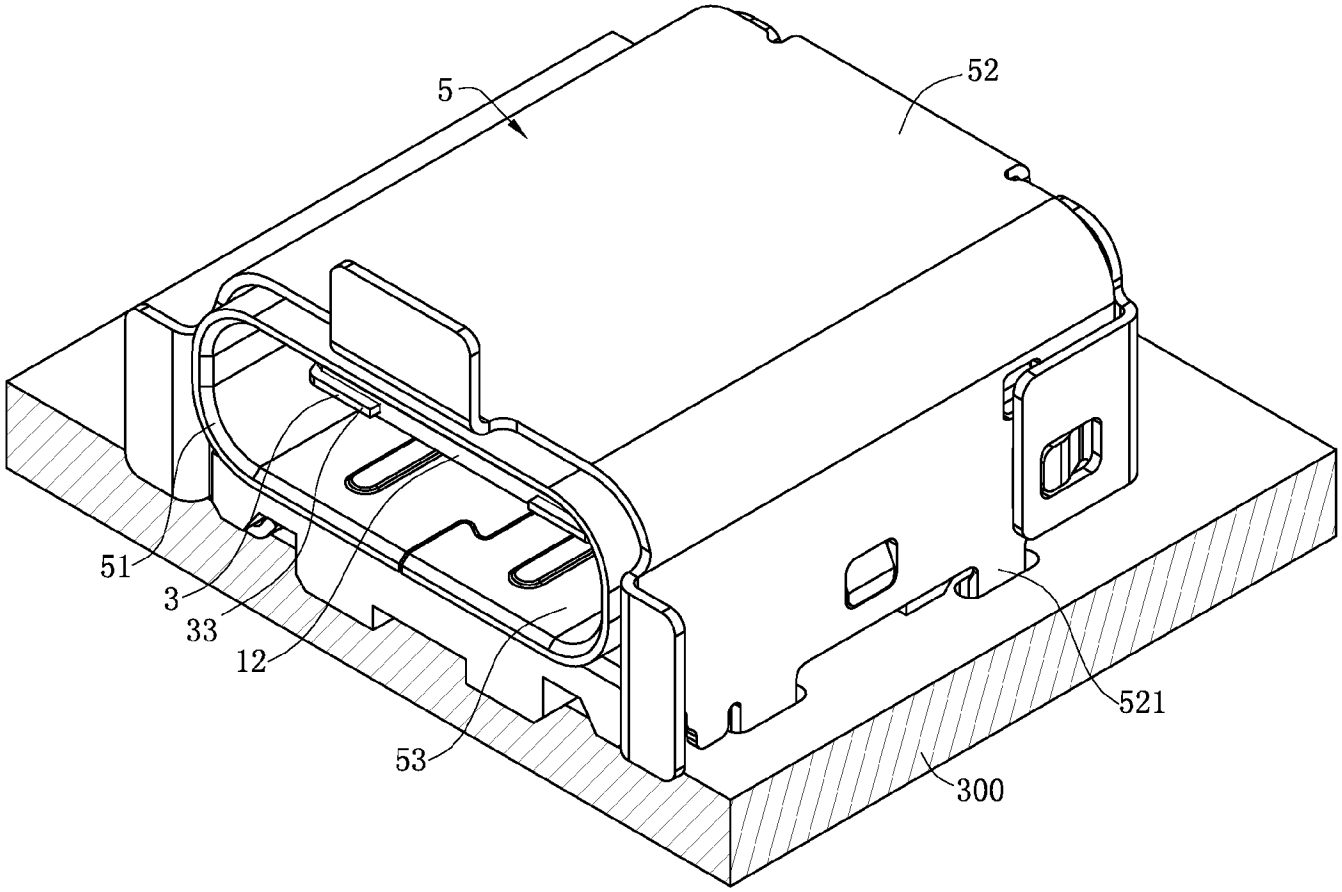
FIG. 40 is a three-dimensional assembly view of the electrical connector mounted on a circuit board according to the eleventh embodiment of the present invention.
Figure 41:
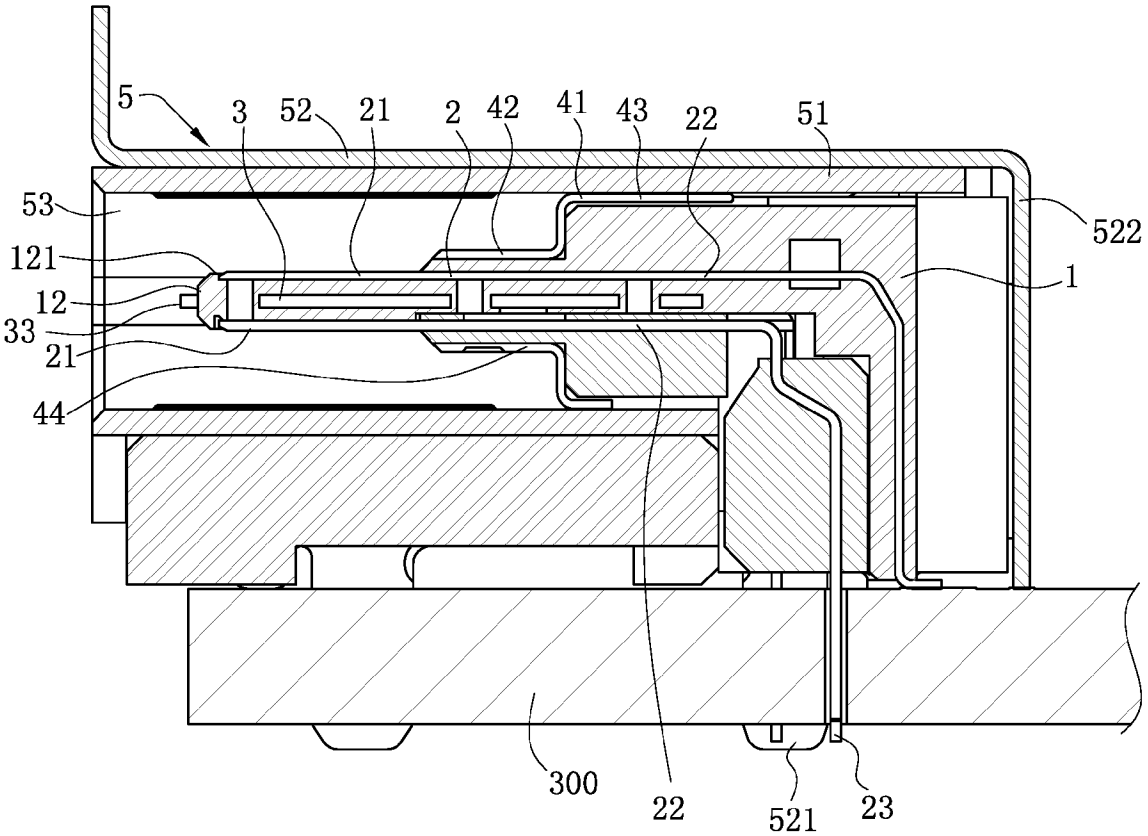
FIG. 41 is a sectional view of the electrical connector mounted on the circuit board according to the eleventh embodiment of the present invention.
Figure 42:
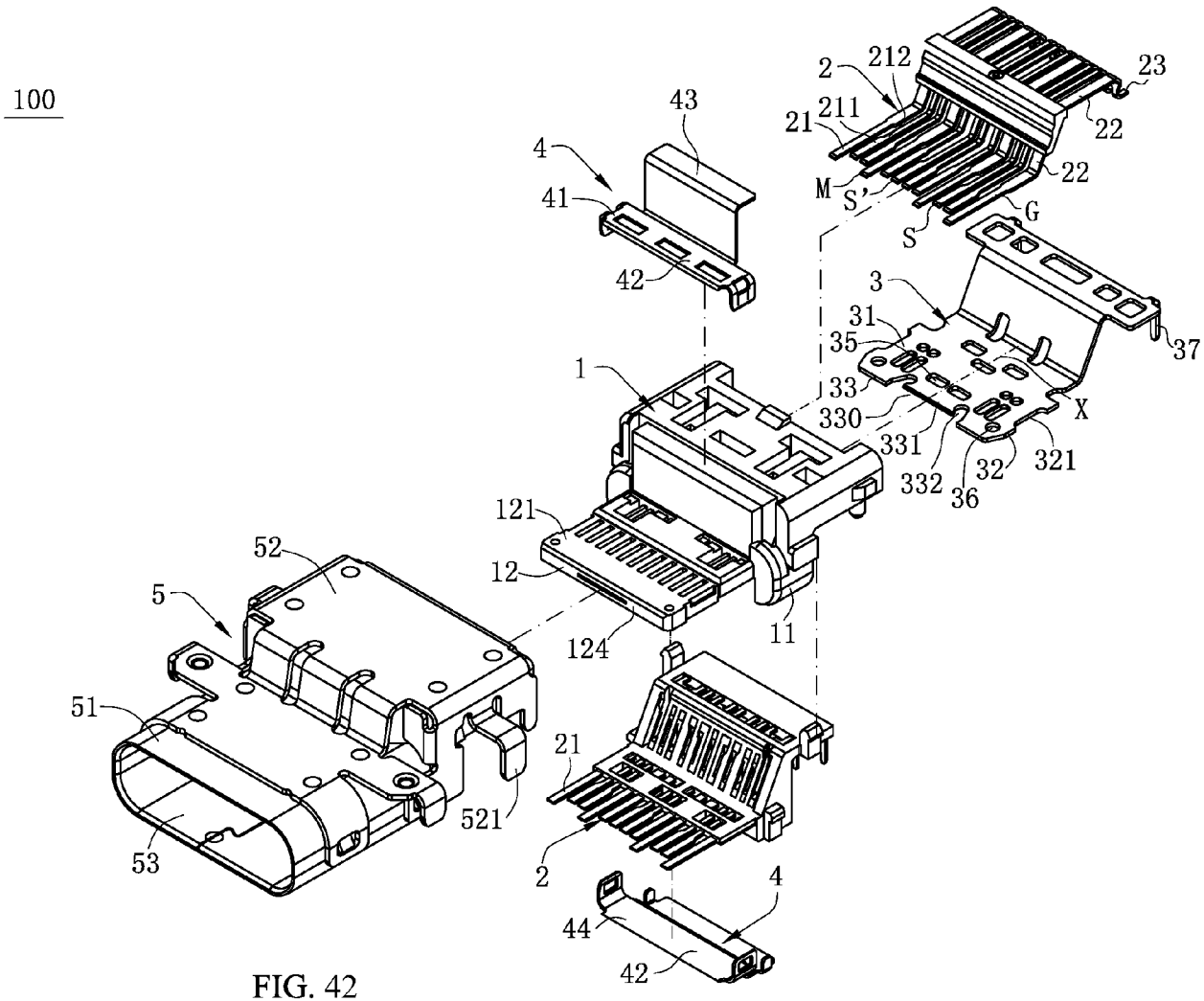
FIG. 42 is a three-dimensional exploded view of an electrical connector according to a twelfth embodiment of the present invention.
Figure 43:
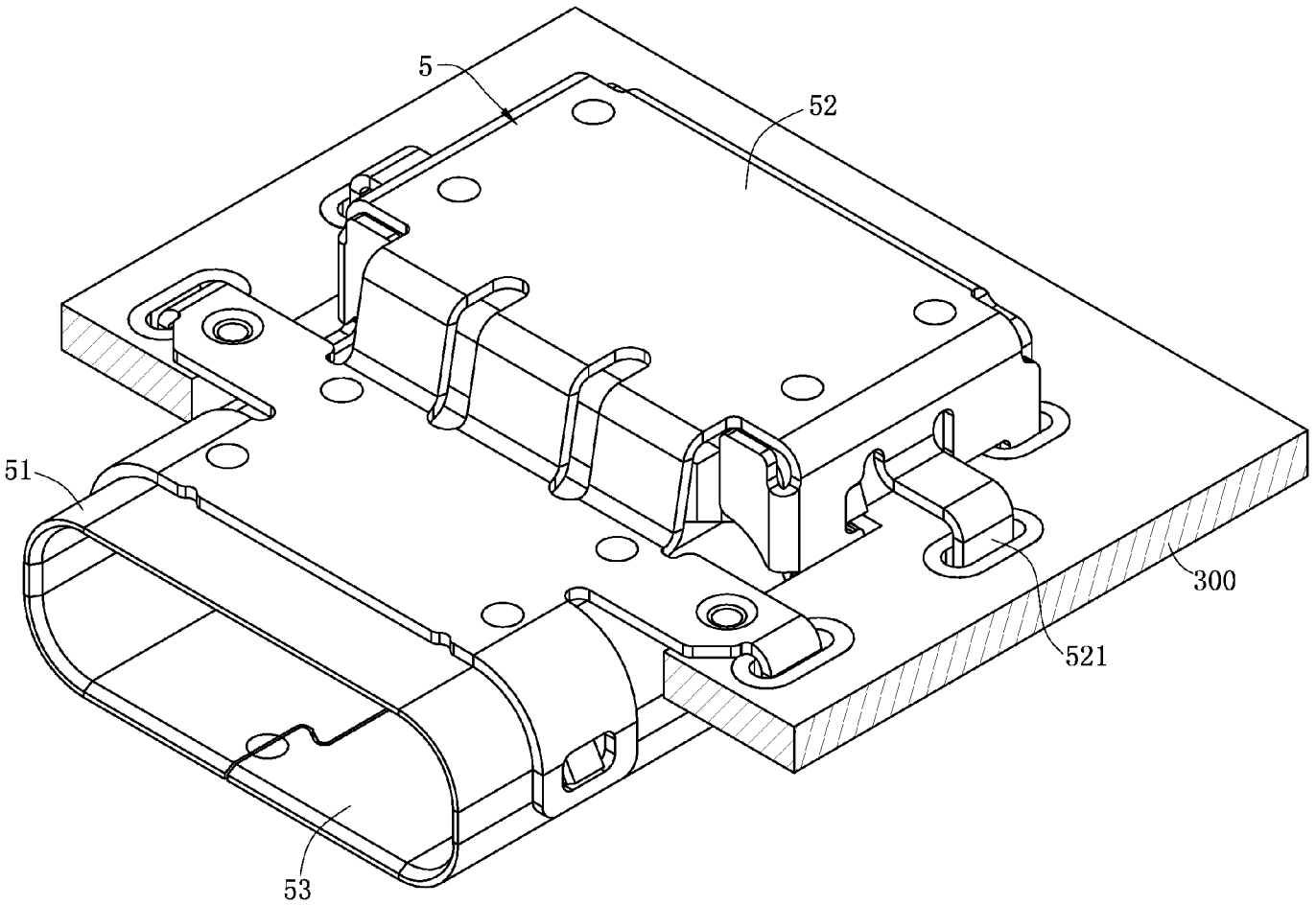
FIG. 43 is a three-dimensional assembly view of the electrical connector mounted on a circuit board according to the twelfth embodiment of the present invention.
Figure 44:
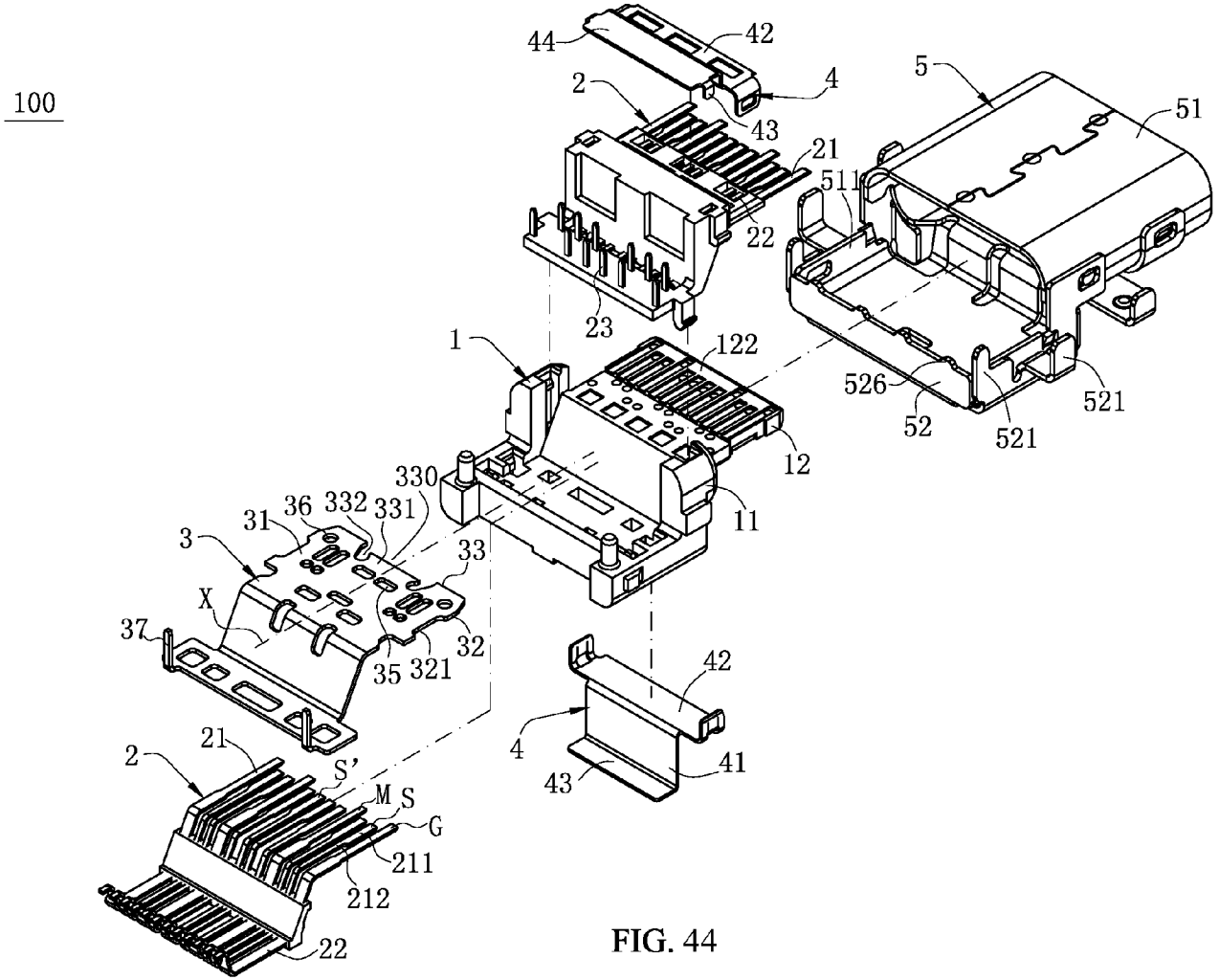
FIG. 44 is a three-dimensional exploded view of the electrical connector viewed from another viewing angle according to the twelfth embodiment of the present invention.
Figure 45:
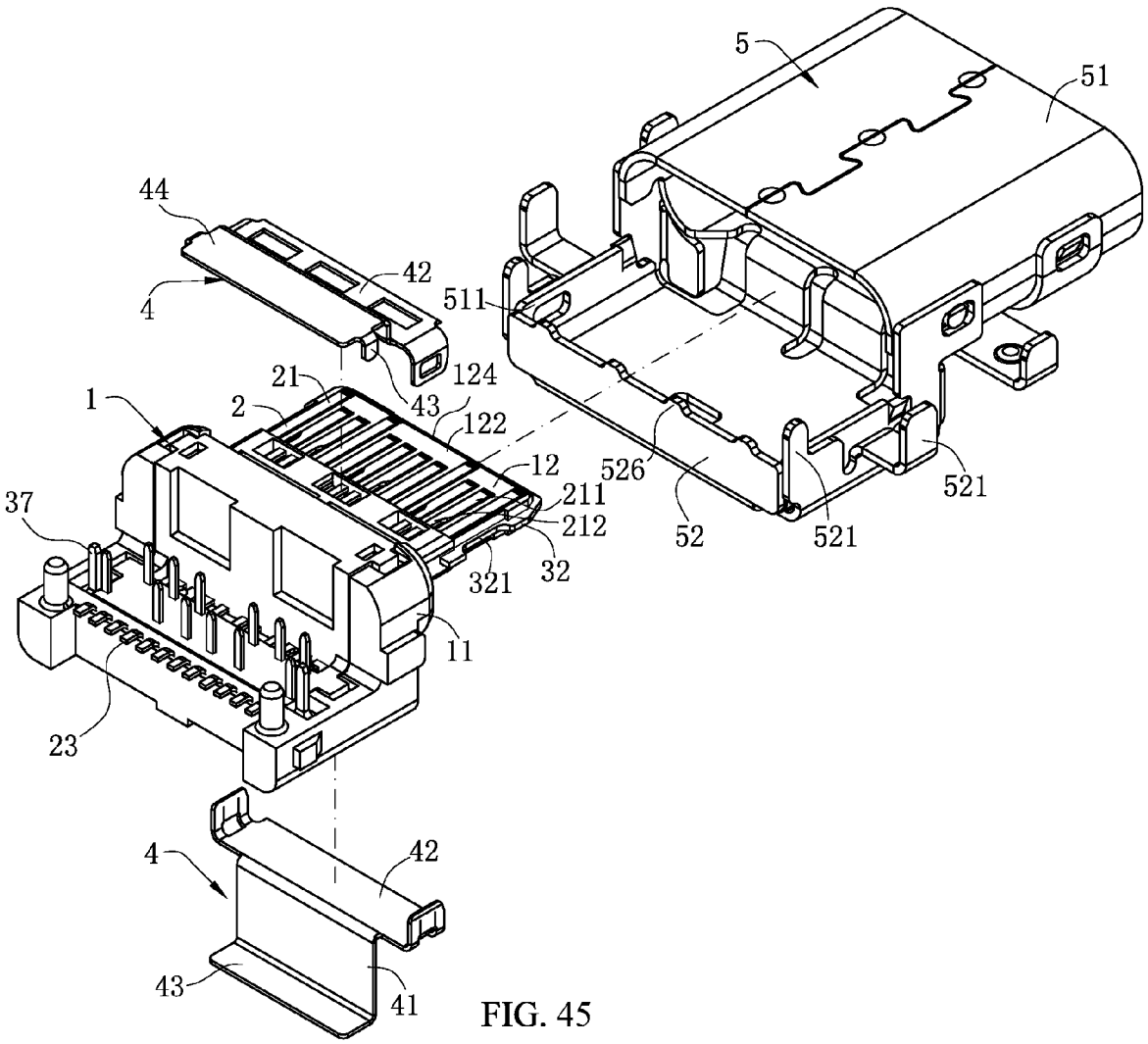
FIG. 45 is a partial three-dimensional exploded view of the electrical connector viewed from another viewing angle according to the twelfth embodiment of the present invention.
Figure 46:
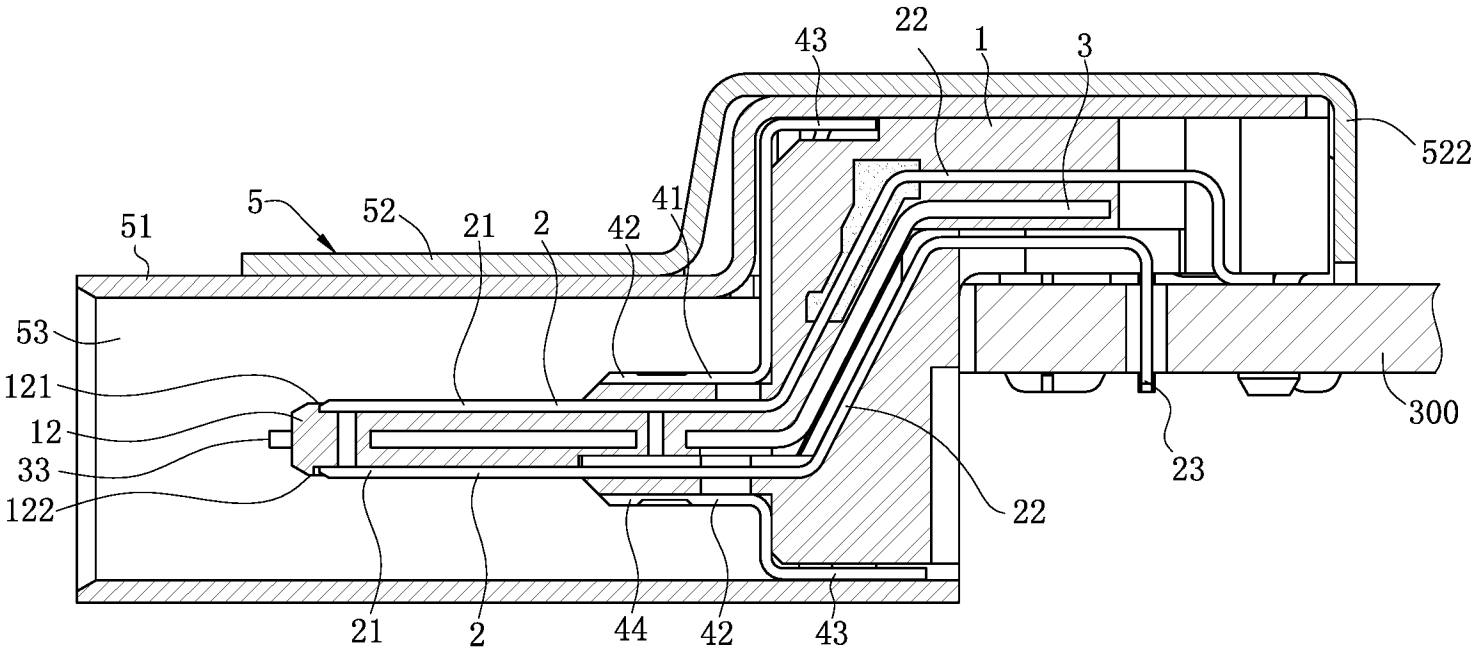
FIG. 46 is a sectional view of the electrical connector according to the twelfth embodiment of the present invention.
Figure 47:
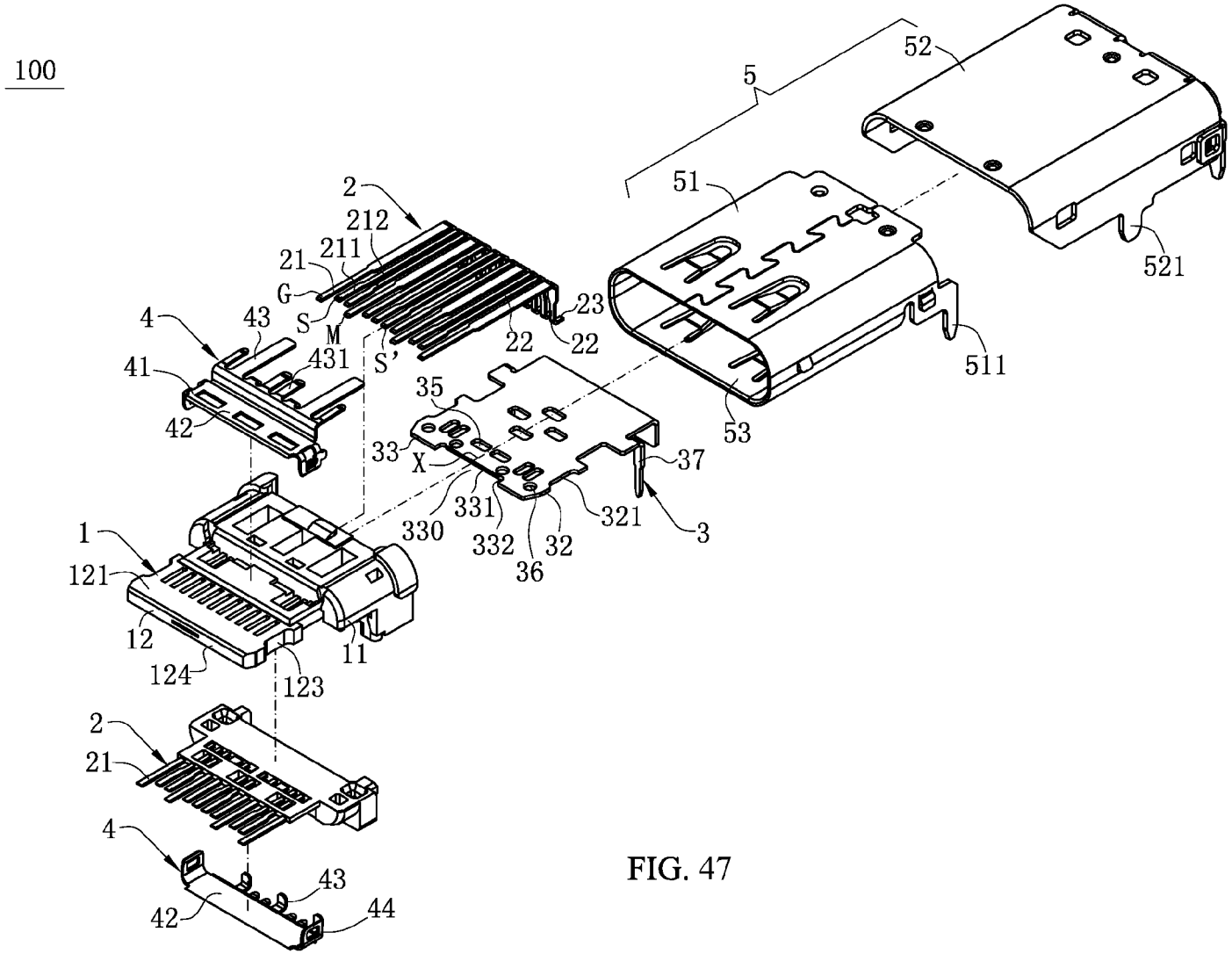
FIG. 47 is a three-dimensional exploded view of an electrical connector according to a thirteenth embodiment of the present invention.

As shown in FIG. 31 and FIG. 36, the electrical connector 100 is also of a sinking board type, and a part of the tongue 12 and the lower row of terminals 2 are lower than the circuit board 300. A height difference is formed between the front segment and the rear segment of the shielding casing 52, the second soldering pins 521 are four in number, and are separately disposed at two sides of the shielding casing 52, and each of the front segment and the rear segment of the shielding casing 52 is provided with two second soldering pins. The sinking board is low, and structures of the electrical connector 100 fixed onto the circuit board 300 are less than those in the on-board type. Therefore, in order to improve the strength, welding is performed between the wrapping casing 51 and the shielding casing 52 by means of point welding, so as to further firmly fix the wrapping casing 51 and the shielding casing 52. Disposition of the four second soldering pins 521 also further ensures that the electrical connector 100 is stably welded to the circuit board 300.

As shown in FIG. 37 to FIG. 41, the electrical connector 100 is used in a desktop host. Because of disposition of external interfaces, the center of the electrical connector 100 is at a long distance from the upper surface of the circuit board 300, and the soldering portions 23 of the multiple terminals 2 need to be designed to be very long, and correspondingly, the first soldering pins 511 and the second soldering pins 521 also need to be designed to be very long, so that it can be satisfied that the electrical connector 100 is disposed relatively high on the upper surface of the circuit board 300. In order that the electrical connector 100 is stably mounted onto the circuit board 300, and the electrical connector 100 is not slanted when the mating connector 200 is inserted into the electrical connector 100, a heightening block is added between the electrical connector 100 and the circuit board 300, and the heightening block is used for supporting the electrical connector 100.

As shown in FIG. 42 to FIG. 46, the electrical connector 100 is also of a sinking board type, and the tongue 12 and the terminals 2 are all located below the circuit board 300. Two second holes 35 run through the plate portion 31, the two second holes 35 are located on two sides of the central line X, neighbor the central line X and are located behind the first projection portion 331. The pair of signal terminals S' neighbor the central line X, and the width of the second hole 35 is larger than the width of the signal terminal S', thereby the two second holes 35 and the pair of signal terminals S' are arranged in one-to-one vertical correspondence.

In summary, the electrical connector 100 and the electrical connector assembly of the present invention have the following beneficial effects.

(1) The tongue 12 has the front surface 124, the middle shielding sheet 3 is arranged on the tongue 12, and the slot 330 is formed on the front end surface 33, and overlaps the central line X. The front end surface 33 extends out of the front surface 124, and consequently, when the mating connector 200 is connected to the electrical connector 100, the abrasion of the front surface 124 can be prevented. The first projection portion 331 overlaps the central line X but does not extend beyond the front surface 124, and thereby is arranged to vertically correspond to the pair of USB 2.0 terminals, which enhances the shielding effect, helps the fixing of the tongue 12 on the middle shielding sheet 3, and effectively decreases the probability of short-circuiting caused by the electrical contact between the terminals and the middle shielding sheet 3 due to foreign matters (such as dust and moisture) attached outside of the tongue 12.

(2) The multiple fixing pins 526 extend downward from the second rear wall 522, and the multiple fixing pins 526 are located between the two second soldering pins 521, and are used for cooperating with the first soldering pins 511 and the second soldering pins 521 to steadily position the electrical connector 100 on the circuit board 300.

(3) The contact portion 21 of each differential signal terminal S has the first portion 211, the second portion 212 extends backward from the first portion 211, the width of the first portion 211 is larger than the width of the second portion 212, the distance between the two neighboring first portions 211 is larger than the distance between the two neighboring second portions 212, consequently, the anti-interference performance of the differential signal terminals is enhanced, and thereby high frequency is improved.

(4) The upper shielding sheet 41 has the extending portion 43 covering the base portion 11, so as to increase the coverage range of the inner metal casing 4, and can, when the electrical connector 100 performs high-speed signal transmission, more effectively prevent the electromagnetic radiation in the insertion space 53 from being leaked backward which interferes with the tail of the terminals 2 to cause crosstalk, thereby improving the signal transmission quality of the electrical connector 100.

(5) The middle shielding sheet 3 has the two protruding portions 32 exposed from the two sides of the tongue 12, and the groove 321 is disposed at the protruding portions 32. Because both the middle shielding sheet 3 and the metal elastic sheet 8 are made of a metal material, when the mating connector 200 enters the insertion space 53, the metal elastic sheet 8 and the groove 321 are snap-fit and fixed, which not only can implement stable buckling of the mating connector 200 and the electrical connector 100, but also can prevent the abrasion problem.

Additionally, the protruding portion 32 and the groove 321 extend out of the two sides of the tongue 12 and are located in the insertion space 53, which helps the mating connector 200 enter the insertion space 53 to snap-fit the groove 321, the snap-fit strength is large, and the mating connector 200 is not easily disengaged.

The foregoing description of the exemplary embodiments of the disclosure has been presented only for the purposes of illustration and description and is not intended to be exhaustive or to limit the disclosure to the precise forms disclosed. Many modifications and variations are possible in light of the above teaching.

The embodiments were chosen and described in order to explain the principles of the disclosure and their practical application so as to enable others skilled in the art to utilize the disclosure and various embodiments and with various modifications as are suited to the particular use contemplated. Alternative embodiments will become apparent to those skilled in the art to which the present disclosure pertains without departing from its spirit and scope. Accordingly, the scope of the present disclosure is defined by the appended claims rather than the foregoing description and the exemplary embodiments described therein.

What is claimed is:

1. An electrical connector for mating a mating connector, comprising:

an insulation body, having a base portion; and a tongue extending from the base portion and having an upper surface;

a lower surface arranged opposite to the upper surface; and a front surface connected to the upper surface and the lower surface;

a plurality of terminals, fixedly disposed in the base portion and grouped into an upper row of terminals and a lower row of terminals, wherein the upper row of terminals are exposed on the upper surface, the lower row of terminals are exposed on the lower surface, and wherein each of the terminals has a connecting portion, and the connecting portion is embedded in the base portion;

a middle shielding sheet, embedded in the tongue, located between the upper row of terminals and the lower row of terminals, and having a front end surface, extending out of the front surface;

a slot, formed on the front end surface;

a first projection portion, extending into the slot, overlapping a central line of the middle shielding sheet along a longitudinal direction, and located behind the front surface; and a metal casing wrapping the insulation body, comprising a shielding casing; and a wrapping casing, wrapping the base portion and the tongue, wherein the shielding casing is arranged outside of the wrapping casing;

wherein the wrapping casing has a first rear wall, the shielding casing has a second rear wall, the first rear wall and the second rear wall cover the base portion, and projections of the first rear wall, the second rear wall and connecting portions of the terminals in the longitudinal direction overlap each other;

wherein each of two sides of the shielding casing has a second soldering pin, the two second soldering pins are located on two sides of the insulation body, a fixing pin extends from the second rear wall, and the fixing pin is located between the two second soldering pins.

2. The electrical connector according to claim 1, wherein the terminals include a pair of signal terminals in compliance with USB 2.0 specifications and arranged to vertically correspond to the first projection portion.

3. The electrical connector according to claim 2, wherein the middle shielding sheet has a first hole located behind the first projection portion, overlapping the central line of the middle shielding sheet along the longitudinal direction, and arranged to vertically correspond to the pair of signal terminals.

4. The electrical connector according to claim 2, wherein the middle shielding sheet has two second holes located behind the first projection portion and on two sides of the central line of the middle shielding sheet along the longitudinal direction, and arranged to one-to-one vertically correspond to the pair of signal terminals.

5. The electrical connector according to claim 1, wherein the middle shielding sheet has a third hole located between the slot and a side edge of the middle shielding sheet, the terminals include a grounding terminal, and the third hole is arranged to vertically correspond to the grounding terminal.

6. The electrical connector according to claim 1, wherein the slot defines a first space located on one side of the first projection portion, the terminals include a power supply terminal, and the power supply terminal is arranged to vertically correspond to the first space.

7. The electrical connector according to claim 1, wherein each of the upper and lower rows of the terminals include at least one pair of differential signal terminals, each differential signal terminal has a first portion and a second portion extending from the first portion, the first portion and the second portion are arranged on the tongue, and a width of the first portion is larger than a width of the second portion.

8. The electrical connector according to claim 7, wherein a distance between two neighboring first portions of the differential signal terminals is larger than a distance between two neighboring second portions of the differential signal terminals.

9. The electrical connector according to claim 7, wherein each row of the upper and lower rows of the terminals include two non-high-speed terminals arranged on two sides of the pair of differential signal terminals, and a distance between the first portion and the neighboring non-high-speed terminal is less than the distance between the second portion and the neighboring non-high-speed terminal.

10. The electrical connector according to claim 1, wherein each of the terminals has a soldering portion extending out of the base portion, soldering portions of the upper row of terminals are arranged in a row, and the soldering portions of the lower row of terminals are arranged in two rows.

11. The electrical connector according to claim 1, wherein the middle shielding sheet extends and bends to form a pin, the pin extends out of the base portion, each of the terminals has a soldering portion extending out of the base portion, and soldering portions of the lower row of terminals and the pin are located on the same straight line.

12. The electrical connector according to claim 1, wherein each of two sides of the wrapping casing has a first soldering pin, first soldering pins and second soldering pins are staggered in the longitudinal direction, the first soldering pins are closer to the base portion than the second soldering pins are, and the second soldering pins are closer to the tongue than the first soldering pins are.

* * * * *